US010874922B2

(12) United States Patent
Harbert et al.

(10) Patent No.: US 10,874,922 B2
(45) **Date of Patent: *Dec. 29, 2020**

(54) GOLF CLUB HEADS

(71) Applicant: Taylor Made Golf Company, Inc., Carlsbad, WA (US)

(72) Inventors: Christopher John Harbert, Carlsbad, CA (US); Nathan T. Sargent, Oceanside, CA (US); Justin David Kleinert, San Clemente, CA (US); Todd P. Beach, Encinitas, CA (US); Brian Bazzel, Carlsbad, CA (US); Robert Nunez, Vista, CA (US); James Edward Michael Cornish, Carlsbad, CA (US); Nick Robbie, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/283,527

(22) Filed: Feb. 22, 2019

(65) Prior Publication Data

US 2019/0184246 A1 Jun. 20, 2019

Related U.S. Application Data

(63) Continuation of application No. 15/996,854, filed on Jun. 4, 2018, now abandoned.
(Continued)

(51) Int. Cl.
*A63B 53/06* (2015.01)
*A63B 53/04* (2015.01)
(Continued)

(52) U.S. Cl.
CPC ..... *A63B 53/06* (2013.01); *A63B 53/0466* (2013.01); *A63B 53/08* (2013.01);
(Continued)

(58) Field of Classification Search
CPC ..... A63B 53/06; A63B 1/00; A63B 53/0466; A63B 53/08; A63B 53/0437;
(Continued)

(56) References Cited

U.S. PATENT DOCUMENTS 3,897,066 A 7/1975 Belmont
5,445,382 A 8/1995 Pearce et al.
(Continued)

FOREIGN PATENT DOCUMENTS

EP 2937118 10/2015
GB 20747 A 9/1910
JP 2006320493 11/2006

OTHER PUBLICATIONS

Bond Laminates, "Advanced thermoplastic composites—Texpex", pp. 1-7 (2013).

(Continued)

*Primary Examiner* — Stephen L Blau
(74) *Attorney, Agent, or Firm* — Klarquist Sparkman, LLP

(57) ABSTRACT

Some disclosed golf club heads include body having at least one raised sole portion and a cantilevered ledge extending down around a perimeter of the club head below the level of the raised sole portion. Some disclosed golf club heads include one or more sole openings in the body and a sole insert that is mounted inside the body over the sole openings. The sole can include weight tracks as well, and a rear weight track can extend between a toe side sole opening and a heel side sole opening. A crown insert can also be included that is mounted over an upper opening in the body.

15 Claims, 49 Drawing Sheets

Related U.S. Application Data

(60) Provisional application No. 62/628,094, filed on Feb. 8, 2018, provisional application No. 62/515,401, filed on Jun. 5, 2017.

(51) Int. Cl.
*A63B 53/08* (2015.01)
*A63B 102/32* (2015.01)

(52) U.S. Cl.
CPC ... *A63B 53/0437* (2020.08); *A63B 2053/0491* (2013.01); *A63B 2102/32* (2015.10); *A63B 2220/803* (2013.01); *A63B 2220/833* (2013.01); *A63B 2225/50* (2013.01)

(58) Field of Classification Search
CPC ..... A63B 2102/32; A63B 2053/0491; A63B 53/0433; A63B 53/04; A63B 60/46; A63B 60/002; A63B 60/04; A63B 2225/50; A63B 2209/02; A63B 2209/00; A63B 2225/54; A63B 2220/35; A63B 2220/12; A63B 2220/833; A63B 2220/30; A63B 2209/023; A63B 2209/10; A63B 2225/01; A63B 2220/803; A63B 2220/89; A63B 24/0003; A63B 2220/40; A63B 2220/62; A63B 60/00
See application file for complete search history.

(56) References Cited

U.S. PATENT DOCUMENTS 5,447,309 A 9/1995 Vincent
5,518,243 A 5/1996 Redman
5,624,331 A 4/1997 Lo et al.
5,709,610 A * 1/1998 Ognjanovic ..... A63B 69/3617 473/220
5,935,020 A 8/1999 Stites et al.
5,997,415 A 12/1999 Wood
6,102,813 A 8/2000 Dill
6,123,627 A 9/2000 Antonious
6,146,571 A 11/2000 Vincent et al.
6,254,494 B1 7/2001 Hasebe
6,565,452 B2 5/2003 Helmsetter
6,648,773 B1 11/2003 Evans
6,663,503 B1 12/2003 Kenmi
6,773,360 B2 8/2004 Willett et al.
6,800,038 B2 10/2004 Willett et al.
6,824,475 B2 11/2004 Burnett et al.
6,824,860 B2 11/2004 Edwards et al.
6,872,152 B2 3/2005 Beach et al.
6,929,565 B2 8/2005 Nakahara et al.
6,939,247 B1 9/2005 Schweigert et al.
6,945,876 B2 9/2005 Nakahara et al.
6,991,558 B2 1/2006 Beach et al.
6,997,820 B2 2/2006 Willett et al.
7,063,629 B2 6/2006 Nakahara et al.
7,147,577 B2 12/2006 Nakahara et al.
7,166,040 B2 1/2007 Hoffman et al.
7,166,041 B2 * 1/2007 Evans ..... A63B 53/0466 473/334
7,169,064 B2 1/2007 Nakahara et al.
7,186,190 B1 3/2007 Beach et al.
7,198,575 B2 4/2007 Beach et al.
7,214,142 B2 5/2007 Meyer et al.
7,217,199 B2 5/2007 Nakahara et al.
7,223,180 B2 5/2007 Willett et al.
7,267,620 B2 9/2007 Chao et al.
7,273,423 B2 9/2007 Imamoto
7,303,487 B2 12/2007 Kumamoto
7,306,527 B2 12/2007 Williams et al.
7,371,191 B2 5/2008 Sugimoto
7,407,447 B2 8/2008 Beach et al.
7,407,448 B2 * 8/2008 Stevens ..... A63B 60/00 473/329
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,530,901 B2 5/2009 Imamoto et al.
7,530,904 B2 5/2009 Beach et al.
7,540,811 B2 6/2009 Beach et al.
7,559,853 B2 7/2009 Hirano
7,568,985 B2 8/2009 Beach et al.
7,578,753 B2 8/2009 Beach et al.
7,591,738 B2 9/2009 Beach et al.
7,611,424 B2 * 11/2009 Nagai ..... A63B 53/0466 473/334
7,621,823 B2 11/2009 Beach et al.
7,628,707 B2 12/2009 Beach et al.
7,632,194 B2 12/2009 Beach et al.
7,691,008 B2 4/2010 Oyama
7,713,142 B2 5/2010 Hoffman et al.
7,717,804 B2 5/2010 Beach et al.
7,717,805 B2 5/2010 Beach et al.
7,744,484 B1 6/2010 Chao
7,775,905 B2 8/2010 Beach et al.
7,824,280 B2 11/2010 Yokota
7,846,041 B2 12/2010 Beach et al.
7,874,936 B2 1/2011 Chao
7,874,937 B2 1/2011 Chao
7,887,436 B2 * 2/2011 Hirano ..... A63B 53/0466 473/345
7,954,526 B2 * 6/2011 Chen ..... A63B 60/62 150/160
7,963,861 B2 6/2011 Beach et al.
RE42,544 E 7/2011 Chao et al.
7,985,146 B2 7/2011 Lin et al.
7,993,216 B2 8/2011 Lee
8,012,038 B1 9/2011 Beach et al.
8,016,694 B2 * 9/2011 Llewellyn ..... A63B 53/0466 473/334
8,025,587 B2 9/2011 Beach et al.
8,096,897 B2 1/2012 Beach et al.
8,117,903 B2 * 2/2012 Golden ..... A63B 24/0003 473/223
8,167,737 B2 * 5/2012 Oyama ..... A63B 53/0466 473/330
8,192,303 B2 6/2012 Ban
8,226,501 B2 7/2012 Stites et al.
8,235,831 B2 8/2012 Beach et al.
8,246,488 B2 8/2012 Stevens et al.
8,298,096 B2 10/2012 Stites et al.
8,303,431 B2 11/2012 Beach et al.
8,337,319 B2 12/2012 Sargent et al.
8,353,786 B2 1/2013 Beach et al.
8,425,349 B2 4/2013 Dawson et al.
8,430,763 B2 4/2013 Beach et al.
8,435,137 B2 5/2013 Hirano
8,444,505 B2 5/2013 Beach et al.
8,533,060 B1 * 9/2013 Arluna ..... A63B 53/06 705/26.1
8,550,934 B2 10/2013 Evans
8,579,722 B1 * 11/2013 Beach ..... A63B 60/00 473/329
8,608,591 B2 12/2013 Chao et al.
8,628,434 B2 1/2014 Chao
8,696,491 B1 * 4/2014 Myers ..... A63B 53/0466 473/334
8,708,838 B2 4/2014 Ferguson et al.
8,734,271 B2 5/2014 Beach et al.
8,771,097 B2 7/2014 Bennett et al.
8,870,678 B2 10/2014 Beach et al.
8,882,609 B2 11/2014 Boyd et al.
8,888,604 B2 * 11/2014 Davenport ..... A63B 53/0466 473/223
8,900,069 B2 12/2014 Beach et al.
8,926,450 B2 1/2015 Takahashi et al.
9,033,821 B2 5/2015 Beach et al.
9,089,747 B2 7/2015 Boyd et al.
9,101,811 B1 8/2015 Goudarzi et al.
9,162,120 B2 10/2015 Jertson et al.

(56) References Cited

U.S. PATENT DOCUMENTS

| | | | | |
|---|---|---|---|---|
| 9,168,435 | B1 | 10/2015 | Boggs et al. | |
| 9,174,096 | B2 | 11/2015 | Sargent et al. | |
| 9,180,349 | B1 | 11/2015 | Seluga et al. | |
| 9,199,145 | B1 | 12/2015 | Myers | |
| 9,211,449 | B2 | 12/2015 | Demille et al. | |
| 9,211,453 | B1 | 12/2015 | Foster et al. | |
| 9,216,332 | B1 | 12/2015 | Ehlers et al. | |
| 9,238,162 | B2 | 1/2016 | Breier et al. | |
| 9,259,625 | B2 | 2/2016 | Sargent et al. | |
| 9,278,262 | B2 | 3/2016 | Sargent et al. | |
| 9,283,449 | B1 | 3/2016 | Demille et al. | |
| 9,289,660 | B1 * | 3/2016 | Myers | A63B 53/06 |
| 9,393,471 | B2 | 7/2016 | Beno et al. | |
| 9,421,438 | B2 | 8/2016 | Beno et al. | |
| 9,561,413 | B2 | 2/2017 | Nielson et al. | |
| 9,636,556 | B2 * | 5/2017 | Beck | A63B 60/00 |
| 9,744,412 | B2 | 8/2017 | Boggs et al. | |
| 9,746,354 | B2 * | 8/2017 | Martin | G01D 11/245 |
| 9,764,210 | B2 | 9/2017 | Curtis et al. | |
| 9,914,027 | B1 | 3/2018 | Harbert et al. | |
| 10,076,688 | B1 | 9/2018 | Harbert et al. | |
| 10,137,347 | B2 * | 11/2018 | Thornton | A63B 69/36 |
| 2002/0160854 | A1 | 10/2002 | Beach et al. | |
| 2003/0175520 | A1 | 9/2003 | Grutta et al. | |
| 2003/0236132 | A1 | 12/2003 | Burrows | |
| 2004/0116207 | A1 | 6/2004 | DeShiell et al. | |
| 2004/0121853 | A1 | 6/2004 | Caldwell et al. | |
| 2005/0159243 | A1 | 7/2005 | Chuang | |
| 2005/0288124 | A1 | 12/2005 | Galloway et al. | |
| 2006/0052177 | A1 | 3/2006 | Nakahara et al. | |
| 2006/0122004 | A1 | 6/2006 | Chen et al. | |
| 2006/0135281 | A1 | 6/2006 | Palumbo et al. | |
| 2006/0229141 | A1 | 10/2006 | Galloway | |
| 2007/0049416 | A1 | 3/2007 | Shear | |
| 2008/0051218 | A1 | 2/2008 | Rae et al. | |
| 2008/0113827 | A1 | 5/2008 | Werner et al. | |
| 2008/0139334 | A1 | 6/2008 | Willett et al. | |
| 2008/0139339 | A1 | 6/2008 | Cheng | |
| 2008/0149264 | A1 | 6/2008 | Chao | |
| 2008/0153624 | A1 | 6/2008 | Ban et al. | |
| 2008/0261715 | A1 | 10/2008 | Carter | |
| 2009/0163289 | A1 | 6/2009 | Chao | |
| 2009/0291775 | A1 * | 11/2009 | Hirano | A63B 53/0466 473/345 |
| 2010/0069170 | A1 * | 3/2010 | Bennett | A63B 53/02 473/288 |
| 2010/0075773 | A1 * | 3/2010 | Casati, Jr. | A63B 60/02 473/334 |
| 2010/0125000 | A1 | 5/2010 | Lee | |
| 2010/0137074 | A1 | 6/2010 | Gilbert et al. | |
| 2010/0144461 | A1 | 6/2010 | Ban | |
| 2010/0292027 | A1 | 11/2010 | Beach et al. | |
| 2011/0152000 | A1 | 6/2011 | Sargent et al. | |
| 2011/0159986 | A1 | 6/2011 | Chao et al. | |
| 2011/0312437 | A1 | 12/2011 | Sargent et al. | |
| 2012/0071264 | A1 | 3/2012 | Beach et al. | |
| 2012/0094781 | A1 | 4/2012 | Breier et al. | |
| 2012/0108358 | A1 | 5/2012 | Sugimoto | |
| 2012/0122601 | A1 | 5/2012 | Beach et al. | |
| 2012/0220387 | A1 | 8/2012 | Beach et al. | |
| 2012/0295504 | A1 | 11/2012 | Miyauchi et al. | |
| 2013/0123040 | A1 | 5/2013 | Willett et al. | |
| 2013/0130831 | A1 | 5/2013 | Morales et al. | |
| 2013/0178306 | A1 | 7/2013 | Beno et al. | |
| 2013/0184098 | A1 * | 7/2013 | Boyd | A63B 53/14 473/307 |
| 2013/0344976 | A1 * | 12/2013 | Stites | A63B 60/52 473/291 |
| 2014/0057737 | A1 | 2/2014 | Solheim et al. | |
| 2014/0080617 | A1 | 3/2014 | Llewellyn et al. | |
| 2014/0080628 | A1 | 3/2014 | Sargent et al. | |
| 2014/0113742 | A1 | 4/2014 | Zimmerman et al. | |
| 2014/0162809 | A1 | 6/2014 | Soracco | |
| 2015/0031468 | A1 | 1/2015 | Matsunaga et al. | |
| 2015/0038258 | A1 | 2/2015 | Beach et al. | |
| 2015/0038259 | A1 | 2/2015 | Sander | |
| 2015/0057101 | A1 | 2/2015 | Sander | |
| 2015/0119165 | A1 | 4/2015 | Sander | |
| 2015/0297961 | A1 | 10/2015 | Voshall et al. | |
| 2015/0306473 | A1 | 10/2015 | Breier et al. | |
| 2015/0321055 | A1 | 11/2015 | Golden et al. | |
| 2016/0001146 | A1 | 1/2016 | Sargent et al. | |
| 2016/0008687 | A1 | 1/2016 | Sargent et al. | |
| 2016/0136490 | A1 | 5/2016 | Sargent et al. | |
| 2016/0287954 | A1 | 10/2016 | Sargent et al. | |
| 2016/0303443 | A1 * | 10/2016 | Boggs | A63B 53/047 |
| 2016/0346643 | A1 * | 12/2016 | Akiyama | A63B 53/00 |
| 2017/0087429 | A1 | 3/2017 | Nielson et al. | |

OTHER PUBLICATIONS

"Exposed: Peek Inside 9 of the Hottest Drivers in Golf," Tony Covey, Aug. 2, 2016, https://mygolfspy.com/a-look-inside-9-drivers/.

* cited by examiner

GOLF CLUB HEADS

CROSS-REFERENCE TO RELATED APPLICATIONS

This application is a continuation of U.S. patent application Ser. No. 15/996,854, filed Jun. 4, 2018, which claims priority to U.S. Provisional Patent Application No. 62/628,094, filed Feb. 8, 2018 and U.S. Provisional Patent Application No. 62/515,401, filed Jun. 5, 2017, all of which are incorporated by reference herein in their entireties.

FIELD

This disclosure is related to golf club heads, and particularly to golf club heads for drivers and other wood-type club heads.

BACKGROUND

Much of the recent improvement activity in the field of golf has involved the use of new and increasingly more sophisticated materials in concert with advanced club-head engineering. For example, modern "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods" since they tend to be made primarily of strong, lightweight metals, such as titanium.

An exemplary metalwood golf club such as a driver or fairway wood typically includes a hollow shaft having a lower end to which the club head is attached. Most modern versions of these club heads are made, at least in part, of a lightweight but strong metal such as titanium alloy. In many cases, the club head comprises a body made primarily of such strong metals.

Some current approaches to reducing structural mass of a metalwood club-head are directed to making one or more portions of the club head of an alternative material. Whereas the bodies and face plates of most current metalwoods are made of titanium alloys, some club heads are made, at least in part, of components formed from either graphite/epoxy-composite (or other suitable composite material) and a metal alloy. Graphite composites have a much lower density compared to titanium alloys, which offers an opportunity to provide more discretionary mass in the club-head.

The ability to utilize such materials to increase the discretionary mass available for placement at various points in the club-head allows for optimization of a number of physical properties of the club-head which can greatly impact the performance obtained by the user. Forgiveness on a golf shot is generally maximized by configuring the golf club head such that the center of gravity ("CG") of the golf club head is optimally located and the moment of inertia ("MOI") of the golf club head is maximized.

In addition to the use of various materials to optimize the strength-to-weight properties and acoustic properties of the club heads, advances have been made in the mass distribution properties provided by using thicker and thinner regions of materials, raising and lowering certain portions of the sole and crown, providing adjustable weight members and adjustable head-shaft connection assemblies, and many other club head engineering advances.

SUMMARY

Disclosed herein are wood-type golf club heads that include a body having at least one raised sole portion that provides a region of the sole with an increased curvature, which can stiffen the sole, reduce the mass of the sole, change the sound the club head makes, and/or provides other beneficial features. The raised sole portion can be bounded by portions of the body, such as cantilevered ledges on the periphery of the body, that extend down below the edges of the raised sole portion, such that the raised sole portion is elevated above where a conventional sole might be located on a comparable conventional club head. Some disclosed golf club heads include a body having one or more sole openings in raised sole portions and further comprise a sole insert that is mounted inside the body over the sole openings. The sole can include channels and/or weight tracks as well, such as a front channel or weight track forward of the raised sole portion and/or a rear weight track that extends between a toe side raised sole portion and a heel side raised sole portion. A crown insert can also be included that is mounted over an upper opening in the body.

The sole and crown inserts can be made of a less dense material relative to the body to provide mass savings. The raised sole portions can further provide mass savings by reducing the area of the sole, providing thinner portions of the sole where less rigidity is needed, and/or increasing the curvature of the sole, which decreases the need for additional sole ribs that help stiffen the sole. Some embodiments can have a bi-level sole, such as with a toe-side portion of the sole being a raised sole portion and a heel-side portion of the sole having a lower, more rigid construction. Some embodiments can include a single raised sole portion that extends across a majority of the sole. Some embodiments can include a first raised sole portion on the toe side of the sole and a second raised sole portion on a heel side of the sole, with a non-raised sole portion therebetween. In some such embodiments, a front-rear sliding weight track can extend between the two raised sole portions. The disclosed combinations of multi-material multi-component construction, mass adjustability features, raised sole and cantilevered ledge features, and other novel features provide unprecedented performance properties when striking a golf ball, including greater distance, greater accuracy and ball flight control, more forgiveness on off-center strikes, superior acoustics and appearance, greater durability, and improved customizability.

Some disclosed golf club heads comprise a weight track and at least one weight mounted in the weight track, with the weight track having three or more track branches, and each of the track branches having a respective terminal end and a joining end, wherein at the joining end each track branch joins with another portion of the weight track, wherein the weight track is continuous such that the at least one weight is adjustably slidable about all of the track branches without removing the at least one weight from the weight track, and wherein the at least one weight is securable to the weight track at different selectable positions located along each of the track branches. The weight track can have the shape of a T, Y, X, K, H or similar shape, for example.

Some disclosed golf club heads include a smart feature, such as a smart weight, that includes one or more sensors to measure swing characteristics, locations, or other useful information about a golfer's game. The smart feature can also include data storage and/or data transmission device, and a power source. The smart feature can also include a sensor that detects the presence or absence of a head cover, golf bag, or other device to enable the smart feature to decide when to enter a sleep mode for power conservation and when to enter an active mode.

The foregoing and other objects, features, and advantages of the disclosed technology will become more apparent from the following detailed description, which proceeds with reference to the accompanying figures.

DETAILED DESCRIPTION

Figure 1:
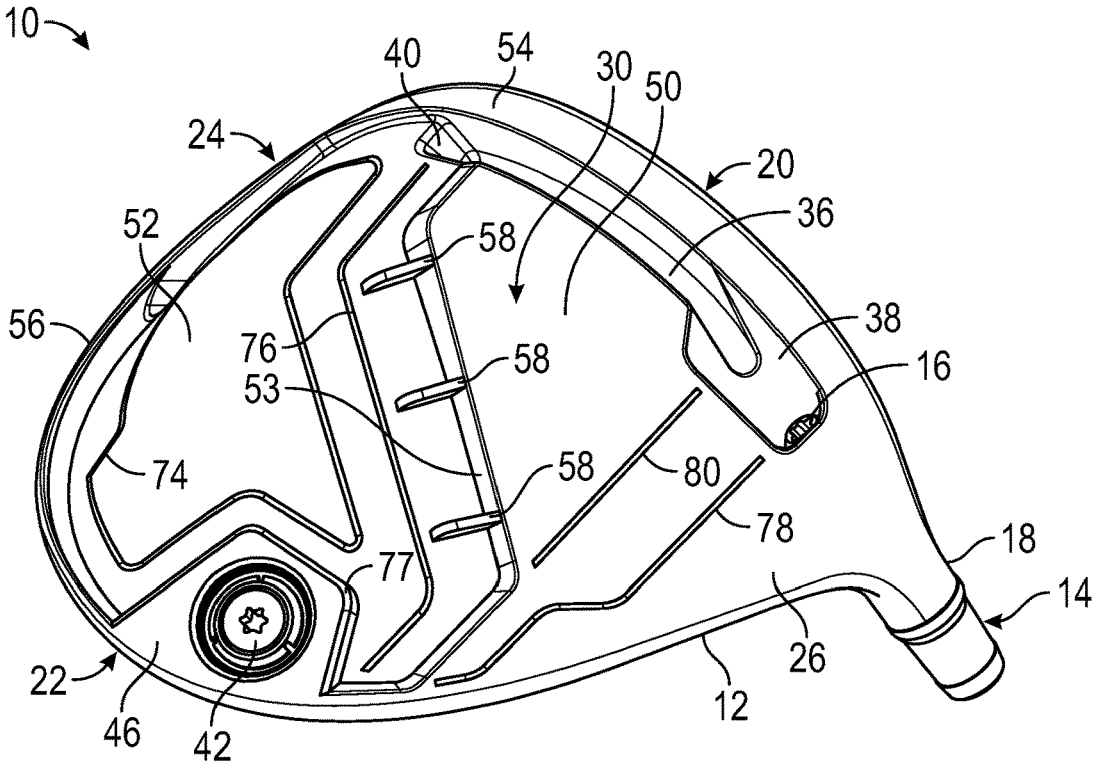
FIG. 1 is a bottom perspective view of an exemplary golf club head disclosed herein.
Figure 2:
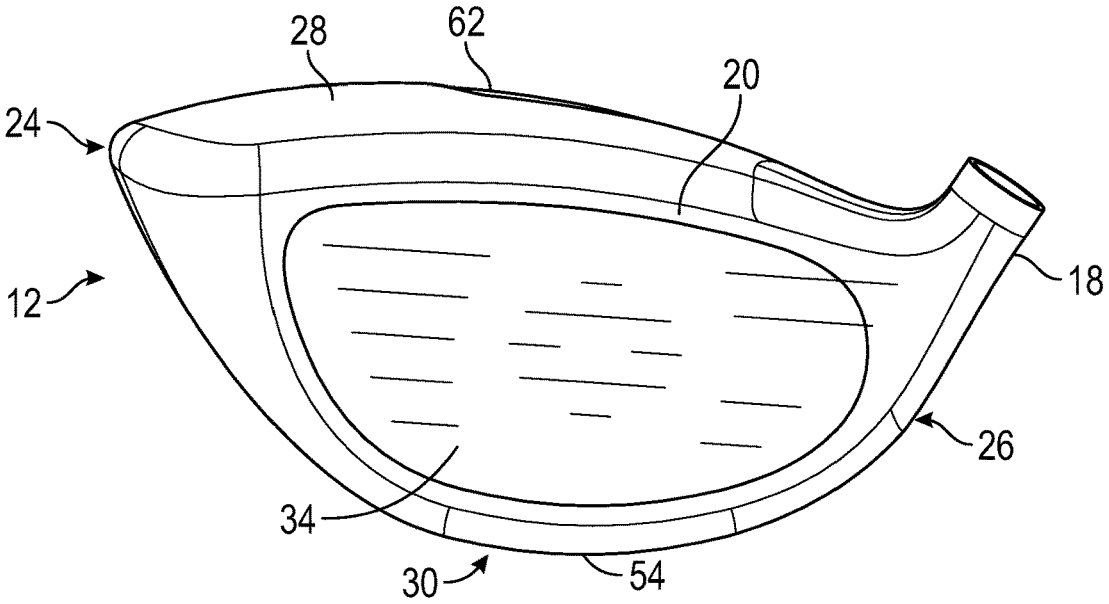
FIG. 2 is a front view of the body of the golf club head of FIG. 1.

This disclosure describes embodiments of golf club heads in the context of driver-type golf clubs, but the principles, methods and designs described may be applicable in whole or in part to other wood-type golf clubs, such as fairway woods, utility clubs (also known as hybrid clubs), and the like.

The disclosed inventive features include all novel and non-obvious features disclosed herein, both alone and in novel and non-obvious combinations with other elements. As used herein, the phrase "and/or" means "and," "or" and both "and" and "or." As used herein, the singular forms "a," "an" and "the" refer to one or more than one, unless the context clearly dictates otherwise. As used herein, the terms "including" and "having" (and their grammatical variants) mean "comprising."

This disclosure also makes reference to the accompanying drawings which form a part hereof. The drawings illustrate specific embodiments, but other embodiments may be formed and structural changes may be made without departing from the intended scope of this disclosure and the technology discussed herein. Directions and references (e.g., up, down, top, bottom, left, right, rearward, forward, heelward, toeward, etc.) may be used to facilitate discussion of the drawings but are not intended to be limiting. For example, certain terms may be used such as "up," "down," "upper," "lower," "horizontal," "vertical," "left," "right" and the like. These terms are used where applicable, to provide some clarity of description when dealing with relative relationships, particularly with respect to the illustrated embodiments. Such terms are not, however, intended to imply absolute relationships, positions and/or orientations, unless otherwise indicated. For example, with respect to an object, an "upper" surface can become a "lower" surface simply by turning the object over. Nevertheless, it is still the same object. Accordingly, the following detailed description shall not be construed in a limiting sense and the scope of property rights sought shall be defined by the appended claims and their equivalents.

FIGS. 1-10 illustrate an exemplary driver-type club head 10 that embodies certain inventive technologies disclosed herein. The head 10 comprises a body 12 (shown isolated in FIGS. 2, 4 and 5), an adjustable head-shaft connection assembly 14 (illustrated in FIGS. 3 and 10) via which a golf club shaft may be coupled to the hosel 18 via fastener 16, a crown insert 32 (see FIG. 3) that is attached to the body, and a sole weight assembly 42 (see FIGS. 1 and 3) that is adjustably mounted to the body. The head 10 defines a front end 20, rear end 22, toe side 24, heel side 26, lower side or sole 30, and upper side or crown 28 (all embodiments disclosed herein share similar directional references). The front end 20 includes a face or strike plate 34 (FIG. 2) for striking a golf ball, which may be an integral part of the body 12 or a separate insert. For example, though not shown, the body 12 can include a face opening to receive a face plate or strike plate 34 that is attached to the body by welding, braising, soldering, screws or other fastening means. A threaded weight port 44 at the rear of the sole threadably receives the adjustable weight 42, such that the weight can be adjusted vertically, or swapped out for other weights of different mass, as desired to change the mass properties of the club head.

The club head 10 also includes a front channel 36 in the body 12 near the front of the sole 30. The channel 36 extends in the toe-heel directions across the sole, with a heelward end 38 near the hosel 18 and an opposite toeward end 40. The heelward end 38 can have an enlarged width, which can allow for the fastener 16 to be inserted into the body from the channel to engage with the head-shaft connection assembly 14 within the hosel 18. The front channel can improve coefficient of restitution (COR) across the striking face and can provide increased forgiveness on off-center ball strikes. For example, the presence of the front channel can expand zones of the highest COR across the face of the club, particularly at the bottom of the club face near the channel, so that a larger fraction of the face area has a COR above a desired value, especially at the lower regions of the face. More information regarding the construction and performance benefits of the front channel 36 and similar front channels can be found in U.S. Pat. No. 8,870,678 and U.S. Publication Nos. 2016/0059094 A1, published Mar. 3, 2016, 2016/0023060 A1, published Jan. 28, 2016, and 2016/0023063 A1, published Jan. 28, 2016, all of which are incorporated by reference herein in their entireties, and various of the other publications that are incorporated by reference herein.

The body 12 can include a front ground contact surface 54 on the body forward of the channel 36 adjacent the bottom of the face 34. The body can also have an intermediate ground contact surface, or sit pad, 50 rearward of the channel 36. The intermediate ground contact surface 50 can have an elevation and curvature congruent with that of the front ground contact surface 54. The body 12 can further comprise a downwardly extending rear sole surface 46 that extends around the weight port 44 and contains the weight assembly 42. In some embodiments, the rear sole surface 46 can act as a ground contact or sit pad as well, having a curvature and elevation congruent with that of the front ground contact surface 54 and the intermediate ground contact surface 50.

The body 12 can further include a raised sole portion 52 that is recessed/raised up from the intermediate ground contact portion 50 and from the rear sole surface 46. The raised sole portion 52 can span over any portion of the sole 30, and in the illustrated embodiment the raised sole portion 52 spans over most of the toeward and rearward portions of the sole. The sole 30 can include a sloped transition portion 53 where the intermediate ground contact surface 50 transitions up to the raised sole portion 52. The sole can also include other similar sloped portions around the boundary of the raised sole portion 52, such as the sloped portion 77 along the boundary of the rear sole surface 46 (FIG. 1). In some embodiments, as illustrated, one or more ribs or struts 58 can be included on the sole that span over the sloped transition portion 53 from the intermediate ground contact portion 50 to the raised sole portion 52, to provide increased stiffness and rigidity to the sole.

The body 12 can also include a cantilevered ledge 56 that extends downwardly and outwardly from the perimeter of the body below the level of the raised sole portion 52 on the toe side and rear side of the body. The ledge 56 can extend from the rear sole surface 46 around the body toward the toeward end of the front of the body, where the ledge can merge with the front ground contact portion 54 of the sole. The raised sole portion 52 can be surrounded, fully or partially, by a combination of the ledge 56, the front ground contact portion 54, and the toeward end 40 of the channel, the intermediate ground contact portion 50, and the rear sole surface 46. In this way, the raised sole portion 52 can form a recessed region surrounded by lower elevation portions of the body.

The cantilevered ledge 56 can be a peripheral extension of the crown that extends continuously past the point where the raised sole meets the crown. The ledge can have a terminal edge that is positioned about where a conventional sole would meet with the crown around the perimeter of the head. The terminal edge of the ledge 56 can include a curled or bent portion that extends inwardly a small distance, which can avoid having a sharp edge at the bottom of the ledge 56. The ledge 56 can also increase the silhouette area of the club head, such that the club head looks at least as large as a conventional club head when a user looks down on crown from above.

The cantilevered ledge 56 can extend beyond the edge of the raised sole portion 52 a distance from about 1 mm to about 20 mm, such as from about 3 mm to about 15 mm, and/or from about 5 mm to about 10 mm. The cantilevered ledge 56 can have any thickness.

The raised sole portion 52 can optionally include grooves, channels, ridges, or other surface features that increase its rigidity, such as grooves 74 and 76. Similarly, the intermediate ground contact portion 50 can include stiffening surface features, such as grooves 78 and 80.

A sole such as the sole 30 of the golf club head 10 may be referred to as a two-tier construction, bi-level construction, raised sole construction, or dropped sole construction, in which one portion of the sole is raised relative to the other portion of the sole. The terms raised, lowered, dropped, etc. are relative terms depending on perspective. For example, the intermediate ground contact portion 50 could be considered "raised" relative to the raised sole portion 52 when the head is upside down with the sole facing upwardly as in FIG. 1. On the other hand, the intermediate ground contact portion 50 portion can also be considered a "dropped sole" part of the sole, since it is located closer to the ground relative to the raised sole portion 52 when the club head is in the normal address position with the sole facing the ground.

The raised sole constructions described herein are counterintuitive because the raised portion of the sole tends to raise the CG of the club (compared to a conventional sole position), which is normally considered disadvantageous. However, the raised sole portion 52 (and other raised sole portion embodiments disclosed herein) allows for a smaller radius of curvature for that portion of the sole (compared to a conventional sole without the raised sole portion) resulting in increased rigidity and better acoustic properties due to the increased stiffness from the geometry. This stiffness increase means fewer ribs or even no ribs are needed in that portion of the sole to achieve a desired first mode frequency, such as 3000 Hz or above, 3200 Hz or above, or even 3400 Hz or above. Fewer ribs provides a mass/weight savings, which allows for more discretionary mass that can be strategically placed elsewhere in the club head or incorporated into user adjustable movable weights.

Furthermore, the various sloped transition portions (e.g., 53, 77) around the raised sole portion 52, as well as the grooves 74, 76, and the optional ribs 58, can provide additional structural support and additional rigidity for the club head and also modify and even fine tune the acoustic properties of the club head. The sound and modal frequencies emitted by the club head when it strikes a golf ball are very important to the sensory experience of a golfer and provide functional feedback as to where the ball impact occurs on the face (and whether the ball is well struck).

In some embodiments, the raised sole portion 52 can be made of a relatively thinner and/or less dense material compared to other portions of the sole and body that take more stress, such as the ground contact portions 46, 54, 50, the face region, and the hosel region. By reducing the mass of the raised sole portion 52, the higher CG effect of raising that portion of the sole is mitigated while maintaining a stronger, heavier material on other portions of the sole and body to promote a lower CG and provide added strength in the area of the sole and body where it is most needed (e.g., in a sole region proximate to the hosel and around the face and shaft connection components where stress is higher).

Figure 4:
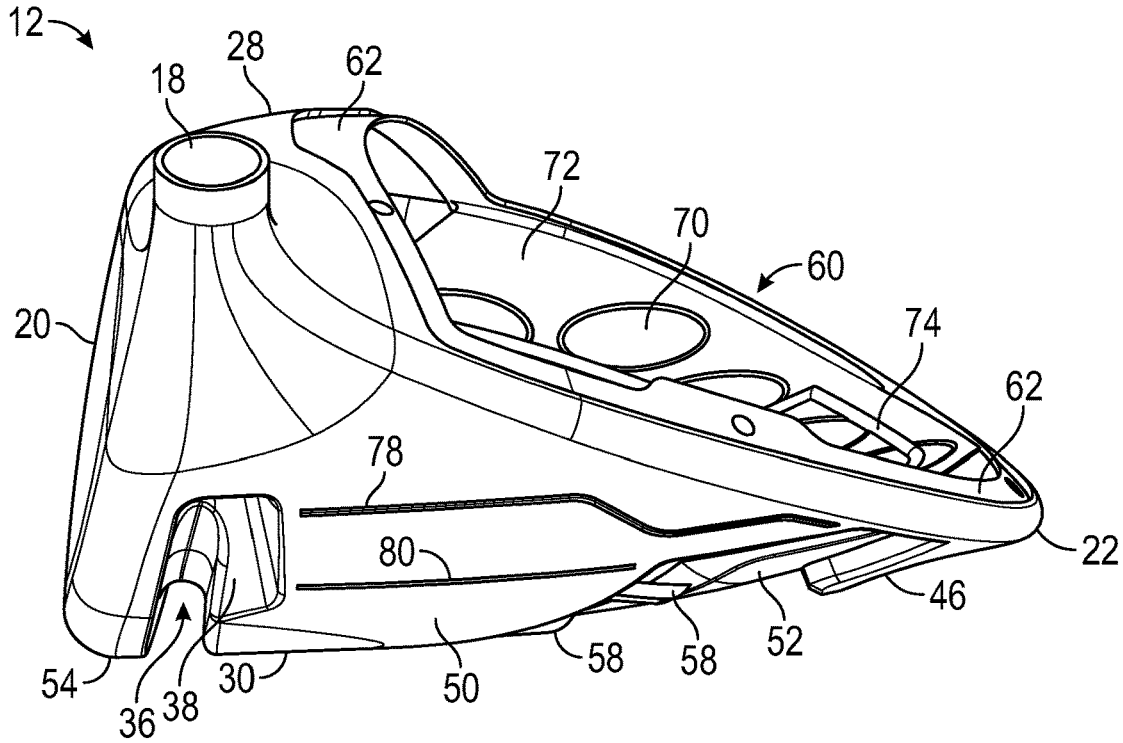
FIG. 4 is a heel-side view of the body of FIG. 2.
Figure 5:
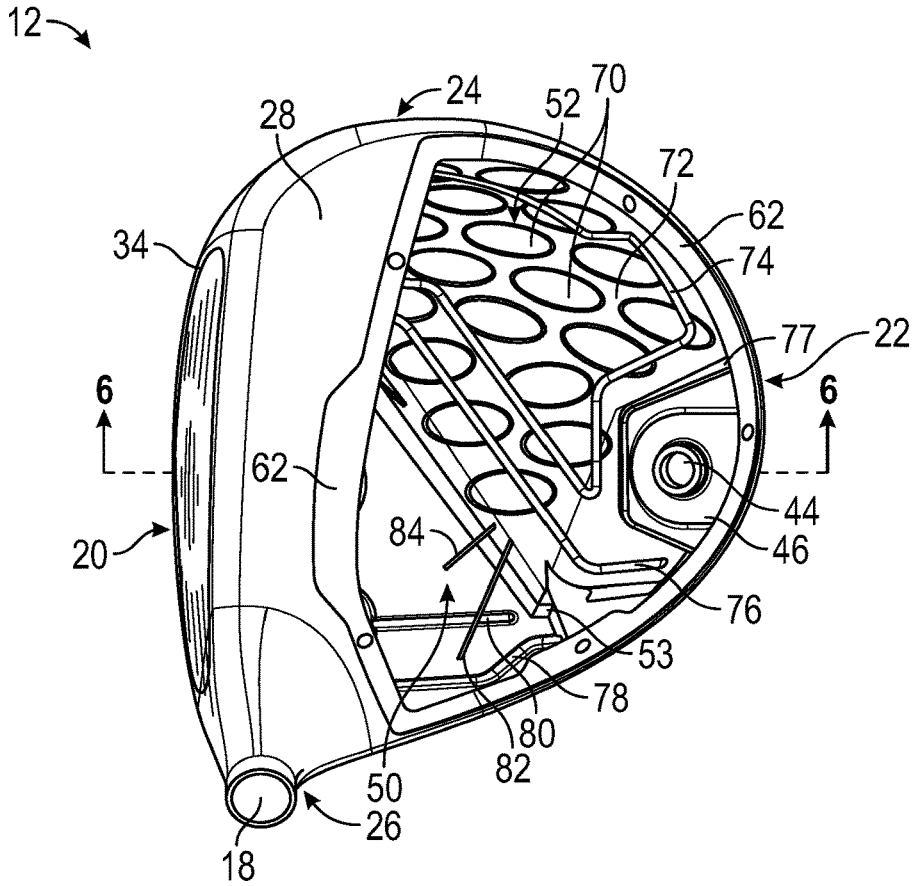
FIG. 5 is a top view of the body of FIG. 2.
Figure 6:
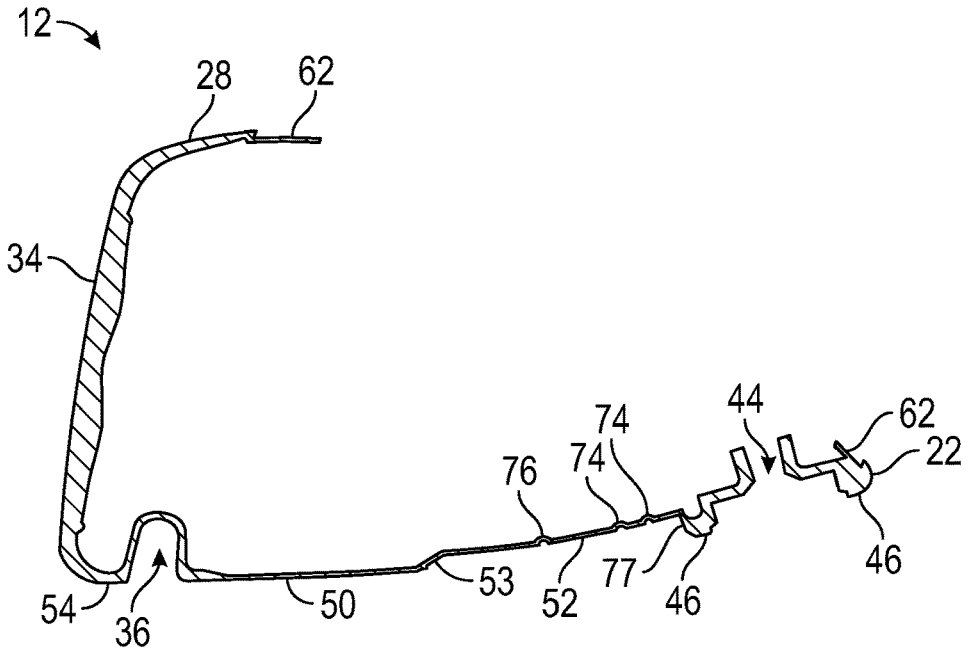
FIG. 6 is a cross-sectional view of the body taken along line 6-6 in FIG. 5.
Figure 7:
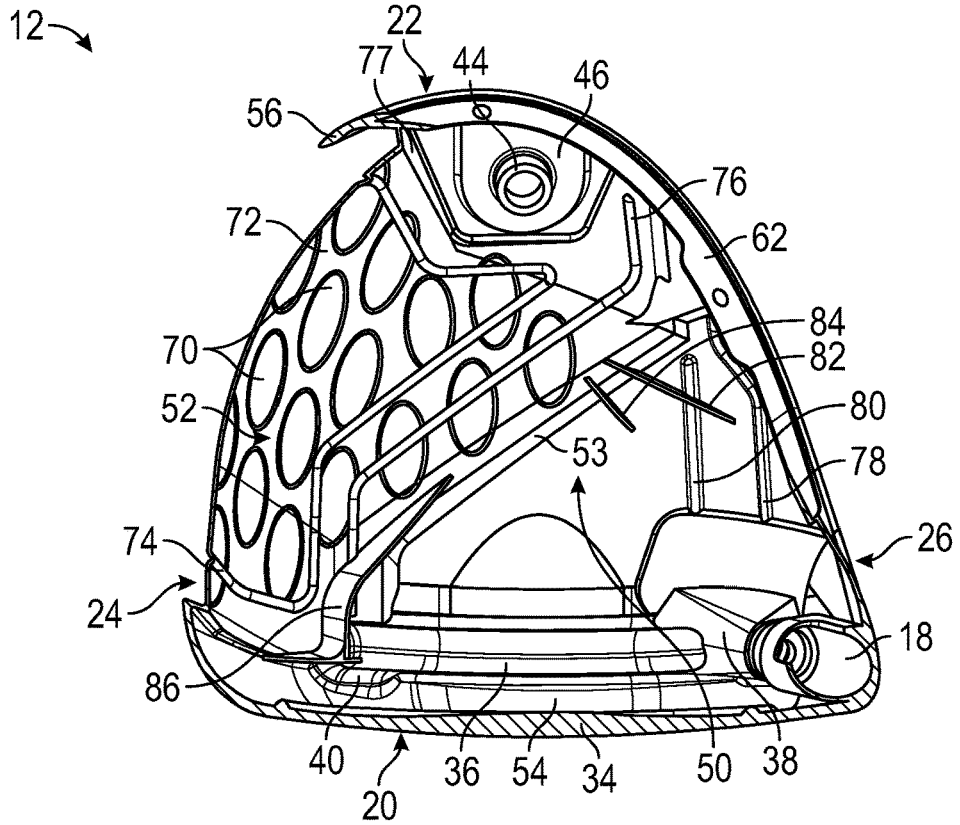
FIG. 7 is a cross-sectional top-down view of a lower portion of the body of FIG. 2.
Figure 8:
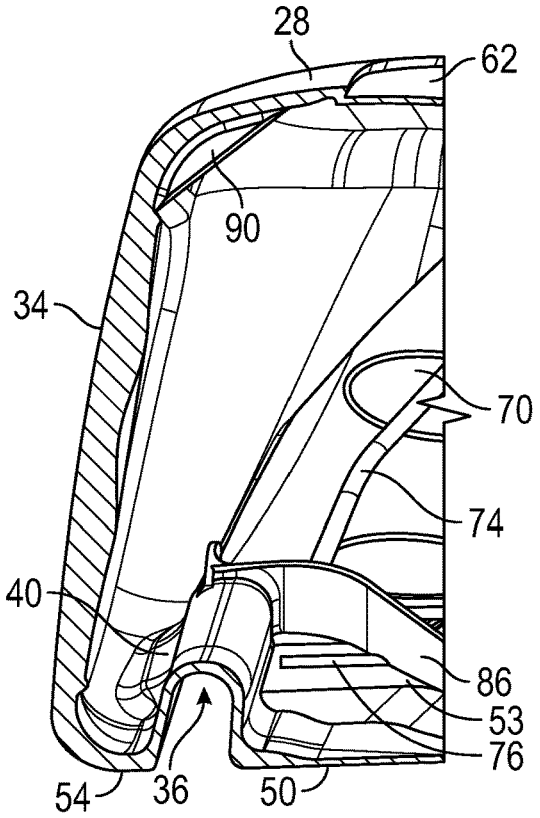
FIG. 8 is a cross-sectional side view of a toe portion of the body of FIG. 2.
Figure 9:
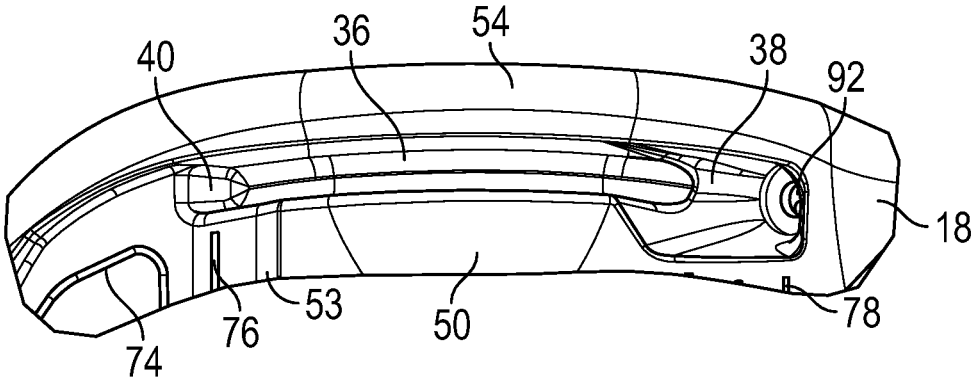
FIG. 9 is a bottom view of a front portion of the sole of the body of FIG. 2.

In some embodiments, the raised sole portion 52 and/or optionally other portions of the body can include relatively thinner regions spaced apart in a web of thicker material. For example, as shown in FIGS. 4, 5, and 7, the raised sole portion 52 includes oval shaped thin regions 70 spaced apart by thicker regions 72 that form a web. Such thick/thin sole construction can provide optimal stiffness benefits while also providing further mass/weight savings in the raised portion of the sole to mitigate adverse CG effects and improve the acoustic properties of the sole. Any number of thin regions 70 can be provided, with any dimensions and spacing. More details regarding thick/thin zones in golf club head walls, such described herein, can be found in various of the references incorporated by reference herein.

The body 12 can also include one or more internal ribs, such as ribs 82, 84, and 86 (see FIGS. 5, 7, and 8) that are integrally formed with or attached to the inner surfaces of the body. Such ribs can vary in size, shape, location, number and stiffness, and can be used strategically to reinforce or stiffen designated areas of the body's interior and/or fine tune acoustic properties of the club head. One or more additional ribs can be included within the body that span the junction between the top of the face 34 and the front of the crown 28, such as rib 90 shown in FIG. 8, which can stiffen the upper portion of the face and the crown.

Figure 3:
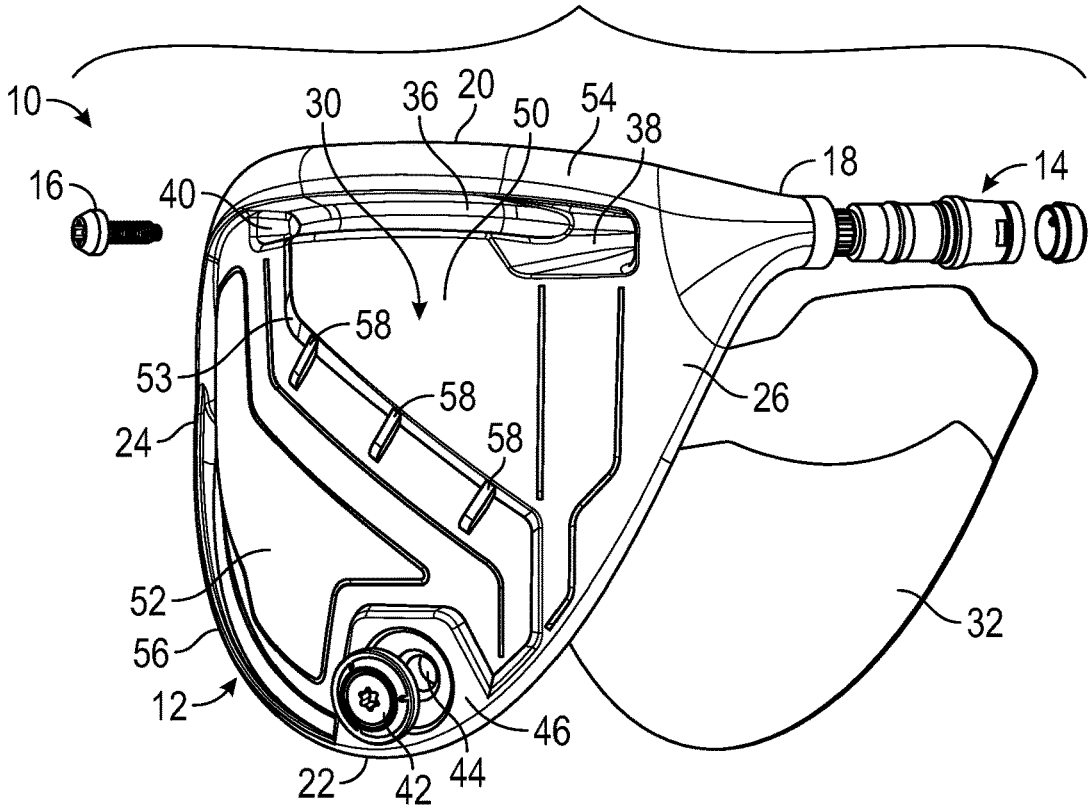
FIG. 3 is an exploded perspective view of the golf club head of FIG. 1.
Figure 36C:
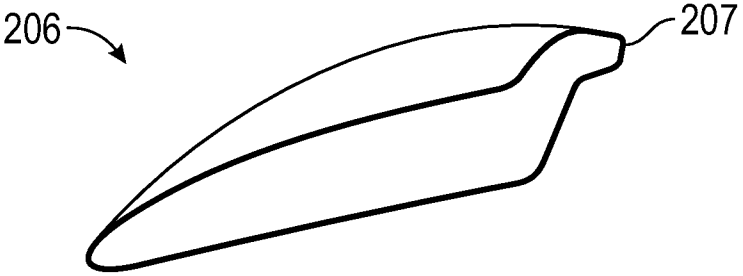
FIG. 36C is a side view of the crown portion of the golf club head of FIG. 20.
Figure 36D:
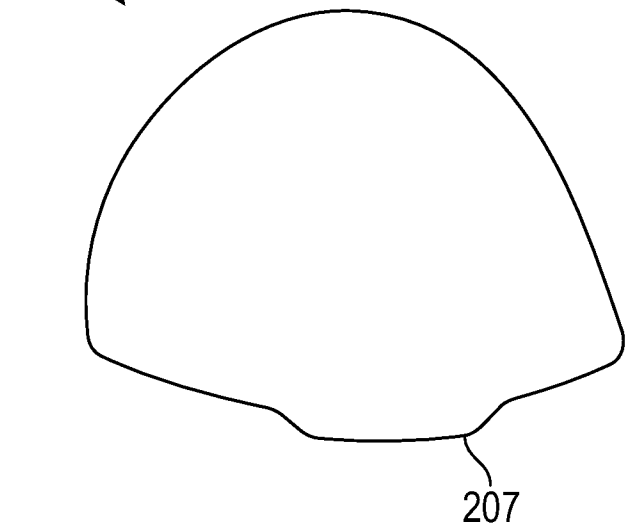
FIG. 36D is a top view of the crown portion of the golf club head of FIG. 20.

As shown in FIGS. 3 and 4, the club head 10 can optionally include a separate crown insert 32 that is secured to the body 12 to cover a large opening 60 at the top and rear of the body, forming part of the crown 28 of the club head. The crown insert 32 covers a substantial portion of the crown's surface area as, for example, at least 40%, at least 60%, at least 70% or at least 80% of the crown's surface area. The crown's outer boundary generally terminates where the crown surface undergoes a significant change in radius of curvature, e.g., near where the crown transitions to the head's sole, hosel, and face. In some embodiments, the crown insert can be set back from the front 20 of the head and has a forwardmost edge that generally extends between the toe and heel and defines a centrally located notch which protrudes toward the face (see, for example, the notch/protrusion 207 in the crown insert 206 shown in FIGS. 36C and 36D). In other embodiments the notch may protrude away from the face.

The crown opening 60 can be formed to have a recessed peripheral ledge or seat 62 to receive the crown insert 32, such that the crown insert is either flush with the adjacent surfaces of the body to provide a smooth seamless outer surface or, alternatively, slightly recessed below the body surfaces. The front of the crown insert 32 can join with a front portion of the crown 28 on the body to form a continuous, arched crown extend forward to the face. The crown insert 32 can comprise any suitable material (e.g., lightweight composite and/or polymeric materials) and can be attached to the body in any suitable manner, as described in more detail elsewhere herein.

The crown insert 32, disclosed in various embodiments herein, can help overcome manufacturing challenges associated with conventional club heads having normal continuous crowns made of titanium or other metals, and can replace a relatively heavy component of the crown with a lighter material, freeing up discretionary mass which can be strategically allocated elsewhere within the club head. For example, with the discretionary mass, additional ribs can be strategically added to the hollow interior of the club head and thereby improve the acoustic properties of the head. Discretionary mass in the form of ribs or other features also can be strategically located in the interior to shift the effective CG fore or aft, toeward or heelward or both (apart from any further CG adjustments made possible by adjustable weight features).

Figure 10:
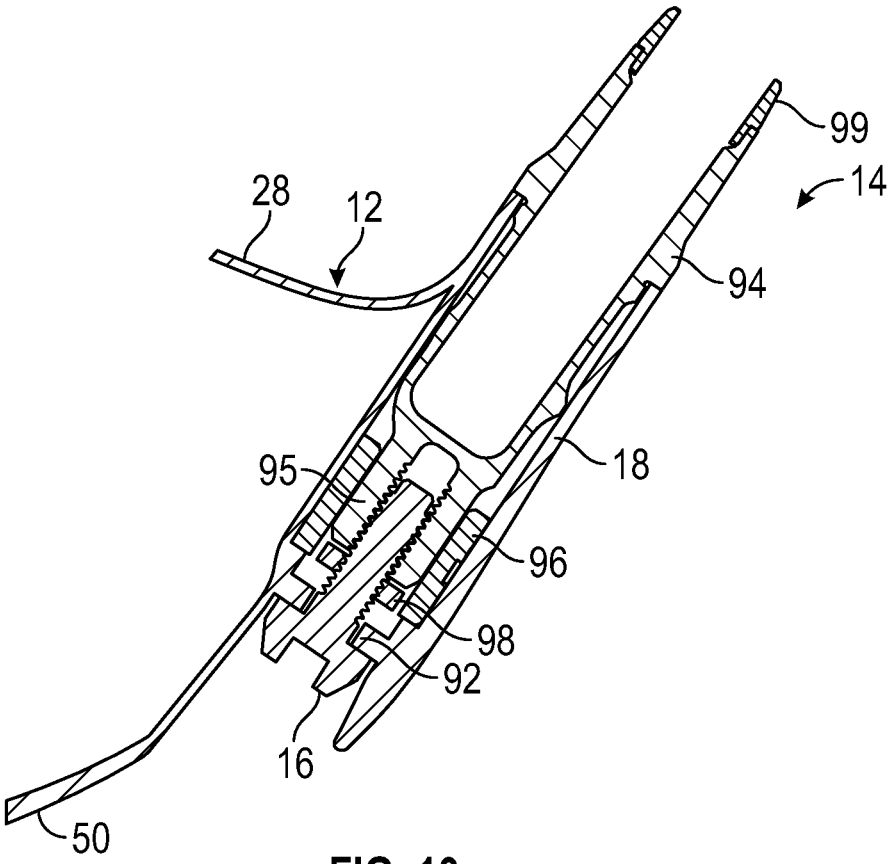
FIG. 10 is a cross-sectional view of a hosel-shaft assembly of the golf club head of FIG. 1.
Figure 11:
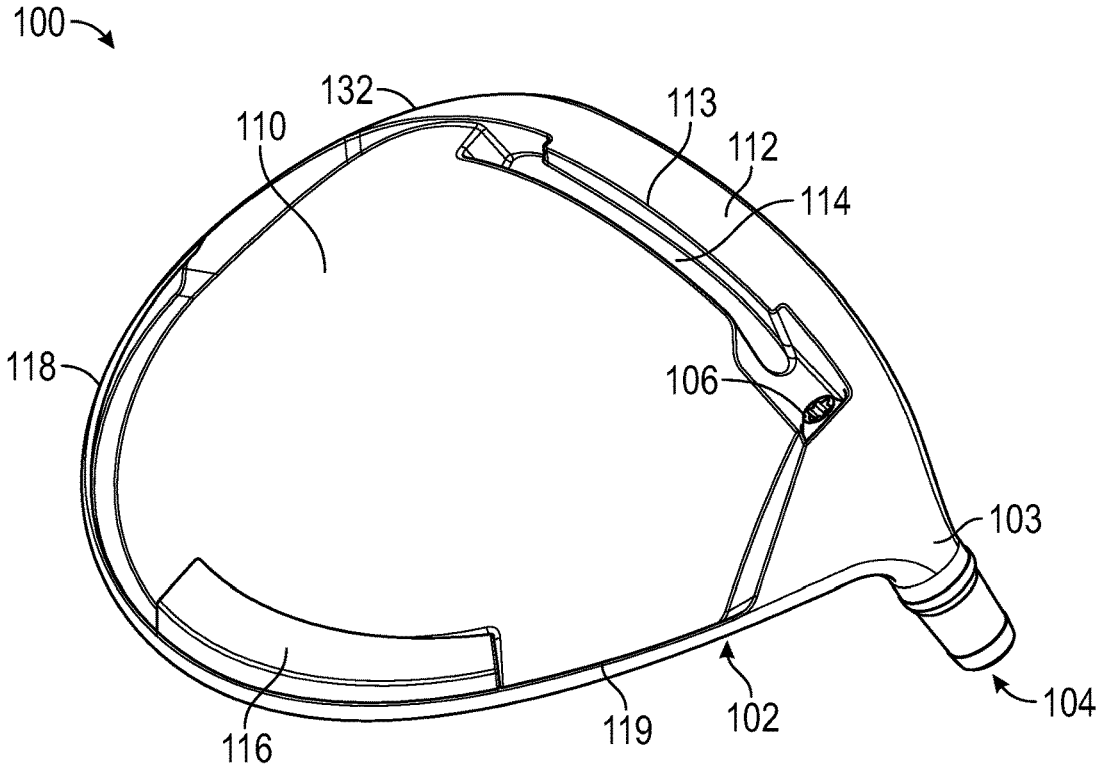
FIG. 11 is a bottom perspective view of another exemplary golf club head disclosed herein.

FIG. 10 is a cross-sectional view of the head-shaft connection assembly 14 mounted within the hosel 18 and secured via fastener 16. The head-shaft connection assembly 14 can coupled a shaft (not shown) to the club head 12 in various different orientations that allow for adjustment of the resulting golf club's loft angel, lie angle, and/or face angle. The head-shaft connection assembly can include components 92, 94, 95, 96, 98, and 99, in addition to the fastener 16 and hosel 18, as shown in FIG. 10. More information about the adjustable head-shaft connection systems that can be included in the disclosed heads is provided in the various referenced that are incorporated by reference herein.

FIGS. 11-19 illustrate another exemplary wood-type golf club head 100. The head 100 comprises a body 102 with a hosel 103, a face 130, an adjustable head-shaft connection assembly 104, 106, a crown insert 108, a raised sole 110, a sole channel 114, a front sit pad 112 and rear sit pad 116, a toe cantilevered ledge 118 extending around the toward side of the raised sole 110 and a heel cantilevered ledge 119 along the heel-ward side of the raised sole. Instead of the bi-level sole construction as described with the head 10 above, the head 100 has a majority of its sole raised up above the level of the lower ground contact surfaces of the sit pads 112 and 116. In this way, the sole is reduced in area and mass, and increased in curvature, compared to a conventional sole that is flush with the sit pads 112, 116, the hosel 103, and ledges 118, 119.

The front sit pad 112 is positioned in front of the sole channel 114 and the raised sole 110 extends rearwardly from the channel 114 to the rear sit pad 116 and perimeter ledges 118, 119. The raised sole 110 also extends heelward over most of the heel portion of the body and transitions into the hosel 103 where stresses are higher and thicker material is needed. At the toe side of the head 100, the raised sole 110 is bounded by the toe-side ledge 118 and the toe end 132 of the body that extends from front sit pad 112 adjacent the face. In the normal address position, the head rests on the ground with only the front and rear sit pads 112, 116 touching the ground, and the raised sole 110 spaced above the ground (see FIGS. 13 and 15). To provide the front sit pad with increased surface area while keeping the channel 114 close to the face, the front sit pad includes a rear lip 113 that partially overhangs the channel 114.

The ledges 118 and 119 can be similar in structure and purpose to the ledge 56 of head 10, as described herein.

The raised sole portion 110 can optionally include grooves, channels, ridges, or other surface features that increase its rigidity, can have thick/thin regions, and/or can include internal ribs, as described with the raised sole portion 52 above.

The rear sit pad 116 can be positioned off-center toward the toe-side of the club head, where it best positioned to contact the ground when a user holds the club head at address with the head rocked toward the heel a bit. The rear sit pad 116 can have a general rectilinear shape that is also arcuate to match the arcuate shape of the rear of the head. The rear sit pad 116 can alternatively have various other shapes and sizes as desired, such as to adjust the mass properties, acoustic properties, or aerodynamic properties.

Figure 12:
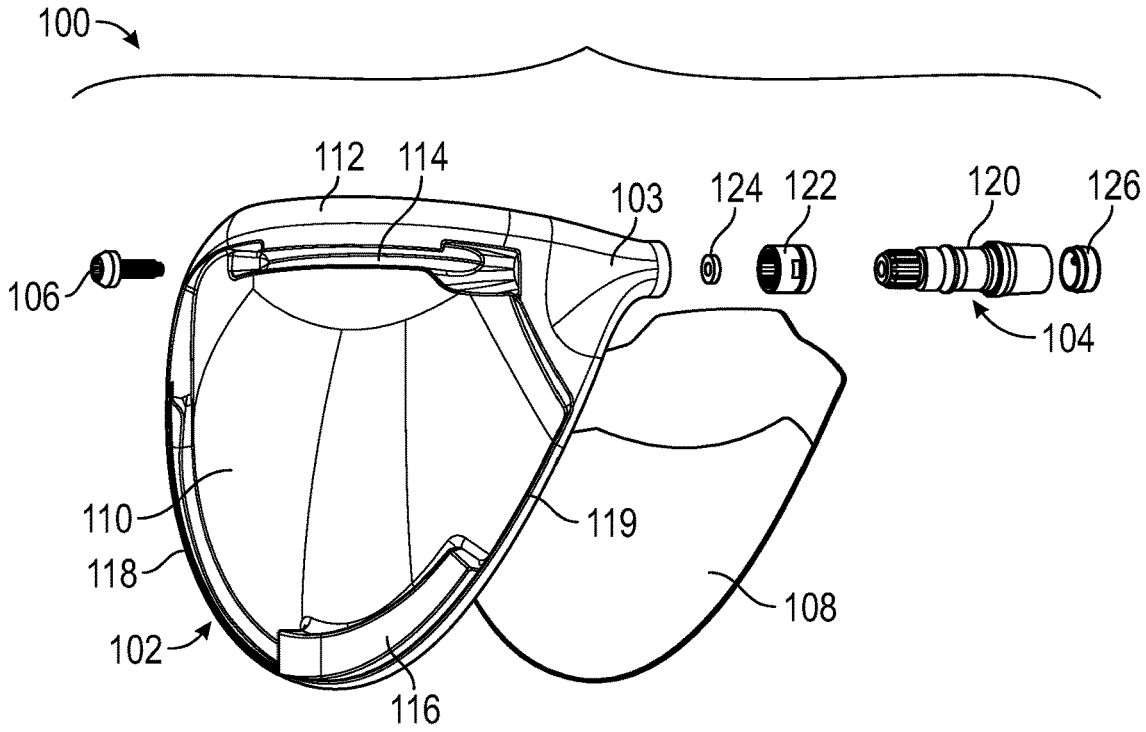
FIG. 12 is an exploded perspective view of the golf club head of FIG. 11.
Figure 13:
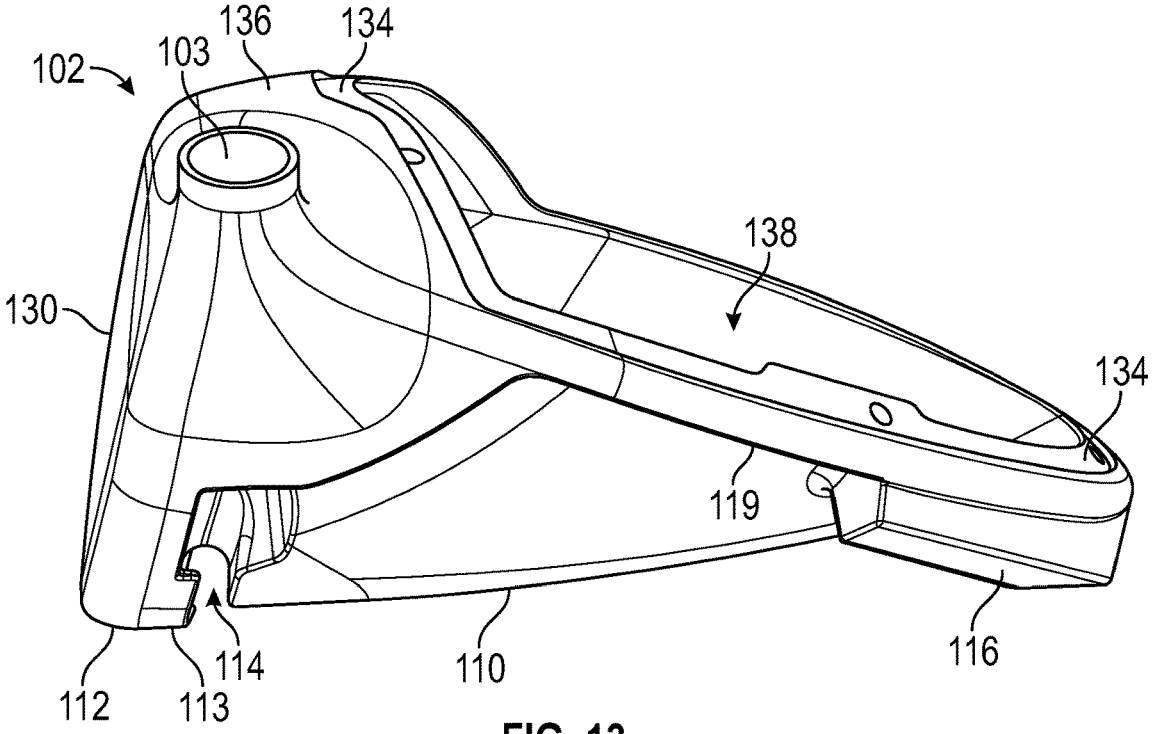
FIG. 13 is a heel-side view of the body of the golf club head of FIG. 11.
Figure 14:
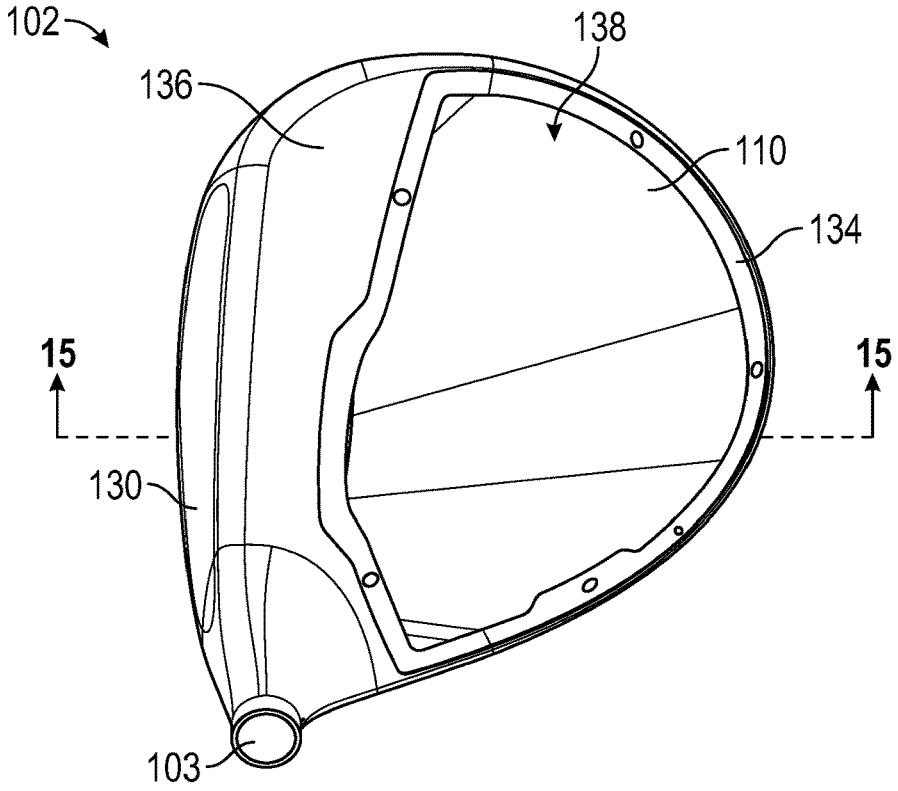
FIG. 14 is a top view of the body of FIG. 13.
Figure 15:
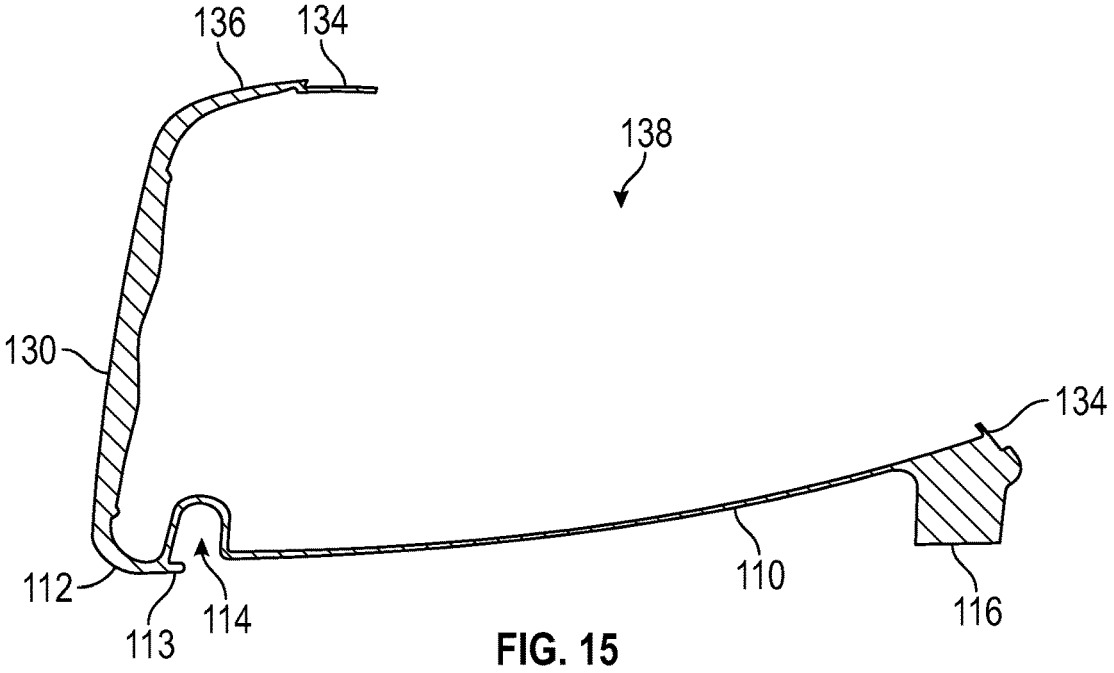
FIG. 15 is a cross-sectional view of the body taken along line 15-15 in FIG. 14.

As with other embodiments herein, the head-shaft connection assembly 104 can include various components to allow adjustment to the loft, lie, and/or face angles of the head relative to the shaft, and can include components 120, 122, 124, 126 as shown in FIG. 12. More information about the adjustable head-shaft connection systems that can be included in the disclosed heads is provided in the various referenced that are incorporated by reference herein.

As shown in FIGS. 13-16, the body 102 can include a crown opening 138 bounded by a recessed ledge 134 that receives the crown insert 108, similar to the head 10. The crown insert 108 and a forward portion 136 of the body form an arched crown that slopes down to the face and hosel.

Figure 16:
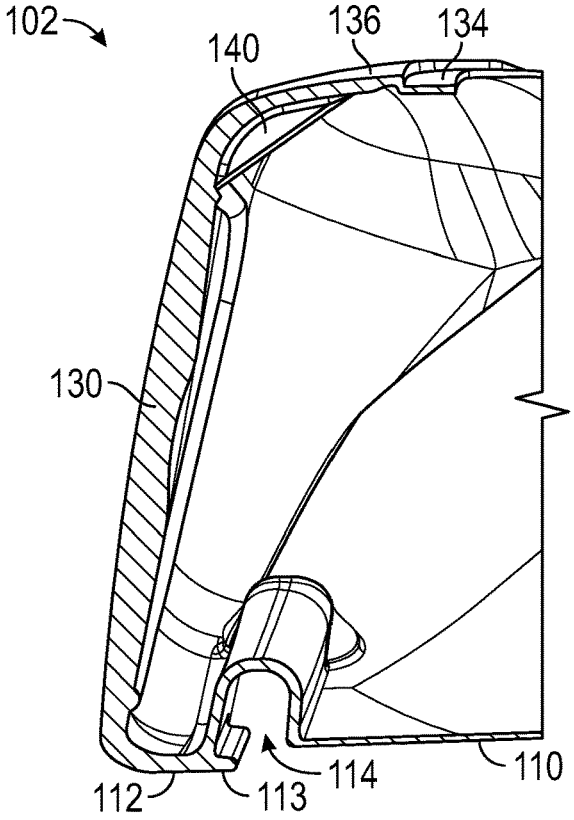
FIG. 16 is a cross-sectional side view of a toe portion of the body of FIG. 13.

In some embodiments, one or more ribs can be included within the body, such as one or more ribs that span the junction between the top of the face 130 and the front of the crown 136, such as the rib 140 shown in FIG. 16, which can stiffen the upper portion of the face and the crown.

Figure 17:
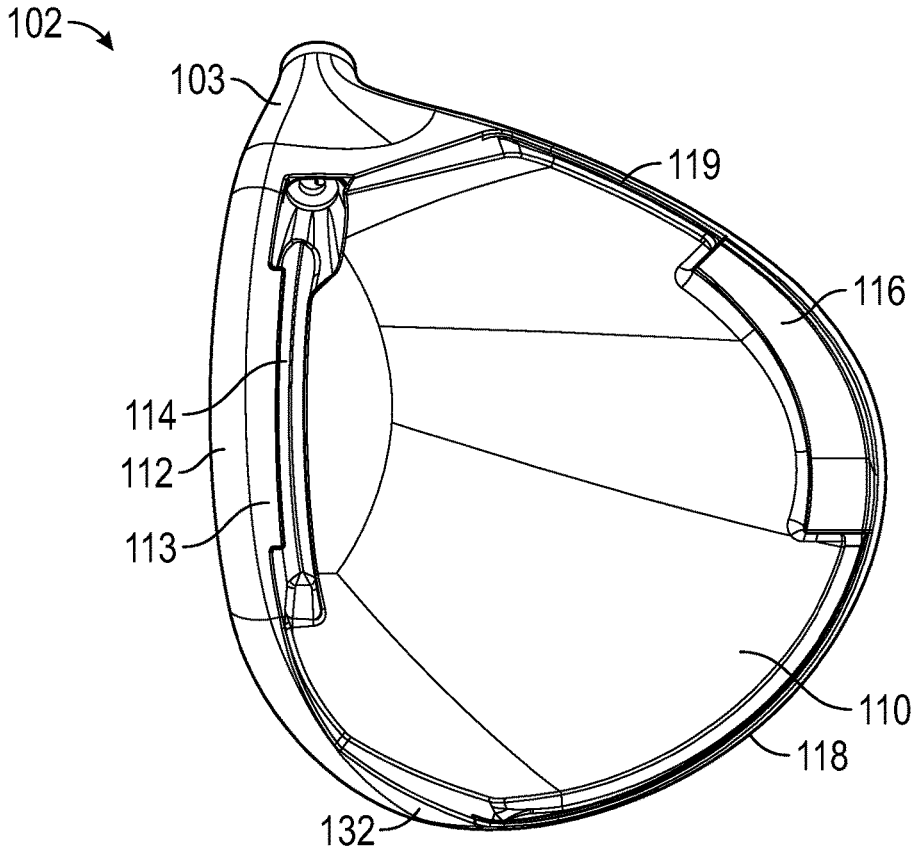
FIG. 17 is bottom plan view of the body of FIG. 13.
Figure 18:
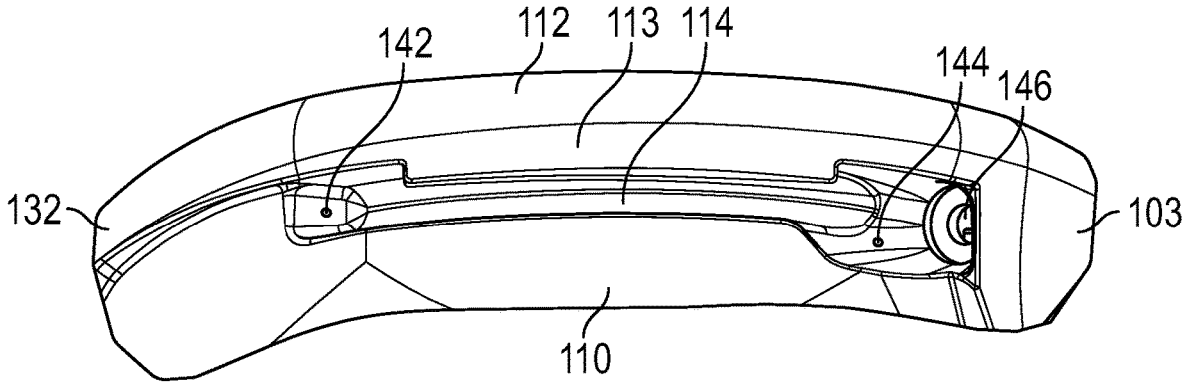
FIG. 18 is a bottom view of a front portion of the sole of the body of FIG. 13.
Figure 19:
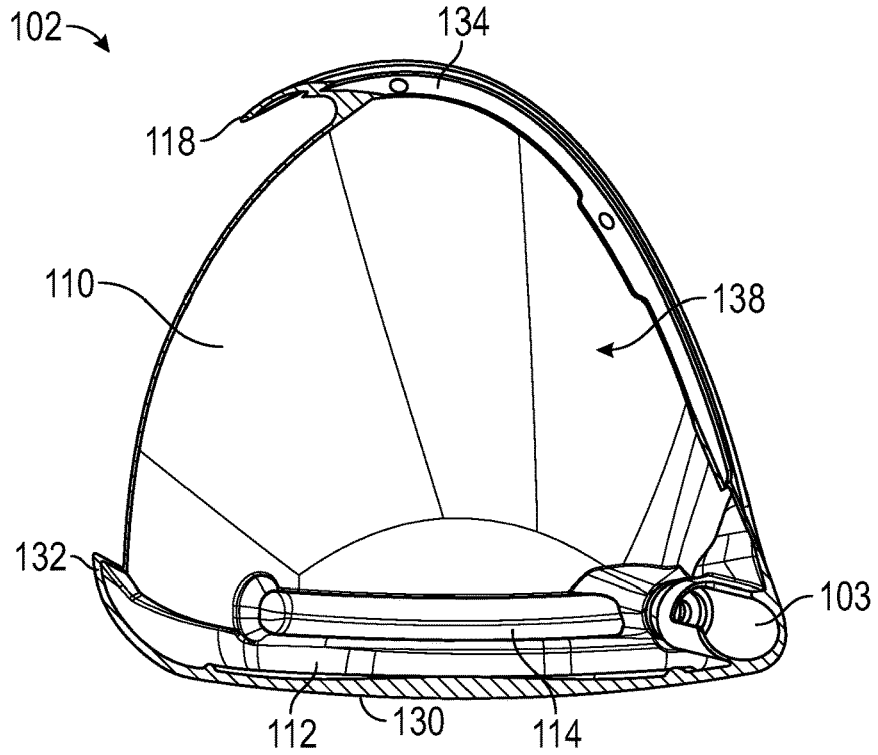
FIG. 19 is a cross-sectional top-down view of a lower portion of the body of FIG. 13.

As shown in FIGS. 17 and 18, the sole channel 114 can have a similar construction to that of the channel 36 in the head 10, with an enlarged heel end 144 adjacent a fastener opening 146 in the hosel and an opposite channel end 142 near the toe. As shown, the lip 113 of the front sit pad 112 partially overhangs the intermediate region of the channel between the ends 142, 144.

In any of the club heads disclosed herein, the club head can include at least one raised sole portion that provides a greater heel-toe curvature as compared to a conventional sole that normally would be included in place of the raised sole portion. For example, the raised sole portion can have a heel end that is bounded by a heel portion of the body (e.g., cantilevered ledge 119 in club head 100) and a toe end that is bounded by a toe portion of the body (e.g., cantilevered ledge 118 in club head 100), and a mid portion that is positioned below the heel end and toe end when the club head is a normal address position. The heel portion of the body extends below the heel end of the raised sole portion and the toe portion of the body extends below the toe end of the raised sole portion, such that the raised sole portion is elevated above where a normal sole would be located if it extended to the peripheral ends of the body, and such that the raised sole portion has an increased degree of curvature. Curvature is defined herein as the inverse of the radius of curvature.

The club head 100, for example, includes raised sole portion 110 that covers a majority of the sole. In the club head 10, as another example, the raised sole portion 52 provides a zone of higher curvature mostly on the toe side, in contrast to the lower sole portions 50, 54, 46, etc. As another example, the club head 200 (described further below) includes a toe-side raised sole portion (area including and around body opening 240) and a separate heel-side raised sole portion (area including and around body opening 242), with a weight track in between.

Figure 37:
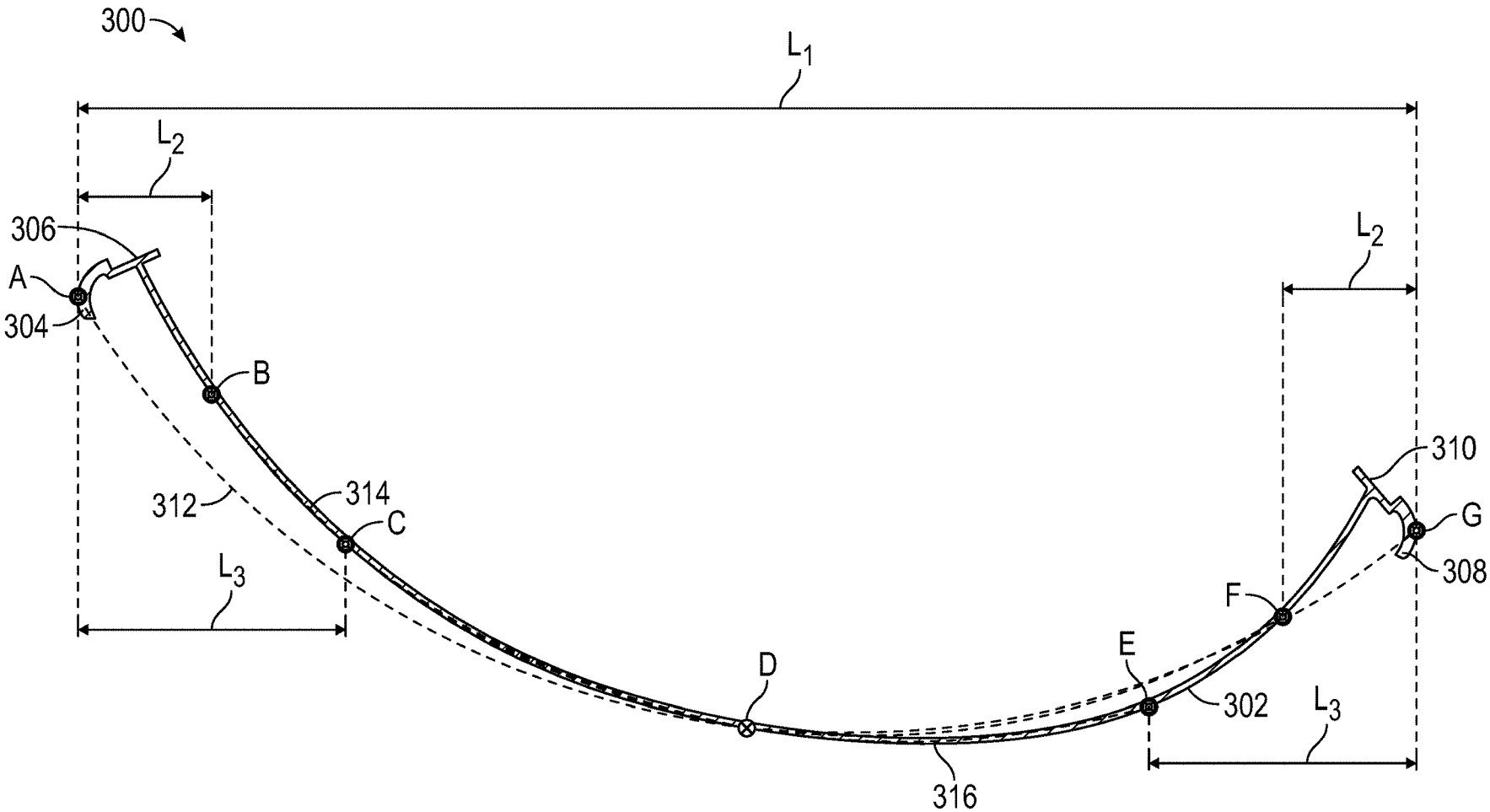
FIG. 37 shows a vertical cross-section of a body of an exemplary golf club head with a raised sole portion and cantilevered ledges extending downwardly at the toe side and heel side of the body, and with a crown insert not included.

The heel-toe curvature of a raised sole portion can be measured at any heel-toe cross-section between the front and back of the club head. For example, FIG. 37 shows a heel-toe cross-sectional view of the body of an exemplary club head 300 (similar to club head 100) taken at a midpoint between the front and rear of the club. As shown in FIG. 37, the club head 300 includes a raised sole portion 302 that extends between a toe side ledge 304 and a heel side ledge 308 that extend down and outwardly beyond the ends of the raised sole portion. The body also includes seats 306 and 310 that receive a crown insert (not shown). The point A is the toeward most point on the body 300, and the point G is the heelward most point on the body. The point D is a point in the sole midway between the points A and G. The point D divides the raised sole portion into a toe side and a heel side. The distance $L_1$ is the horizontal heel-toe distance between points A and G. The point B on the toe end of the raised sole portion is a distance $L_2$ horizontally from the point A, which is 10% of $L_1$. Similarly, the point F on the heel end of the raised sole portion is the same distance $L_2$ horizontally from the point G. The point C on the toe side of the raised sole portion is a distance $L_3$ horizontally from the point A, which is 20% of $L_1$. Similarly, the point E on the heel end of the raised sole portion is the same distance $L_3$ horizontally from the point G.

The average heel-toe curvature of the raised sole portion 302 can be defined by an arc 314 of constant radius passing through points B, D and F. Alternatively, the average heel-toe curvature of the raised sole portion 302 can be defined by an arc 316 of constant radius passing through points C, D and E. These are just two examples of how the heel-toe curvature of a raised sole portion can be measured or estimated. In any case, it is apparent that the curvature of the raised sole portion is greater than a reference curvature defined by reference arc 312 that extends through points A, D and G with a constant radius, which is approximately where a conventional sole would be located and approximates an average curvature of such a conventional sole.

In embodiments have a raised sole portion, the average heel-toe curvature of the raised sole portion can be greater than the reference heel-toe curvature by any degree, by at least 3%, by at least 5%, by at least 10%, by at least 15%, and/or by at least 20%.

In the example cross-section of FIG. 37, $L_1$ can be about 123 mm, $L_2$ can be about 12.3 mm, $L_3$ can be about 24.6 mm, the arc ADG can have a curvature of about 0.0121 $mm^{-1}$, the arc BDF can have a curvature of about 0.0137 $mm^{-1}$, and the arc CDE can have a curvature of about 0.0123 $mm^{-1}$. The arc BDF is longer and extends further toward the higher curvature portions nearer to the crown, and is thus a better approximation of the average heel-toe curvature of the whole span of the raised sole portion compared to the relatively flatter lower span segment approximated by the arc CDE. The ratio of the BDF curvature to the ADG curvature is about 1.132 in this example, which illustrates that the raised sole portion can have a curvature that is more than 10% greater than the reference curvature. Of course FIG. 37 is just one example and the dimensions can vary significantly in other embodiments.

It should be noted that the foregoing comparisons of curvatures and dimensions are based on a cross-section of the club head body taken at a vertical cut located midway (50%) between the front and rear of the club head. Alternatively, such curvature comparisons can be made at other front-rear cross-section locations, such as 25%, 30%, 40%, 60%, 70%, or 75% of the distance from the from the front of the club head toward the rear of the club head, while yielding comparable results and conclusions.

For example, in one embodiment at a cross-section located at about 30% of the distance from the from the front of the club head toward the rear of the club head a toe arc curvature may be greater than about 0.0135 $mm^{-1}$, preferably greater than about 0.0140 $mm^{-1}$, more preferably greater than about 0.0145 $mm^{-1}$, and most preferably greater than about 0.0150 $mm^{-1}$. Additionally or alternatively, at that same 30% cross-section a heel arc curvature may be greater than about 0.0135 $mm^{-1}$, preferably greater than about 0.0140 $mm^{-1}$, more preferably greater than about 0.0145 $mm^{-1}$, and most preferably greater than about 0.0150 $mm^{-1}$. Similarly, at a cross-section located at about 70% of the distance from the from the front of the club head toward the rear of the club head a toe arc curvature may be greater than about 0.0115 $mm^{-1}$, preferably greater than about 0.0120 $mm^{-1}$, more preferably greater than about 0.0125 $mm^{-1}$, and most preferably greater than about 0.0130 $mm^{-1}$. Additionally or alternatively, at that same 70% cross-section a heel arc curvature may be greater than about 0.0135 $mm^{-1}$, preferably greater than about 0.0140 $mm^{-1}$, more preferably greater than about 0.0145 $mm^{-1}$, and most preferably greater than about 0.0150 $mm^{-1}$. The heel and toe curvatures may not necessarily be the same and in many instances the heel curvature may be greater than the toe curvature. As discussed above, at least one of the heel curvature and toe curvature may be greater than a reference heel-toe curvature by at least 3%, by at least 5%, by at least 10%, by at least 15%, and/or by at least 20%.

Looking again at FIG. 37, it is apparent in the illustrated example 300 that the heel side of the raised sole portion 302 has a greater curvature than the toe side. In fact, in many examples, the actual curvature varies considerably moving in the heel-toe directions across the sole, with some portions having a continuously variable curvature and some portions having a constant curvature over certain spans. For this reason, it can be more convenient to characterize the overall curvature of the raised sole portion using an approximation, such as the arcs BDF and CDE of constant curvature.

A non-constant curvature of the raised sole portion can be characterized in other ways as well. For example, the overall span can be broken up into N smaller segments, and the curvatures of each of the N segments can be summed together and then divided by N to calculate an approximate average curvature. In one such example, the raised sole portion can have an overall heel-toe arc length of about 120 mm, and can be broken up into 12 arc segments of about 10 mm each. The curvature of each of the 12 segments can be calculated, added together, and then divided by 12 to arrive at an approximate average curvature. In other examples, the N segments can each have different arc lengths. In such cases, for each segments, the product of the length and the curvature can be found. Those products can be summed and then divided by the sum of the lengths (the overall length) to arrive at an approximate average curvature. Regardless of the technique used to measure the average curvature of the raised sole portion, the average curvature of the raised sole portion can be greater than the reference curvature.

FIGS. 20-36D illustrate yet another exemplary wood-type golf club head 200. The head 200 also includes a raised sole construction with the benefits provided thereby described above, but also includes two weight tracks 214, 216 with slidably adjustable weights assemblies 210, 212. The head 200 further comprises both a crown insert 206 (akin to those described above) as well as a sole insert 208 (see exploded views in FIGS. 21 and 22).

The head 200 comprises a body 202, a hosel 203, an adjustable head-shaft connection assembly 204, fastener 205, a crown insert 206 attached to an upper portion of the body, a sole insert 208 mounted inside the body on top of a lower portion of the body, the front weight assembly 210 slidably mounted in the front weight track 214, and the rear weight assembly 212 slidably mounted in the rear weight track 216. The two weight tracks form a T shape, with a rearwardly extending track branch, a toewardly extending track branch, and a heelwardly extending track branch, defining three terminal ends. In some embodiments, a similar weight track can have more of a Y shape, with all three branches extending at different angles. The head 200 includes a front sit pad, or ground contact surface, 226 between the front track 214 and the face 270, and a rear sit pad, or ground contact surface, 224 at the rear of the body to the heel side of the rear track 216, with the rest of the sole elevated above the ground when in the normal address position.

Figure 22:
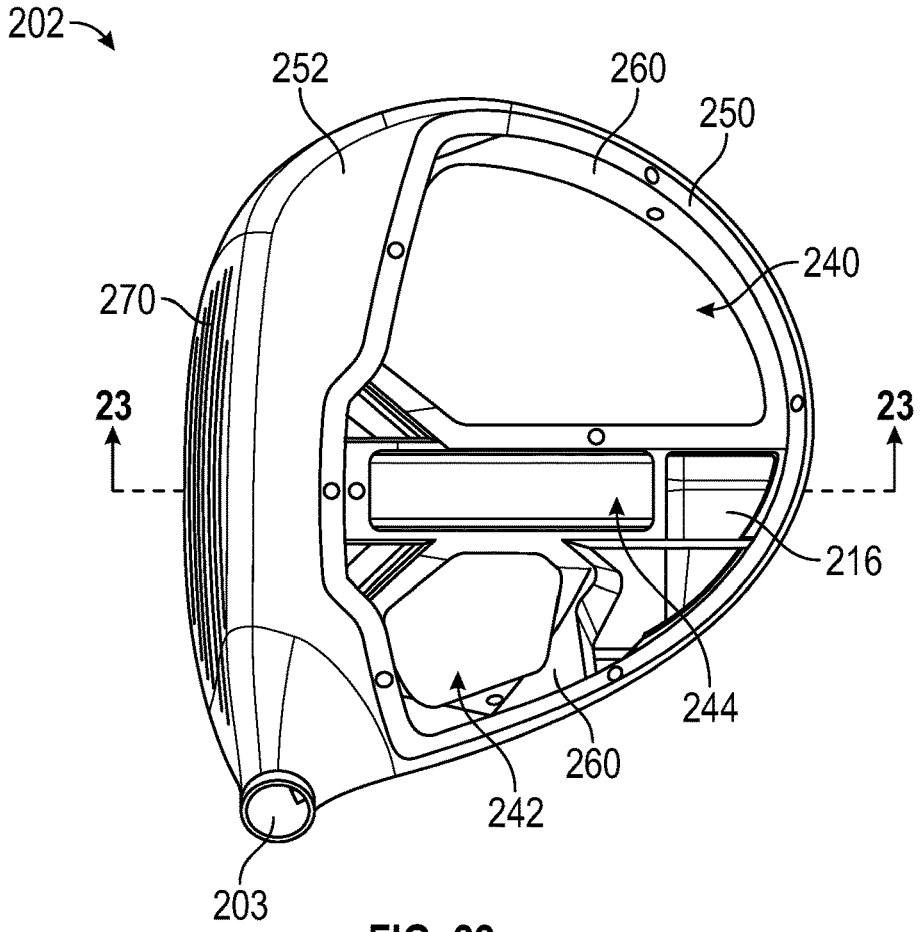
FIG. 22 is a top view of the body of the golf club head of FIG. 20.
Figure 23:
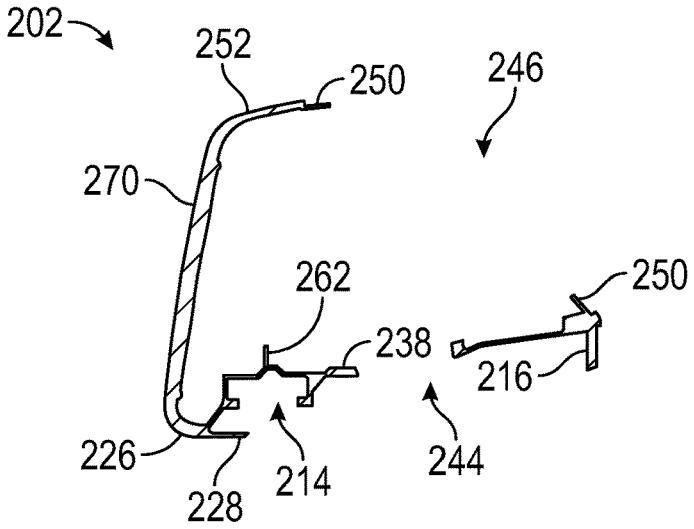
FIG. 23 is a cross-sectional view of the body taken along line 23-23 in FIG. 22.
Figure 24:
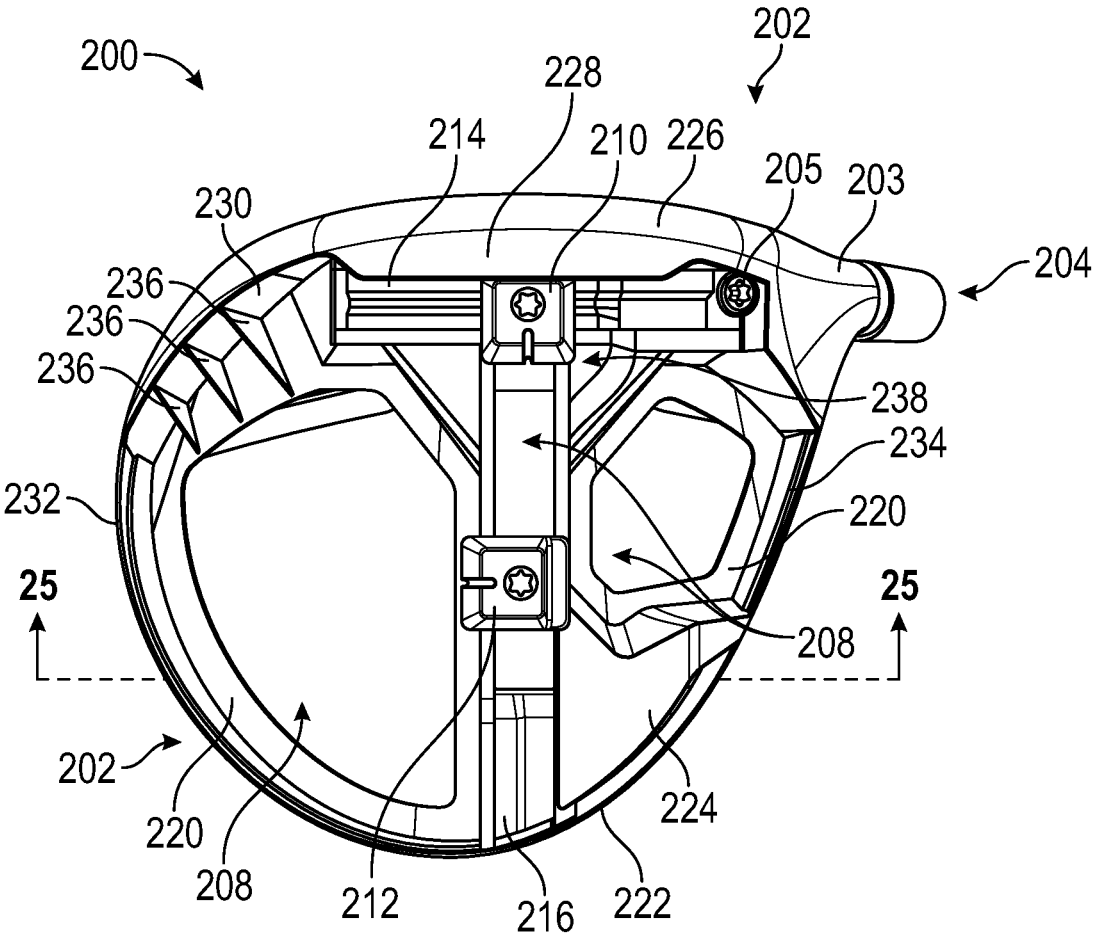
FIG. 24 is a bottom view of the golf club head of FIG. 20.
Figure 25:
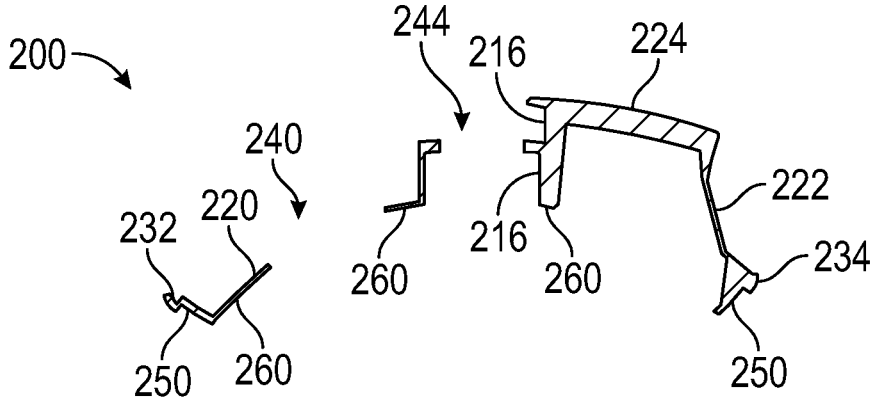
FIG. 25 is a cross-sectional view taken along line 25-25 in FIG. 24.
Figure 27:
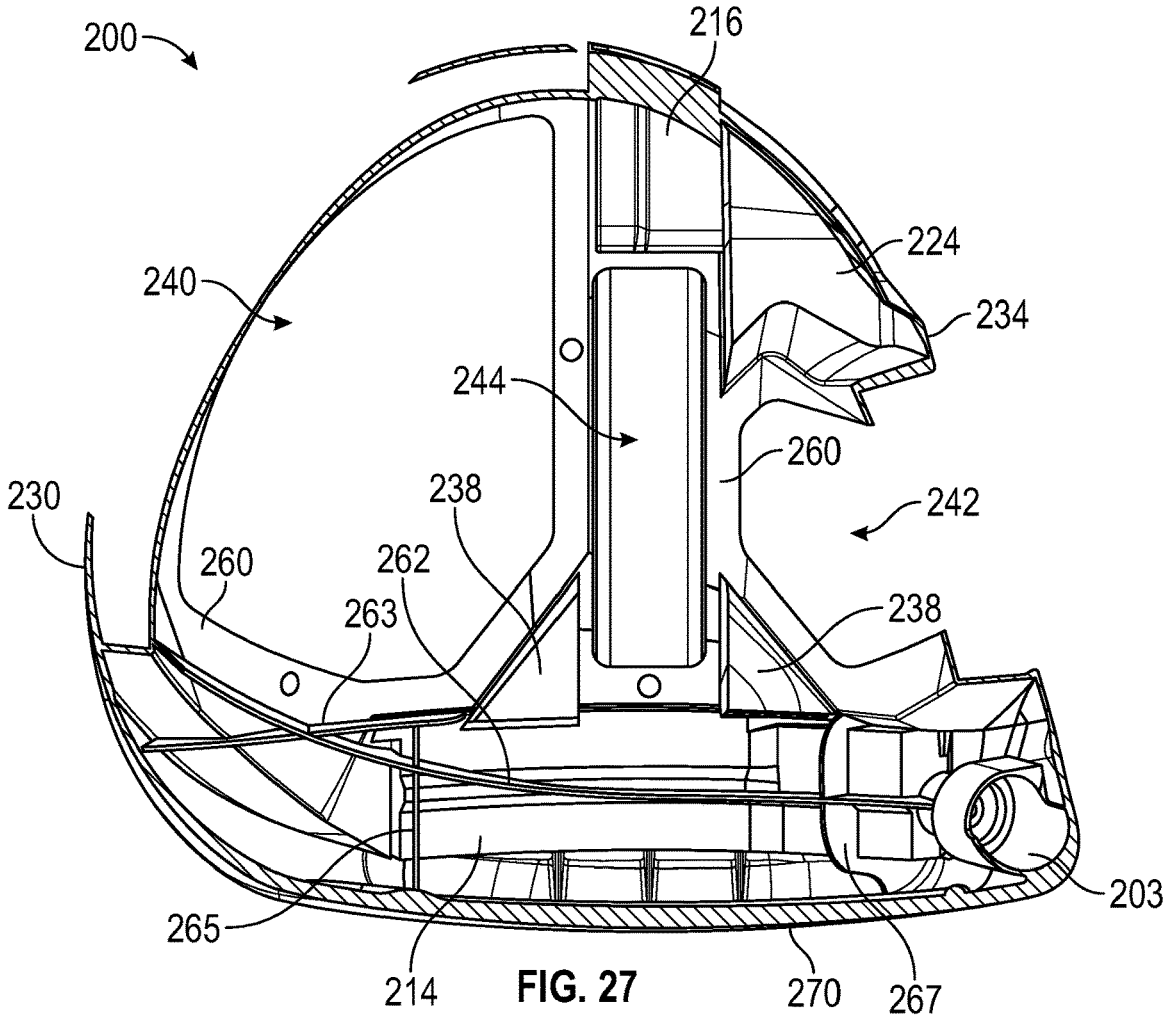
FIG. 27 is a cross-sectional top-down view of a lower portion of the body of FIG. 22.
Figure 28:
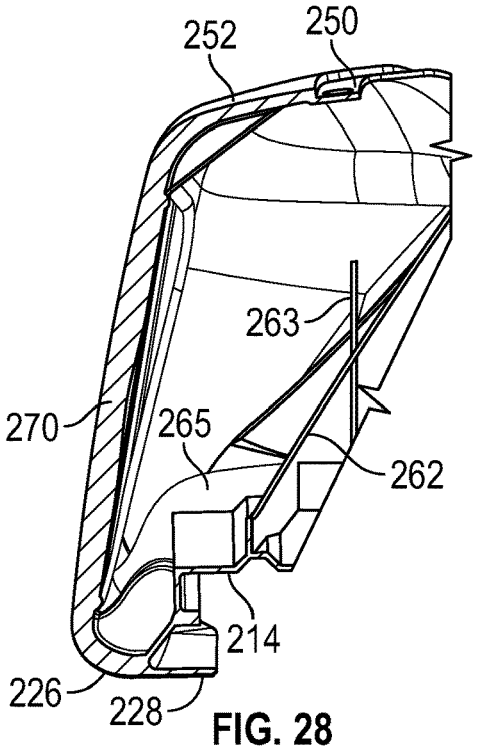
FIG. 28 is a cross-sectional side view of a toe portion of the body of FIG. 22.

The head 200 has a raised sole that is defined by a combination of the body 202 and the sole insert 208. As shown in FIGS. 22 and 27, for example, the lower portion of the body 202 include a toe-side opening 240, a heel-side opening 242, and a rear track opening 244, all of which are covered by the sole insert 208. The rear weight track 216 is positioned below the sole insert 208. As shown in FIG. 24, the toe-side opening 240 and heel-side opening 242 can can include a ledge or seat around the openings that receive the sole insert 208.

Figure 20:
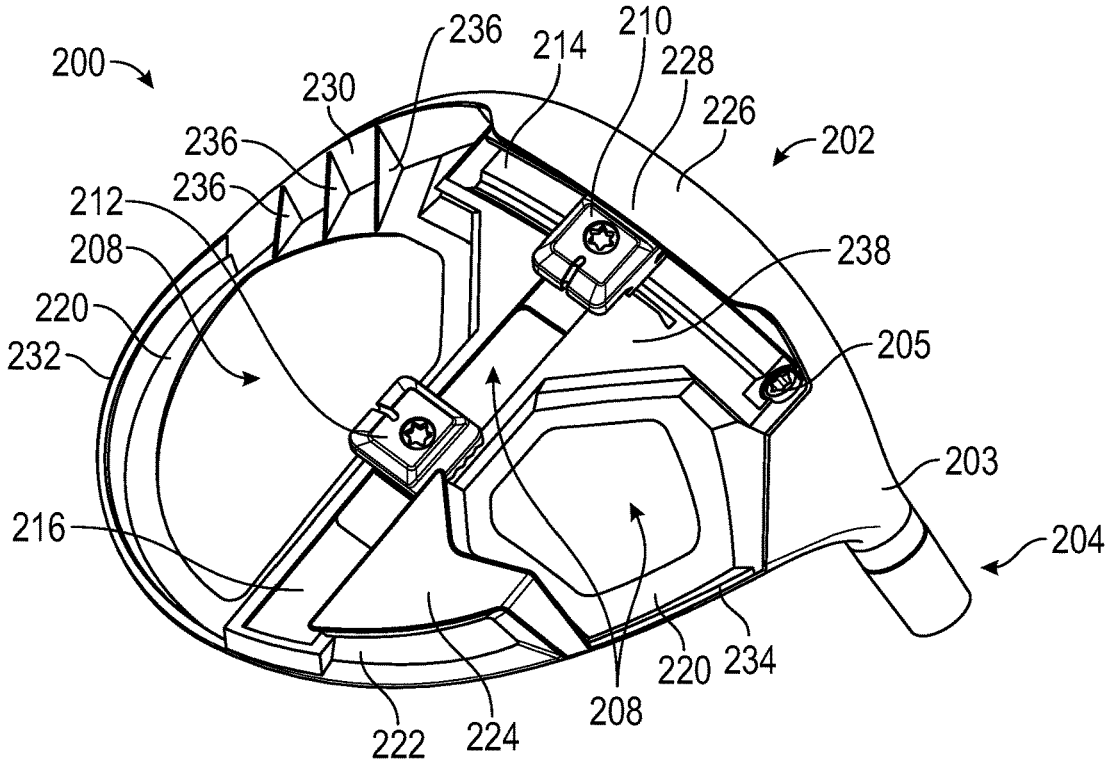
FIG. 20 is a bottom perspective view of yet another exemplary golf club head disclosed herein.
Figure 21:
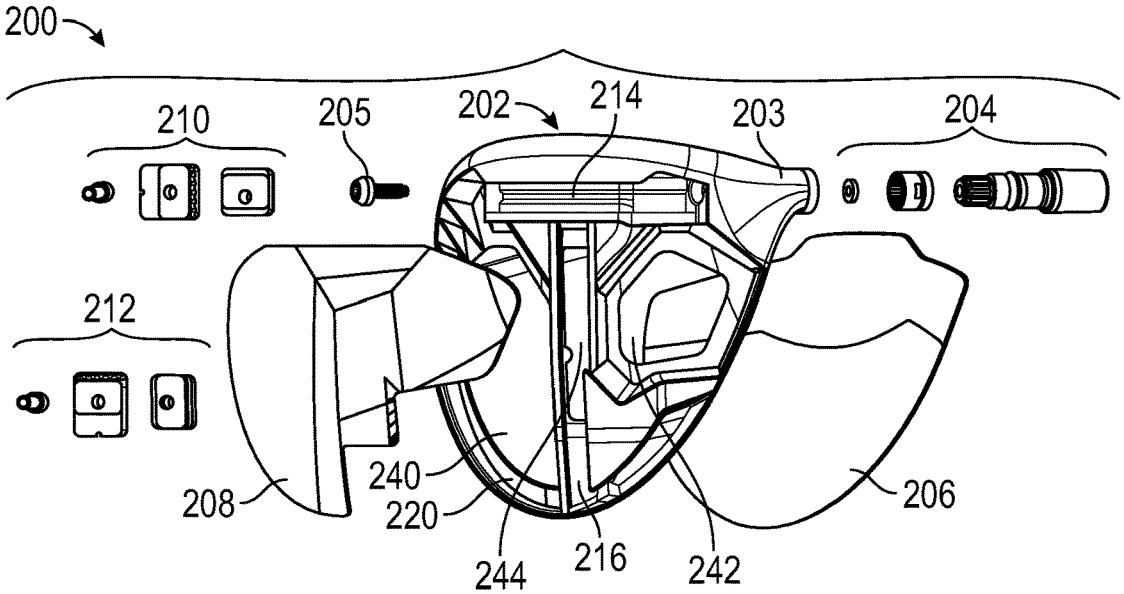
FIG. 21 is an exploded bottom perspective view of the golf club head of FIG. 20.
Figure 26:
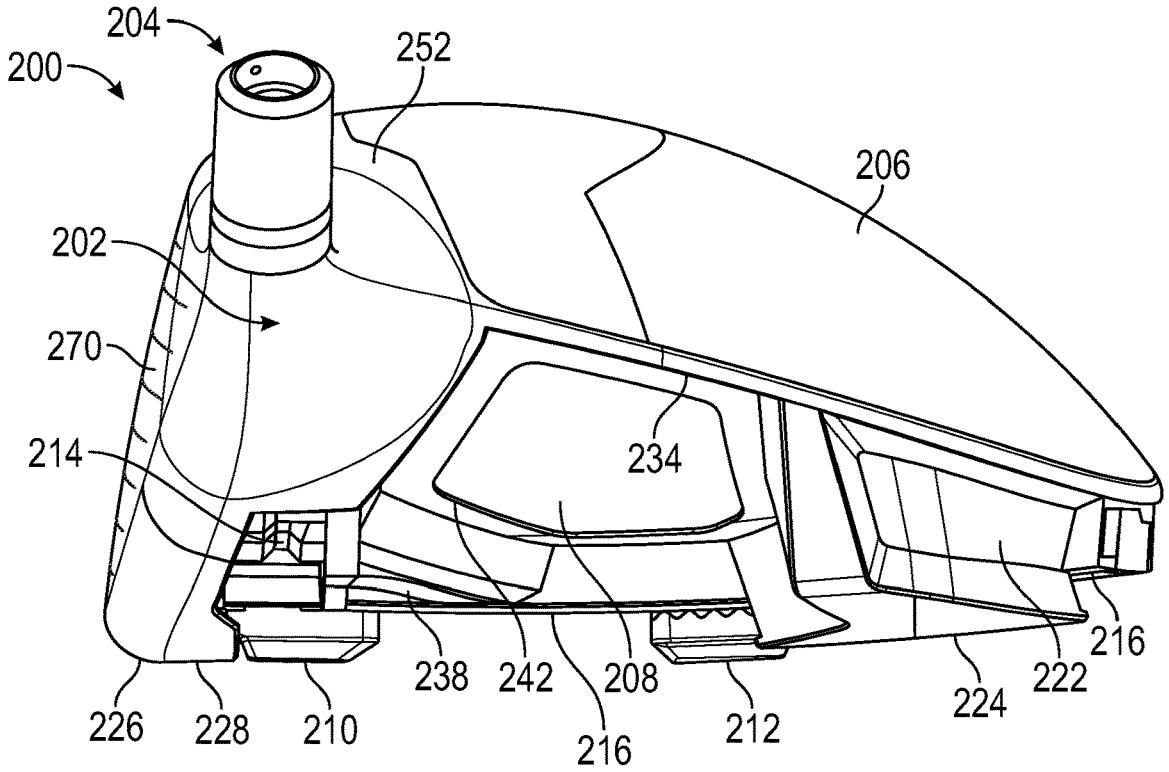
FIG. 26 is a heel side view of the golf club head of FIG. 20.
Figure 26A:
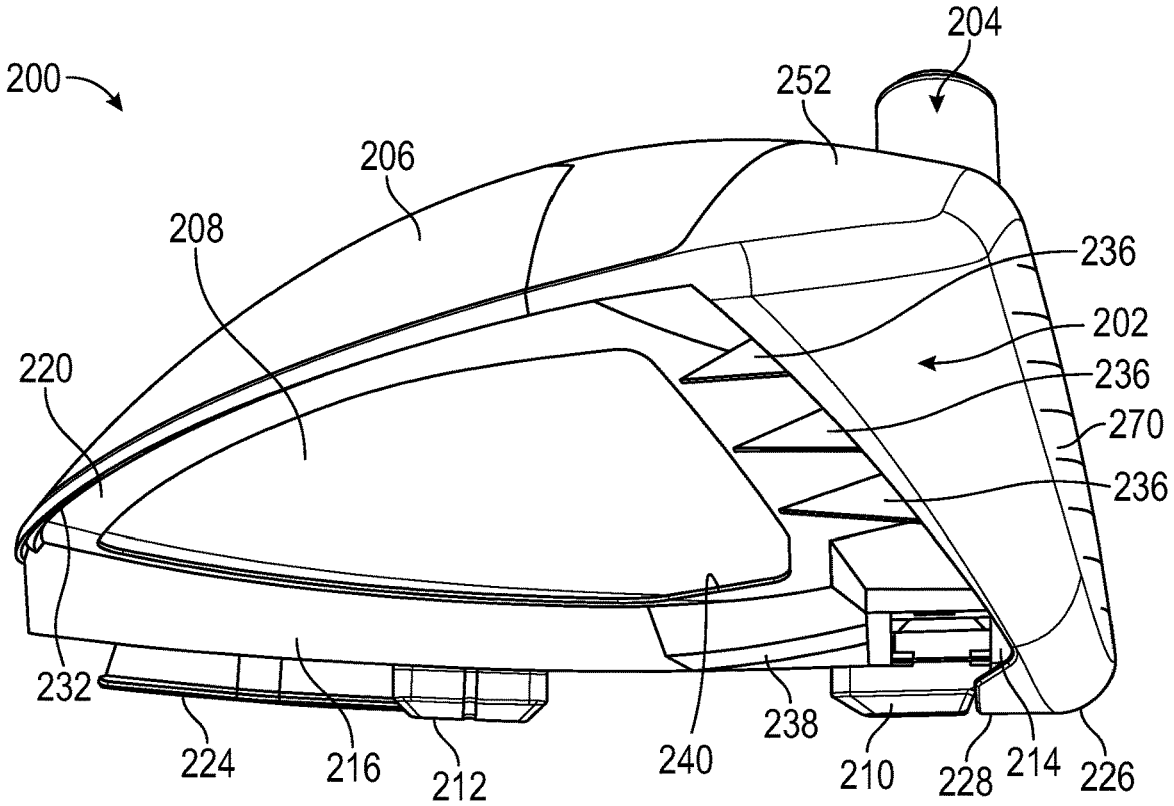
FIG. 26A is a toe side view of the golf club head of FIG. 20.

The head 200 also includes a toe-side cantilevered ledge 232 extending around the perimeter from the rear weight track 216 or rear sit pad 224 around to toe region adjacent the face, where the ledge 232 joins with a toe portion 230 of the body that extends toeward from the front sit pad 226. One or more optional ribs 236 can join the toe portion 230 to the raised sole adjacent a forward end of the toe-side opening 240 in the body. Three such triangular ribs are illustrated in FIG. 20 and FIG. 26A.

The head 200 also includes a heel-side cantilevered ledge 234 that extends from near the hosel region rearward to the rear sit pad 224 or to the rear end of the rear weight track 216. In some embodiments, the two cantilevered ledges 232 and 234 can meet and/or form a continuous ledge that extends around the rear of the head. The rear sit pad 224 can optionally include a recessed rear portion 222 (as shown in FIG. 26).

The lower portion of the body 202 that forms part of the sole can include various features, thickness variations, ribs, etc, to provide enhanced rigidity where desired and weight saving when rigidity is less desired. The body can include thicker regions 238, for example, near the intersection of the two weight tracks 214, 216. The body can also include thin ledges or seats 260 around the openings 240, 242, with the ledges 260 configured to receive and mate with sole insert 208. The lower surfaces of the body can also include various internal ribs to enhance rigidity and acoustics, such as ribs 262, 263, 265, and 267 shown in FIGS. 27 and 28.

Figure 21A:
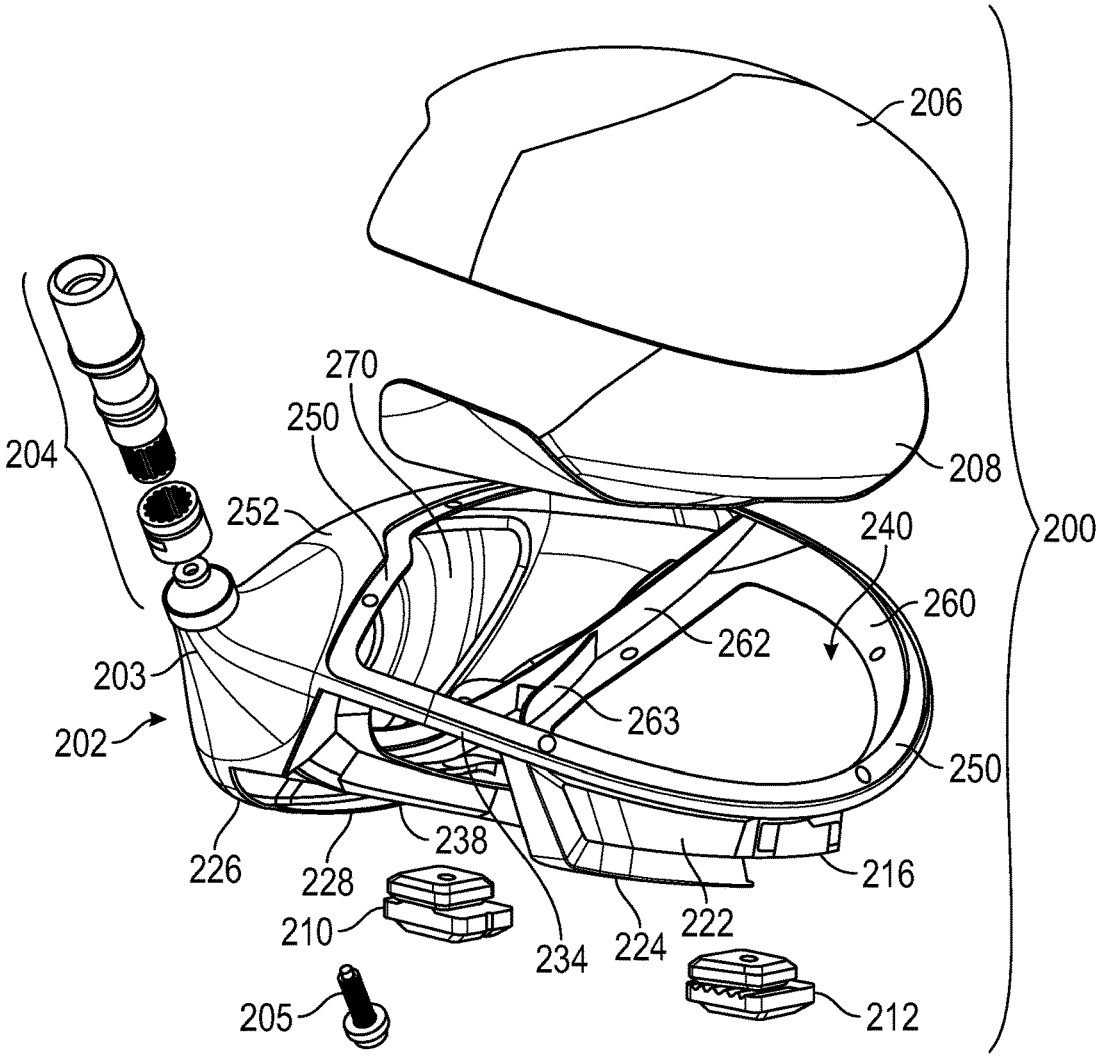
FIG. 21A is an exploded side perspective view of the golf club head of FIG. 20.

The upper portion of the body can also include various features, thickness variations, ribs, etc, to provide enhanced rigidity where desired and weight saving when rigidity is less desired. For example, the body includes a thinner seat region 250 around the upper opening to receive the crown insert 206. As shown in FIG. 21A, the seats 250 and 260 for the crown and sole inserts can be close to each other, even sharing a common edge, around the outer perimeter of the body.

Figure 36A:
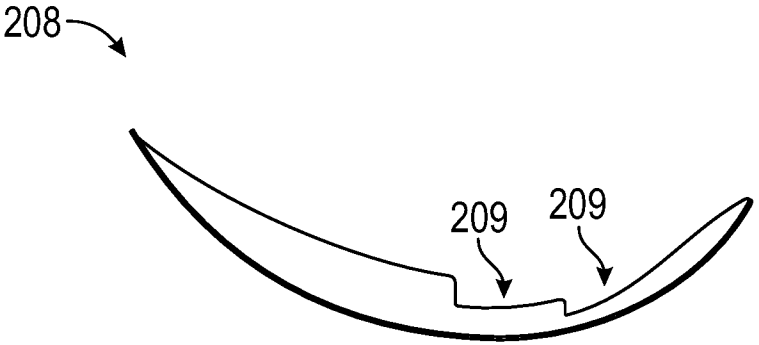
FIG. 36A is a front side view of the sole portion of the golf club head of FIG. 20.
Figure 36B:
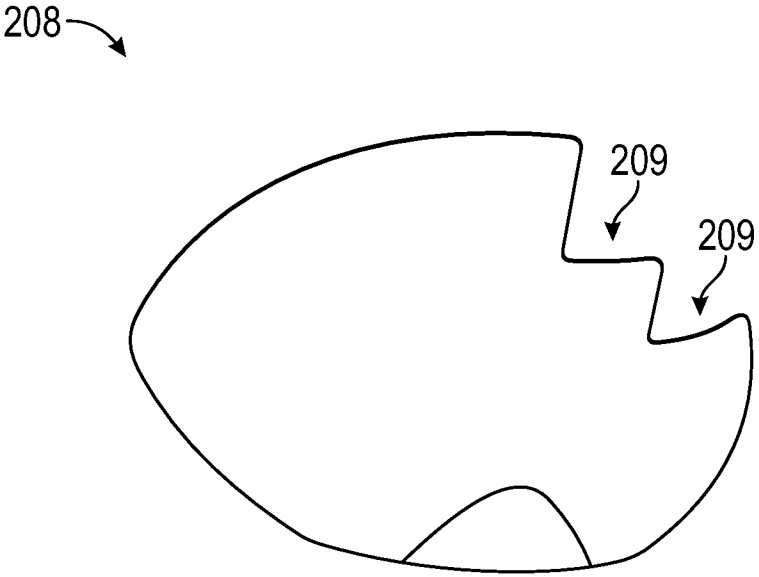
FIG. 36B is a bottom view of the sole portion of the golf club head of FIG. 20.

FIGS. 35A-D show top views of the head 200 in various states with the crown and sole inserts in place and/or removed. FIGS. 36A-D show the crown and sole inserts in more detail. As shown in FIGS. 36A and 36B, the sole insert 208 can have an irregular shape with a concave upper surface and convex lower surface. The sole insert 208 can also include notches 209 at the rear-heel end to accommodate fitting around the rear sit pad 224 area, where enhanced rigidity is needed due to ground contact forces. In various embodiments, the sole insert can cover at least about 50% of the surface area of the sole, at least about 60% of the surface area of the sole, at least about 70% of the surface area of the sole, or at least about 80% of the surface area of the sole. In another embodiment, the sole insert covers about 50% to 80% of the surface area of the sole. The sole insert contributes to a club head structure that is sufficiently strong and stiff to withstand the large dynamic loads imposed thereon, while remaining relatively lightweight to free up discretionary mass that can be allocated strategically elsewhere within the club head.

The sole insert 208 has a geometry and size selected to at least cover the openings 240, 242, 244 in the bottom of the body, and can be secured to the frame by adhesion or other secure fastening technique. In some embodiments, the ledges 260 may be provided with indentations to receive matching protrusions or bumps on the underside of the sole insert to further secure and align the sole insert on the frame.

Like the sole, the crown also has an opening 246 that reduces the mass of the body 202, and more significantly, reduces the mass of the crown, a region of the head where increased mass has the greatest impact on raising (undesirably) the CG of the head. Along the periphery of the opening 246, the frame includes a recessed ledge 250 to seat and support the crown insert 206. The crown insert 206 (see FIGS. 36C and 36D) has a geometry and size compatible with the crown opening 246 and is secured to the body by adhesion or other secure fastening technique so as to cover the opening 246. The ledge 260 may be provided with indentations along its length to receive matching protrusions or bumps on the underside of the crown insert to further secure and align the crown insert on the body. The crown insert may also include a forward projection 207 that extends in to the forward crown portion 252 of the body.

In various embodiments, the ledges of the body that receive the crown and sole inserts (e.g. ledges 250 and 260) may be made from the same metal material (e.g., titanium alloy) as the body and, therefore, can add significant mass to the golf club head. In some embodiments, in order to control the mass contribution of the ledge to the golf club head, the width of the ledges can be adjusted to achieve a desired mass contribution. In some embodiments, if the ledges add too much mass to the golf club head, it can take away from the decreased weight benefits of a sole and crown inserts, which can be made from a lighter materials (e.g., carbon fiber or graphite composites and/or polymeric materials). In some embodiments, the width of the ledges may range from about 3 mm to about 8 mm, preferably from about 4 mm to about 7 mm, and more preferably from about 4.5 mm to about 5.5 mm. In some embodiments, the width of the ledges may be at least four times as wide as a thickness of the respective insert. In some embodiments, the thickness of the ledges may range from about 0.4 mm to about 1 mm, preferably from about 0.5 mm to about 0.8 mm, and more preferably from about 0.6 mm to about 0.7 mm. In some embodiments, the thickness of the ledges may range from about 0.5 mm to about 1.75 mm, preferably from about 0.7 mm to about 1.2 mm, and more preferably from about 0.8 mm to about 1.1 mm. Although the ledges may extend or run along the entire interface boundary between the respective insert and the body, in alternative embodiments, the ledges may extend only partially along the interface boundaries.

The periphery of crown opening 246 can be proximate to and closely track the periphery of the crown on the toe-, rear-, and heel-sides of the head 200. In contrast, the face-side of the crown opening 246 can be spaced farther from the face 270 region of the head. In this way, the head can have additional frame mass and reinforcement in the crown area 252 just rearward of the face 270. This area and other areas adjacent to the face along the toe, heel and sole support the face and are subject to the relatively higher impact loads and stresses due to ball strikes on the face. As described elsewhere herein, the frame may be made of a wide range of materials, including high strength titanium, titanium alloys, and/or other metals. The opening 246 can have a notch at the front side which matingly corresponds to the crown insert projection 207 to help align and seat the crown insert on the body.

The front and rear weight tracks 214, 216 are located in the sole of the club head and define tracks for mounting two-piece slidable weight assemblies 210, 212, respectively, which may be fastened to the weight tracks by fastening means such as screws. The weight assemblies can take forms other than as shown in FIG. 21A, can be mounted in other ways, and can take the form of a single piece design or multi-piece design. The weight tracks allows the weight assemblies to be loosened for slidable adjustment along the tracks and then tightened in place to adjust the effective CG and MOI characteristics of the club head. For example, by shifting the club head's CG forward or rearward via the rear weight assembly 212, or heelward or toeward via the front weight assembly 210, the performance characteristics of the club head can be modified to affect the flight of the golf ball, especially spin characteristics of the golf ball. In other embodiments, the front weight track 214 can instead be a front channel without a movable weight.

The sole of the body 202 preferably is integrally formed with the front weight track 214 extending generally parallel to and near the face of the club head and generally perpendicular to the rear weight track 216, which extends rearward from near the middle of the front track toward the rear of the head.

In the illustrated embodiments, the weight tracks each only include one weight assembly. In other embodiments, two or more weight assemblies can be mounted in either or both of the weight tracks to provide alternative mass distribution capabilities for the club head.

By adjusting the CG heelward or toeward via the front weight track 214, the performance characteristics of the club head can be modified to affect the flight of the ball, especially the ball's tendency to draw or fade and/or to counter the ball's tendency to slice or hook. By adjusting the CG forward or rearward via the rear weight track 216, the performance characteristics of the club head can be modified to affect the flight of the ball, especially the ball's tendency to move upwardly or resist falling during flight due to backspin. The use of two weights assemblies in either track can allow for alternative adjustment and interplay between the two weights. For example, with respect to the front track 214, two independently adjustable weight assemblies can be positioned fully on the toe side, fully on the heel side, spaced apart a maximum distance with one weight fully on the toe side and the other fully on the heel side, positioned together in the middle of the weight track, or in other weight location patterns. With a single weight assembly in a track, as illustrated, the weight adjustment options are more limited but the effective CG of the head still can be adjusted along a continuum, such as heelward or toeward or in a neutral position with the weight centered in the front weight track.

Figure 29:
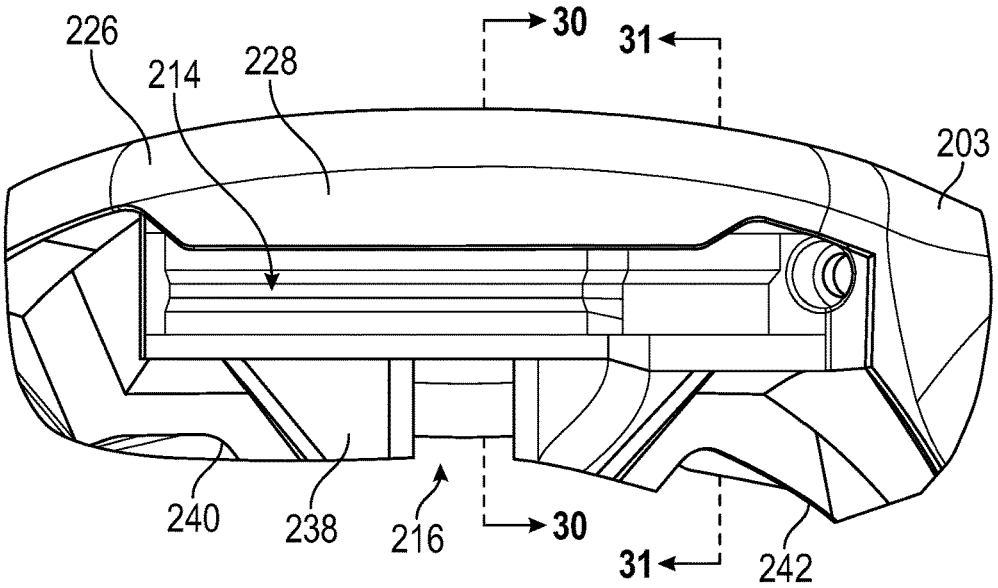
FIG. 29 is a bottom view of a front portion of the sole of the body of FIG. 22.
Figure 30:
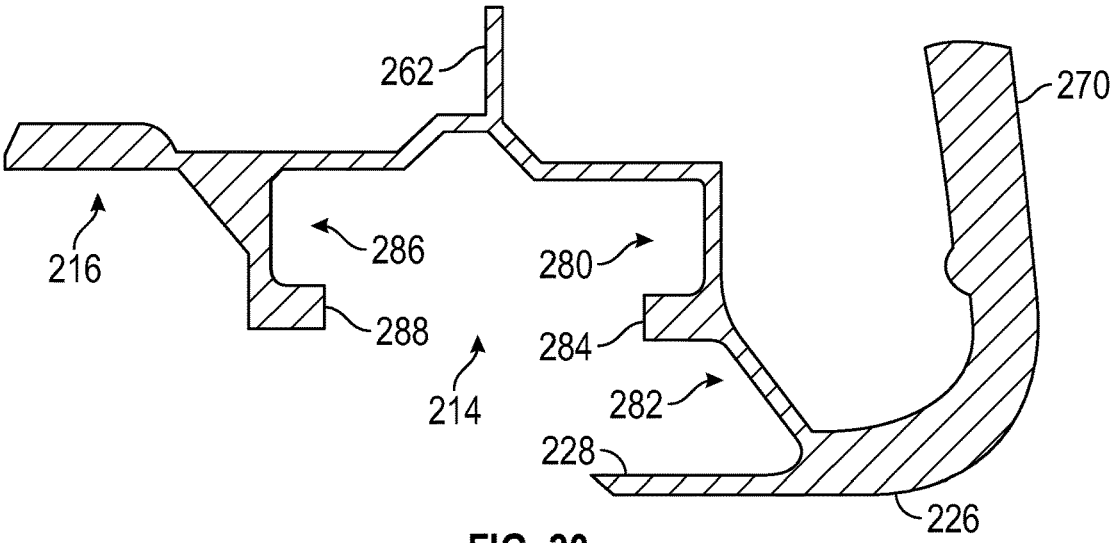
FIG. 30 is an enlarged detail cross-section view of a side-to-side weight track taken generally along line 30-30 of FIG. 29.
Figure 31:
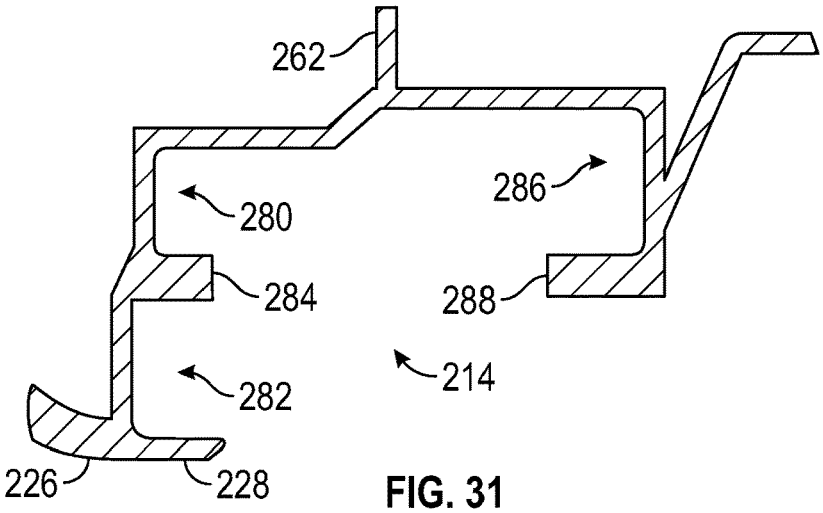
FIG. 31 is another enlarged detail cross-section view of the side-to-side weight track taken generally along line 31-31 of FIG. 29.
Figure 32:
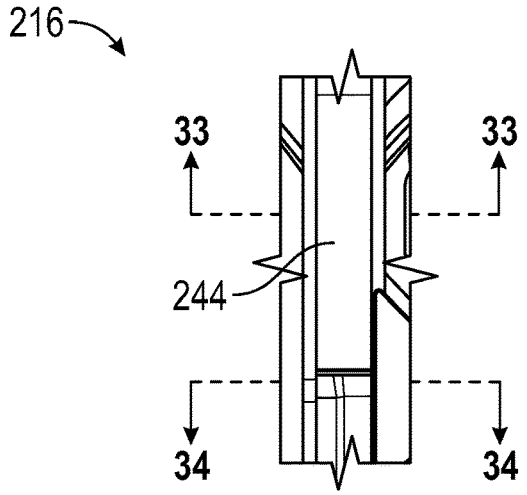
FIG. 32 is a bottom view of a portion of the sole of the body of FIG. 22 including a front-to-rear weight track.
Figure 33:
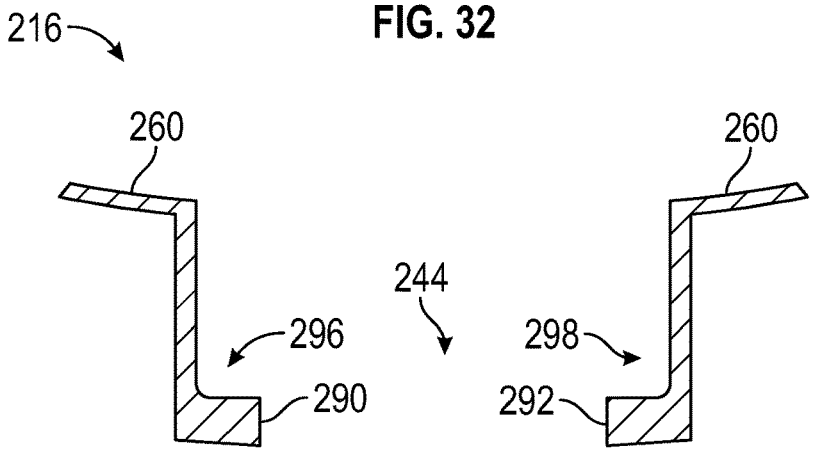
FIG. 33 is an enlarged detail cross-section view of the front-to-rear weight track taken generally along line 33-33 of FIG. 32.
Figure 34:
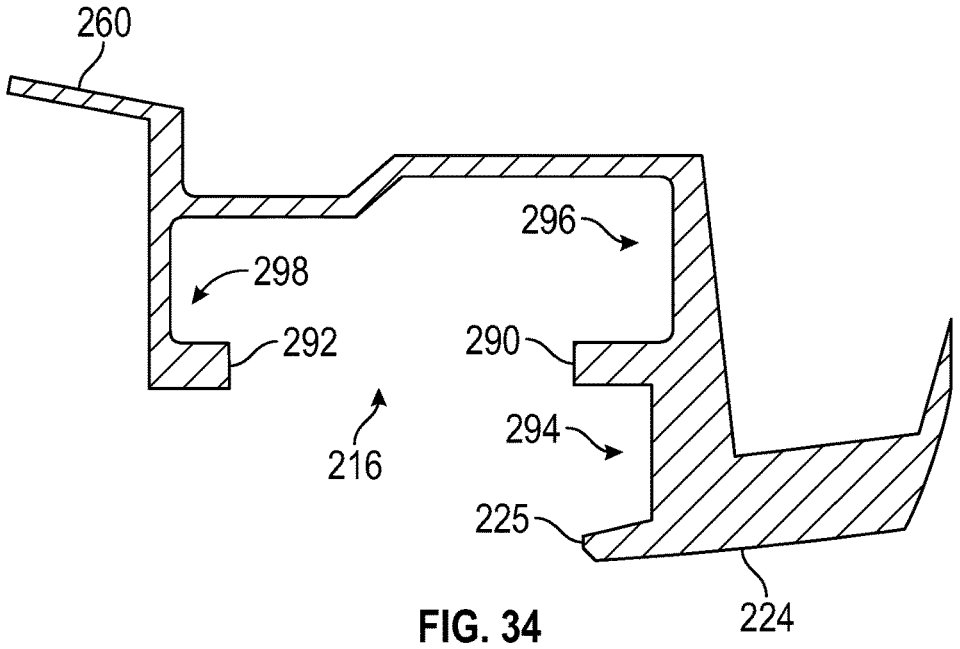
FIG. 34 is another enlarged detail cross-section view of the front-to-rear weight track taken generally along line 34-34 of FIG. 32.
Figure 35C:
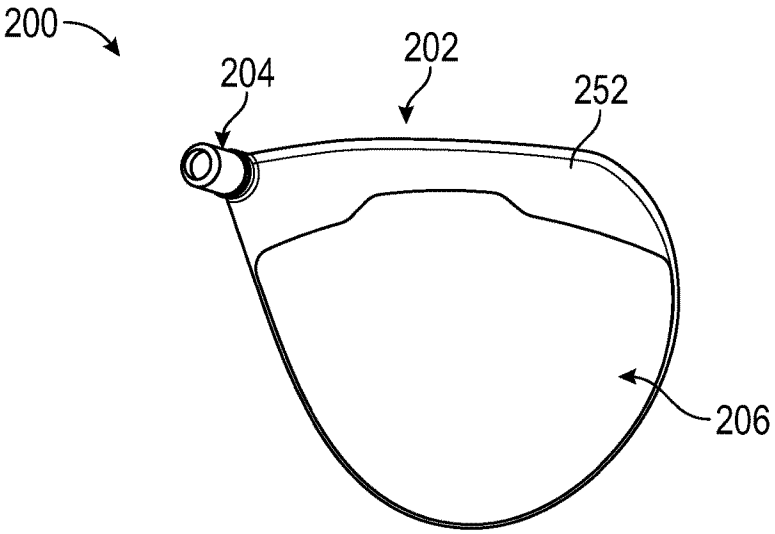
FIG. 35C is a top view of the golf club head of FIG. 20 with the crown portion in place.
Figure 35D:
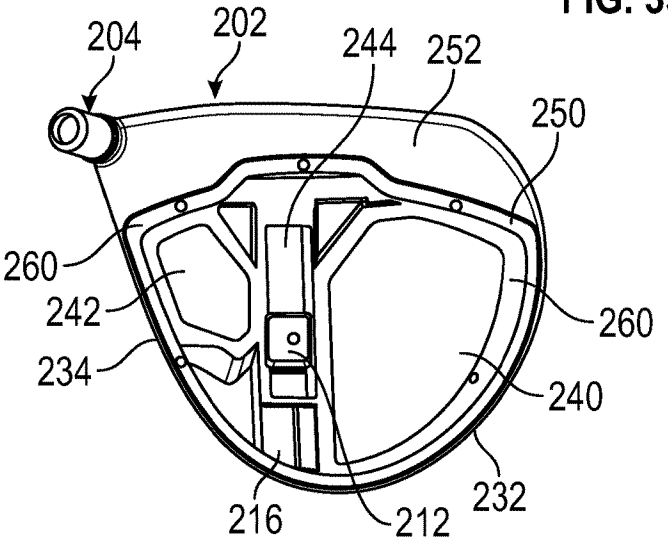
FIG. 35D is a top view of the golf club head of FIG. 20 with both the crown portion and the sole portion removed.
Figure 35A:
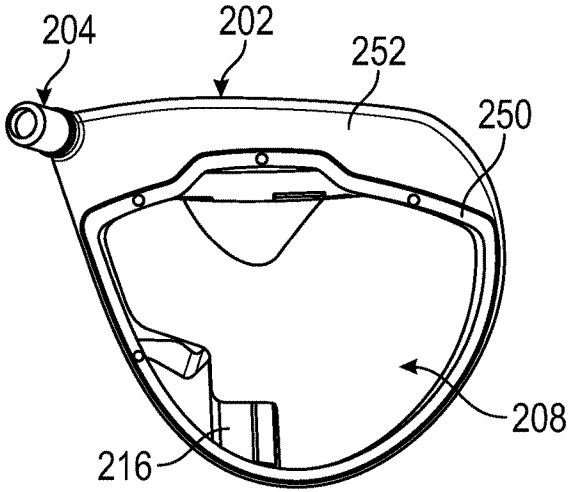
FIG. 35A is a top view of the golf club head of FIG. 20 with a crown portion removed, showing a sole portion positioned in the body.
Figure 35B:
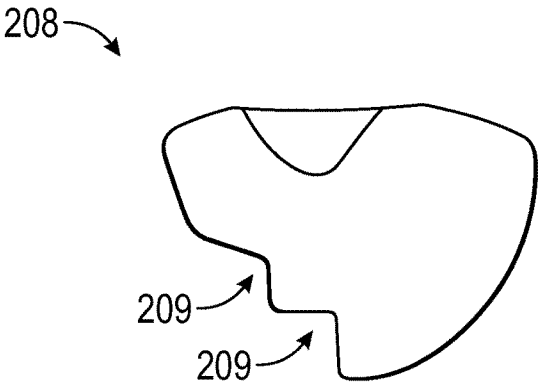
FIG. 35B is a top view of the sole portion of the golf club head of FIG. 20.

As shown in FIGS. 29-34, each of the weight tracks 214, 216 preferably has a recess, which may be generally rectangular in shape, to provide a recessed track to seat and guide the weight as it adjustably slides along the track. Each track includes one or more peripheral rails or ledges to define an elongate channel preferably having a width dimension less than the width of the weight placed in the channel. For example, as shown in FIGS. 29 and 30, the front track 214 includes opposing peripheral rails 288 and 284 and, as shown in FIGS. 33 and 34, the rear track 216 includes opposing peripheral rails 290 and 292. In this way, the weights can slide in the weight track while the rails prevent them from passing out of the tracks. At the same time, the channels between the ledges permit the screws of the weight assemblies to pass through the center of the outer weight elements, through the channels, and then into threaded engagement with the inner weight elements. The ledges serve to provide tracks or rails on which the joined weight assemblies freely slide while effectively preventing the weight assemblies from inadvertently slipping out of the tracks, even when loosened. In the front track 214, the inner weight member of the assembly 210 sits above the rails 284 and 288 in inner recesses 280 and 286, while the outer weight member is partially seated in recess 282 between the forward rail 284 and the overhanging lip 228 of the front sit pad 226 (FIGS. 30, 31). In the rear track 216, the inner weight member of the assembly 212 sits above the rails 290 and 292 in inner recesses 296 and 298, while the outer weight member can be partially seated in recess 294 between the heel-side rail 290 and an overhanging lip 225 of the rear sit pad 224.

The weight assemblies can be adjusted by loosening the screws and moving the weights to a desired location along the tracks, then the screws can be tightened to secure them in place. The weights assemblies can also be swapped out and replaced by other weight assemblies having different masses to provide further mass adjustment options. If a second or third weight is added to the weight track, many additional weight location and distribution options are available for additional fine tuning of the head's effective CG location in the heel-toe direction and the front-rear direction, and combinations thereof. This also provides great range of adjust of the club head's MOI properties.

Any of the weight assemblies disclosed herein, such as 210, 212, can comprise a three piece assembly including an inner weight member, an outer weight member, and a fastener coupling the two weight members together. The assemblies can clamp onto front, back, or side ledges of the weight tracks by tightening the fastener such that the inner member contacts the inner side the ledge and the outer weight member contacts the outer side of the ledge, and the fastener is in tension, with enough clamping force to hold the assembly stationary relative to the body throughout a round of golf. Any of the weight members disclosed herein and/or the associated assemblies can be shaped and/or configured to be inserted into the weight track by inserting the inner weight member into the inner channel past the ledge(s) at a usable portion of the weight track, as opposed to inserting the inner weight at an enlarged opening at one end of the weight track where the weight assembly is not configured to be secured in place. This can allow for elimination of such a wider, non-functional opening at the end of the track, and allow the track to be shorter or to have a longer functional ledge length over which the weight assembly can be secured. To allow the inner weight member to be inserted into the track in the middle of the track (for example) past the ledge, the inner weight member can be inserted at an angle that is not perpendicular to the ledge, e.g., an angled insertion. Moreover, the insertion of the inner member into the channel can be in a direction that is not parallel to a longitudinal axis of the channel. Also, the weight member cannot be removed from the channel solely by movement perpendicular to the longitudinal axis of the channel. The weight member can be inserted at an angle and gradually rotated into the inner channel to allow insertion past the clamping ledge at a usable portion of the track. In some embodiments, the inner weight member can have a rounded, oval, oblong, arcuate, curved, or otherwise specifically shaped structure to better allow the weight member to insert into the channel past the ledge at a useable portion of the track. In addition, in some embodiments one or both weight members of an assembly can have a non-circular shape and/or shaped to prevent rotation of the weight member upon tightening then threaded fastening bolt. More information regarding weight assemblies and weight tracks can be found in U.S. Pub. No. 2017/0072277, published Mar. 16, 2017, which is incorporated by reference herein in its entirety.

In the golf club heads of the present disclosure, the ability to adjust the relative positions and masses of the slidably adjusted weights and/or threadably adjustable weights, coupled with the weight saving achieved by incorporation of the light-weight crown insert and/or sole insert, further coupled with the discretionary mass provided by the raised sole configurations, allows for a large range of variation of a number properties of the club-head all of which affect the ultimate club-head performance including the position of the CG of the club-head, MOI values of the club head, acoustic properties of the club head, aesthetic appearance and subjective feel properties of the club head, and/or other properties.

In certain embodiments, the front weight track and the rear weight track have certain track widths. The track widths may be measured, for example, as the horizontal distance between a first track wall and a second track wall that are generally parallel to each other on opposite sides of the inner portion of the track that receives the inner weight member of the weight assembly. With reference to FIGS. 29-31, the width of the front track 214 can be the horizontal distance between opposing walls of the inner recesses 280 and 286. With reference to FIGS. 32-34, the width of the rear track 216 can be the horizontal distance between opposing walls of the inner recesses 296 and 298. For both the front track and the rear track, the track widths may be between about 5 mm and about 20 mm, such as between about 10 mm and about 18 mm, or such as between about 12 mm and about 16 mm. According to some embodiments, the depth of the tracks (i.e., the vertical distance between the uppermost inner wall in the track and an imaginary plane containing the regions of the sole adjacent the outermost lateral edges of the track) may be between about 6 mm and about 20 mm, such as between about 8 mm and about 18 mm, or such as between about 10 mm and about 16 mm. For the front track 214, the depth of the track can be the vertical distance from the inner surface of the overhanging lip 228 to the upper surface of the inner recess 280 (FIG. 30). For the rear track 216, the depth of the track can be the vertical distance from the inner surface of the overhanging lip 225 to the upper surface of the inner recess 296 (FIG. 34).

Additionally, both the front track and rear track have a certain track length. Track length may be measured as the horizontal distance between the opposing longitudinal end walls of the track. For both the front track and the rear track, their track lengths may be between about 30 mm and about 120 mm, such as between about 50 mm and about 100 mm, or such as between about 60 mm and about 90 mm. Additionally, or alternatively, the length of the front track may be represented as a percentage of the striking face length. For example, the front track may be between about 30% and about 100% of the striking face length, such as between about 50% and about 90%, or such as between about 60% and about 80% mm of the striking face length.

The track depth, width, and length properties described above can also analogously also be applied to the front channel 36 of the club head 10.

In FIGS. 30 and 34, it can be seen that the lips 228, 225 of the front and rear sit pads extend over or overhang the respective weight tracks, restricting the track openings and helping retain the weight(s) within the tracks.

Referring to FIG. 34, the sole area on the rear sit pad 224 on the heel side of the rear track 216 is lower than the sole area on the toe side (bottom of ledge 292) by a significant vertical distance when the head is in the address position relative to a ground plane. This can be thought of as the head having a "dropped sole" or "raised sole" construction with a portion of the sole positioned lower (e.g., on the heel side) relative to another portion of the sole (e.g., on the toe side). Put another way, a portion of the sole (e.g., most of the sole except for the rear sit pad 224) is raised relative to another portion of the sole (e.g., the rear sit pad). The same also applies at the front track 214 where the front sit pad 226 and its lip 228 are significantly lower than the rear side of the front track (as shown in FIG. 30), in the normal address position.

In one embodiment, the vertical distance between the level of the ground contact surfaces of the sit pads and the adjacent surfaces of the raised sole portions may be in the range of about 2-12 mm, preferably about 3-9 mm, more preferably about 4-7 mm, and most preferably about 4.5-6.5 mm. In one example, the vertical distance is about 5.5 mm.

The wood-type club heads disclosed herein have a volume, typically measured in cubic-centimeters ($cm^3$) equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports. In embodiments disclosed herein, a golf club head can be configured to have a head volume between about 110 $cm^3$ and about 600 $cm^3$. In some embodiments, the head volume is between about 250 $cm^3$ and about 500 $cm^3$. In yet other embodiments, the head volume is between about 300 $cm^3$ and about 500 $cm^3$, between 400 $cm^3$ and about 500 $cm^3$, between about 400 $cm^3$ and about 460 $cm^3$ or between about 420 $cm^3$ and about 450 $cm^3$.

In the case of a driver (as illustrated), any of the disclosed golf club heads can have a volume between about 300 $cm^3$ and about 600 $cm^3$, between about 350 $cm^3$ and about 600 $cm^3$, and/or between about 350 $cm^3$ and about 500 $cm^3$, and can have a total mass between about 145 g and about 260 g, such as between about 195 g and about 205 g. In the case of a fairway wood (analogous to the illustrated embodiments), the golf club head may have a volume between about 100 $cm^3$ and about 300 $cm^3$, such as between about 150 $cm^3$ and about 250 $cm^3$, and a total mass between about 125 g and about 260 g. In the case of a utility or hybrid club (analogous to the illustrated embodiments), the golf club head may have a volume between about 60 $cm^3$ and about 150 $cm^3$, and a total mass between about 125 g and about 280 g.

Generally, the center of gravity (CG) of a golf club head is the average location of the weight of the golf club head or the point at which the entire weight of the golf club-head may be considered as concentrated so that if supported at this point the head would remain in equilibrium in any position. A club head origin coordinate system can be defined such that the location of various features of the club head, including the CG can be determined with respect to a club head origin positioned at the geometric center of the striking surface and when the club-head is at the normal address position (i.e., the club-head position wherein a vector normal to the club face substantially lies in a first vertical plane perpendicular to the ground plane, the centerline axis of the club shaft substantially lies in a second substantially vertical plane, and the first vertical plane and the second substantially vertical plane substantially perpendicularly intersect).

The head origin coordinate system defined with respect to the head origin includes three axes: a z-axis extending through the head origin in a generally vertical direction relative to the ground; an x-axis extending through the head origin in a toe-to-heel direction generally parallel to the striking surface (e.g., generally tangential to the striking surface at the center) and generally perpendicular to the z-axis; and a y-axis extending through the head origin in a front-to-back direction and generally perpendicular to the x-axis and to the z-axis. The x-axis and the y-axis both extend in generally horizontal directions relative to the ground when the club head is at the normal address position. The x-axis extends in a positive direction from the origin towards the heel of the club head. The y axis extends in a positive direction from the head origin towards the rear portion of the club head. The z-axis extends in a positive direction from the origin towards the crown. Thus for example, and using millimeters as the unit of measure, a CG that is located 3.2 mm from the head origin toward the toe of the club head along the x-axis, 36.7 mm from the head origin toward the rear of the clubhead along the y-axis, and 4.1 mm from the head origin toward the sole of the club head along the z-axis can be defined as having a $CG_x$ of −3.2 mm, a $CG_y$ of −36.7 mm, and a $CG_z$ of −4.1 mm.

Further as used herein, Delta 1 is a measure of how far rearward in the club head body the CG is located. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can create a higher dynamic loft and more reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

The embodiments disclosed herein can be provided with one or more adjustable weights, which can have a mass selected to vary Delta 1 of the club head to a value greater than 5 mm, greater than 10 mm, greater than 15 mm, and greater than 18.5 mm.

Similarly Delta 2 is the distance between the CG and the hosel axis along the x axis (in the direction straight toward the back of the body of the golf club face from the geometric center of the striking face).

Adjusting the location of the discretionary mass in a golf club head as described herein can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

In addition to the position of the CG of a club-head with respect to the head origin another important property of a golf club-head is a projected CG point on the golf club head striking surface which is the point on the striking surface that intersects with a line that is normal to the tangent line of the ball striking club face and that passes through the CG. This projected CG point ("CG Proj") can also be referred to as the "zero-torque" point because it indicates the point on the ball striking club face that is centered with the CG. Thus, if a golf ball makes contact with the club face at the projected CG point, the golf club head will not twist about any axis of rotation since no torque is produced by the impact of the golf ball. A negative number for this property indicates that the projected CG point is below the geometric center of the face.

In terms of the MOI of the club-head (i.e., a resistance to twisting) it is typically measured about each of the three main axes of a club-head with the CG as the origin of the coordinate system. These three axes include a CG z-axis extending through the CG in a generally vertical direction relative to the ground when the club head is at normal address position; a CG x-axis extending through the CG origin in a toe-to-heel direction generally parallel to the striking surface (e.g., generally tangential to the striking surface at the club face center), and generally perpendicular to the CG z-axis; and a CG y-axis extending through the CG origin in a front-to-back direction and generally perpendicular to the CG x-axis and to the CG z-axis. The CG x-axis and the CG y-axis both extend in generally horizontal directions relative to the ground when the club head is at normal address position. The CG x-axis extends in a positive direction from the CG origin to the heel of the club head. The CG y-axis extends in a positive direction from the CG origin towards the rear portion of the golf club head. The CG z-axis extends in a positive direction from the CG origin towards the crown. Thus, the axes of the CG origin coordinate system are parallel to corresponding axes of the head origin coordinate system. In particular, the CG z-axis is parallel to z-axis, the CG x-axis is parallel to x-axis, and CG y-axis is parallel to y-axis.

Specifically, a club head as a moment of inertia about the vertical axis ("Izz"), a moment of inertia about the heel/toe axis ("Ixx"), and a moment of inertia about the front/back axis ("Iyy"). Typically, however, the MOI about the z-axis (Izz) and the x-axis (Ixx) is most relevant to club head forgiveness.

A moment of inertia about the golf club head CG x-axis (Ixx) is calculated by the following equation:

$$Ixx=\int(y^2+z^2)dm$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following equation:

$$Izz=\int(x^2+y^2)dm$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

A further description of the coordinate systems for determining CG positions and MOI can be found US Patent Publication No. 2012/0172146 A1 published on Jul. 5, 2012, the entire contents of which is incorporated by reference herein.

As shown in Tables 1 and 2 below, the clubs of the present disclosure are able to achieve extremely high ranges of CGx, CGz, Delta 1 and Delta 2 and Ixx, Izz and projected CG position within the adjustability ranges of the club head. Table 1 below provides exemplary data for embodiments of the golf club heads 10 and 100 disclosed herein.

TABLE 1

| | Embodiment: | |
|---|---|---|
| | Golf Club Head 10 | Golf Club Head 100 |
| TOTAL MASS (w/snot): | 200.2 | 199.9 |
| VOLUME: | 436 | 435 |
| ADDRESS AREA: | 12244 | 12756 |
| CGX: | 0.3 | 0.2 |
| CGZ: | −3.13 | −3.57 |
| Z UP: | 28.7 | 27.2 |
| ASM DELTA-1: | 19.4 | 24.6 |
| Ixx: | 320 | 403 |
| Iyy: | 299 | 283 |
| Izz: | 486 | 564 |
| CG ANGLE: | 28.9 | 34.5 |
| CFX: | 54.2 | 49.6 |
| CFY: | 14.5 | 14.7 |
| CFZ: | 38.8 | 39.6 |
| GND LOFT: | 10.6 | 11.5 |
| LOFT (FA = 0): | 9.2 | 9.5 |
| BODY LIE: | 56 | 56 |
| ASM LIE: | 54.3 | 54.3 |
| FACE ANGLE: | 2.1 | 3 |
| BULGE RADIUS: | 330.2 | 330.2 |
| ROLL RADIUS: | 279.4 | 279.4 |
| FACE HEIGHT: | 56.7 | 62.1 |
| FACE WIDTH: | 87.2 | 85.7 |
| FACE LENGTH: | 50.8 | 53.6 |

TABLE 1-continued

| | Embodiment: | |
|---|---|---|
| | Golf Club Head 10 | Golf Club Head 100 |
| BALANCE POINT L: | 28.93 | 30.83 |
| CG L: | 23.4 | 25.18 |
| FACE AREA: | 4283 | 4461 |
| FACE PROGRESSION: | 17.5 | 17.9 |
| HOSEL AXIS TO BACK LENGTH | 100.6 | 103.9 |
| CENTER FACE from GND: | 31.8 | 30.7 |
| HEAD HEIGHT: | 67.3 | 64.8 |
| HEAD LENGTH: | 123.6 | 127.1 |
| Shaft Rotation Angle | 2.53502 | 3.6 |
| D1' | 19.4 | 24.6 |
| CGx' | 0.3 | 0.2 |
| CGz' | −3.13 | −3.6 |
| Square Loft | 9.2 | 9.50 |
| CG Projected on Face | 2.330236 | 2.97 |
| CG Projected distance to CF | 2.349468 | 3.0 |

Table 2 below provides exemplary data for configurations of the golf club head 200 disclosed herein, with the front weight assembly 210 and rear weight assembly 212 in various positions. In each case, both weight assemblies have a mass of 15 grams (though weights with any other mass values can be used). In Table 2, "C/F" means the front weight assembly is in the center of the front track and the rear weight assembly is at the front of the rear track. "C/M" means the front weight assembly is in the center of the front track and the rear weight assembly is at the middle of the rear track. "C/B" means the front weight assembly is in the center of the front track and the rear weight assembly is at the back of the rear track.

TABLE 2

| Golf Club Head 200 | C/F | C/M | C/B | B/B |
|---|---|---|---|---|
| Face Area | | 3947 | | |
| Address Area | | 12361 | | |
| Face Height | | 60.8 | | |
| Head Height | | 66.0 | | |
| Loft angle | | 9.6 | | |
| Lie angle | | 56.5 | | |
| Face Angle | | 2.0 | | |
| Delta 1 | 17.8 | 20 | 22.6 | 24.9 |
| Ixx | 295 | 307 | 355 | 365 |
| Izz | 419 | 432 | 482 | 510 |
| CG Projection | 0.6 | 1 | 1.8 | 2.4 |
| Aero eCT | | 256 | | |
| Front/Back Track L | | 86.9 | | |
| Delta 1 change | | 4.8 | | |

As shown in Tables 1 and 2 above, embodiments of the present disclosure are able to achieve high MOI (Ixx and Izz), relatively low CG ($CG_z$) and a desirable Center of Gravity projection on the club face, also known as "balance point on the face" (BP Proj.). CGx and CGz represent center of gravity locations on the x and z coordinate axes, respectively. Delta 1 (D1) represents the distance between the club head's CG and its hosel axis along the Y axis (in a direction straight toward the back of the body of the club head face from the geometric center of the face). Thus, for embodiments disclosed herein in which the projected CG (BP Proj.) on the ball striking face is lower than the geometric center, reducing Delta 1 produces a lower projected CG and a lower dynamic loft and creates a desirable further reduction in backspin due to the Z-axis gear effect. Thus, some embodiment disclosed herein can facilitate a club design having a desirable high launch angle and yet relatively low spin rate. High launch trajectories are normally associated with higher spin rates. "Mass" denotes the mass of the club head in grams. Ixx and Izz denote the moment of inertia of the club head about the x and z axes, respectively. The Delta 1 value may have a range of adjustability due to the adjustable front-to-back weight(s) of at least 5 mm, at least 10 mm, at least 15 mm or at least 18.5 mm, for example. The adjustability in one exemplary embodiment may range from about 5 to 28.1 mm, for example. The foregoing properties and values may also be achieved with relatively light polymer (or composite) sole and crown inserts.

The United States Golf Association (USGA) regulations constrain golf club head shapes, sizes, and moments of inertia. Due to theses constraints, golf club manufacturers and designers struggle to produce club heads having maximum size and moment of inertia characteristics while maintaining all other golf club head characteristics. For example, one such constraint is a volume limitation of 460 $cm^3$. In general, volume is measured using the water displacement method. However, the USGA will fill any significant cavities in the sole or series of cavities which have a collective volume of greater than 15 $cm^3$.

To produce a more forgiving golf club head designers struggle to maximize certain parameters such as face area, moment of inertia about the z-axis and x-axis, and address area. A larger face area makes the club head more forgiving. Likewise, higher moment of inertia about the z-axis and x-axis makes the club head more forgiving. Similarly, a larger front to back dimension will generally increase moment of inertia about the z-axis and x-axis because mass is moved further from the center of gravity and the moment of inertia of a mass about a given axis is proportional to the square of the distance of the mass away from the axis. Additionally, a larger front to back dimension will generally lead to a larger address area which inspires confidence in the golfer when s/he addresses the golf ball.

Figure 55:
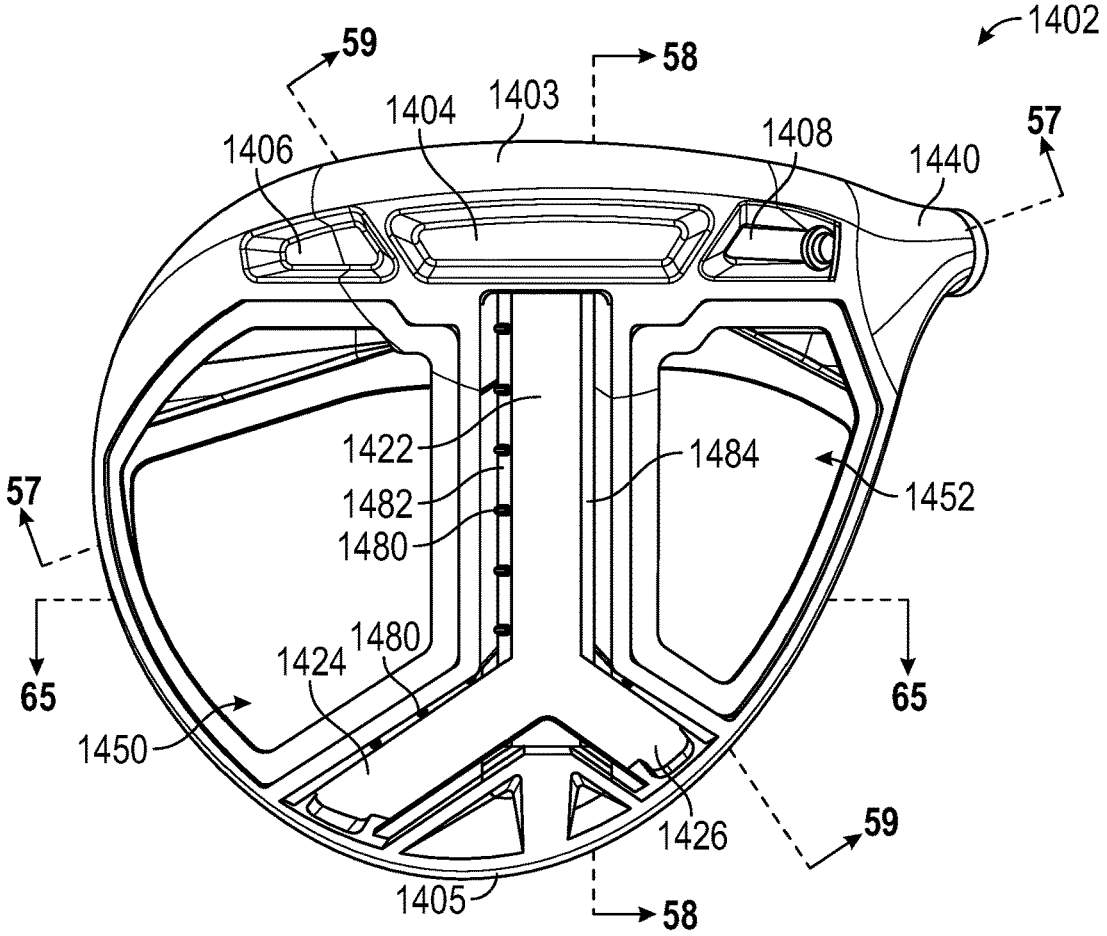
FIG. 55 is a bottom view of the body of the club head of FIG. 48.
Figure 56:
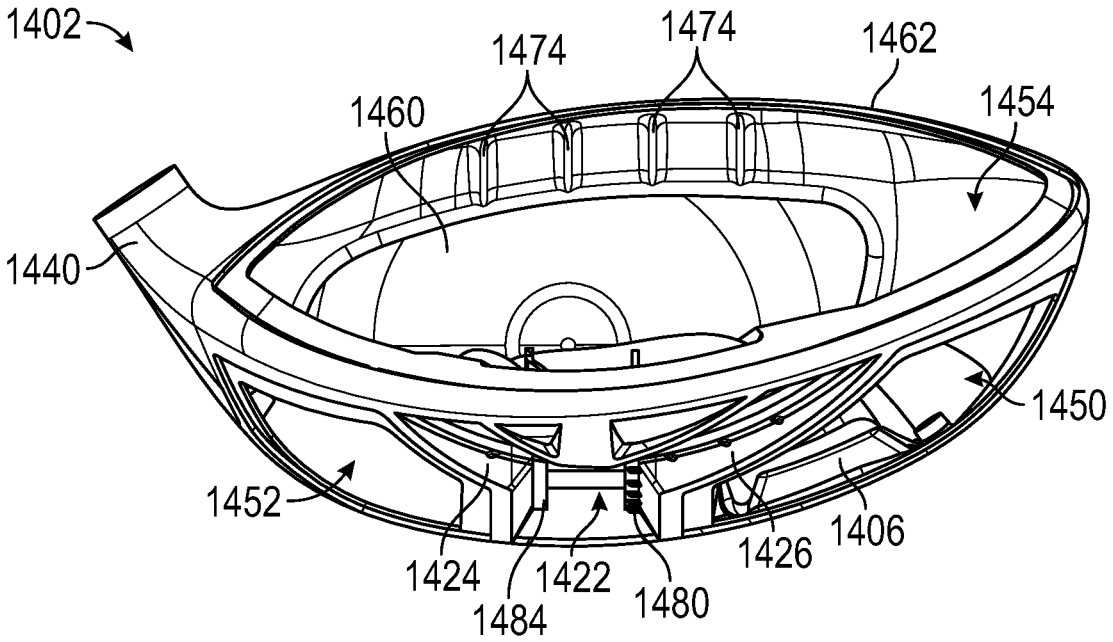
FIG. 56 is a rear view of the club head of FIG. 48.
Figure 57:
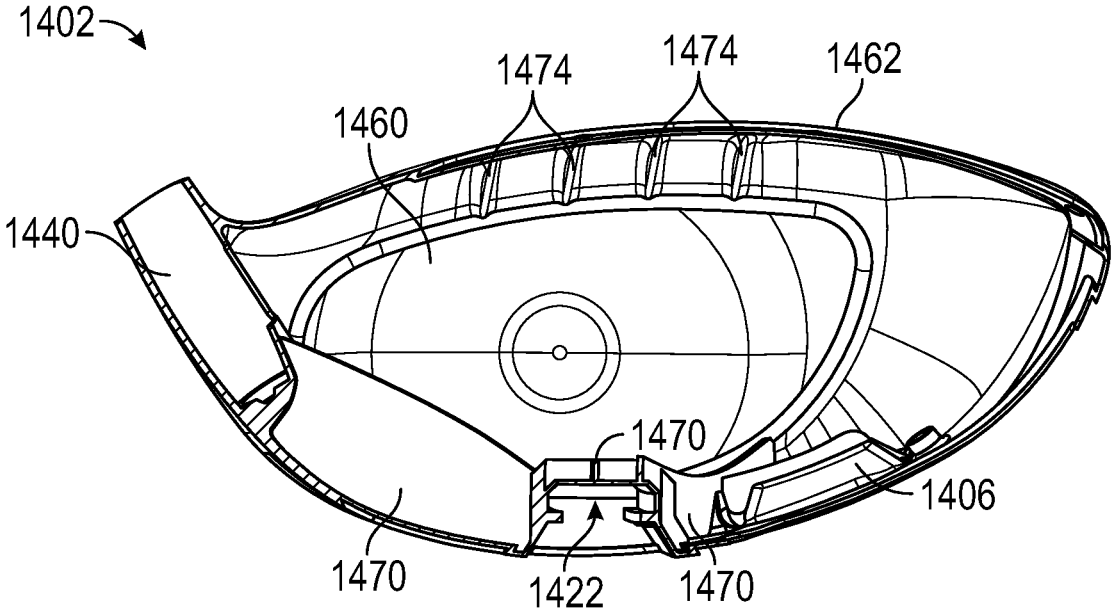
FIG. 57 is a cross-sectional view showing the inside of a forward portion of the body of the club head of FIG. 48.
Figure 58:
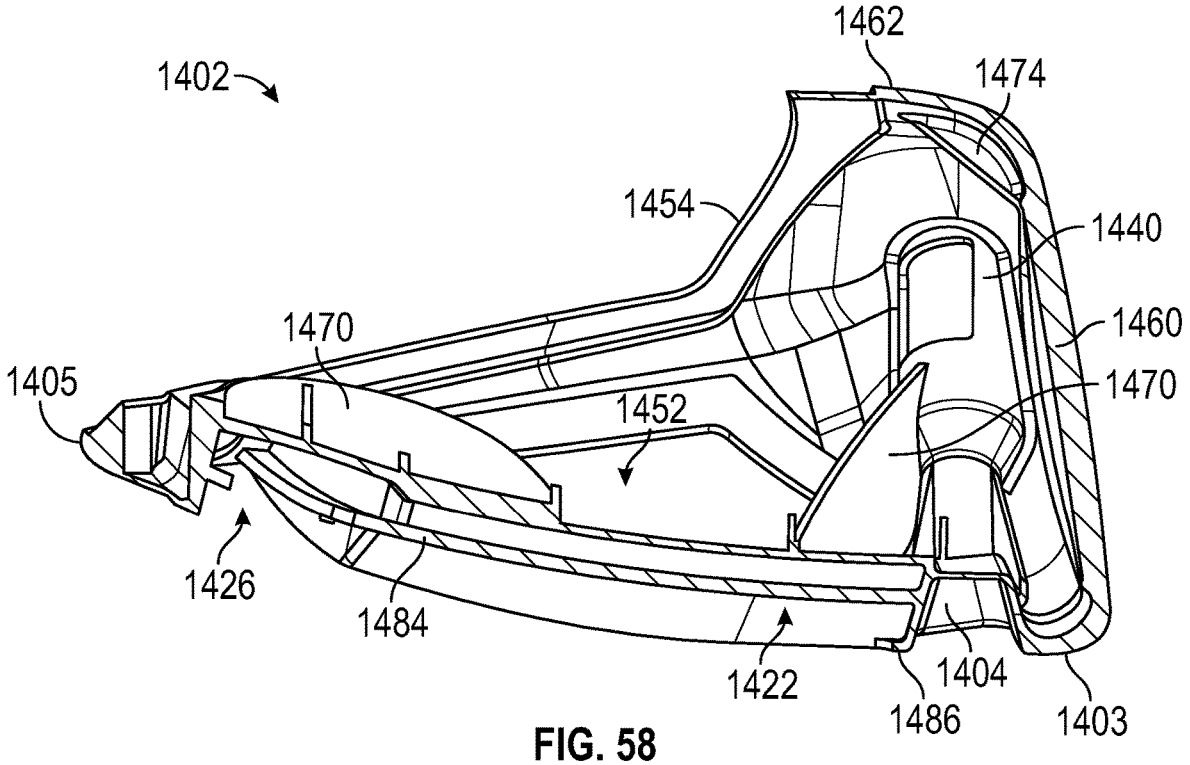
FIG. 58 is a cross-sectional view showing the inside of a heel-side portion of the body of the club head of FIG. 48.
Figure 59:
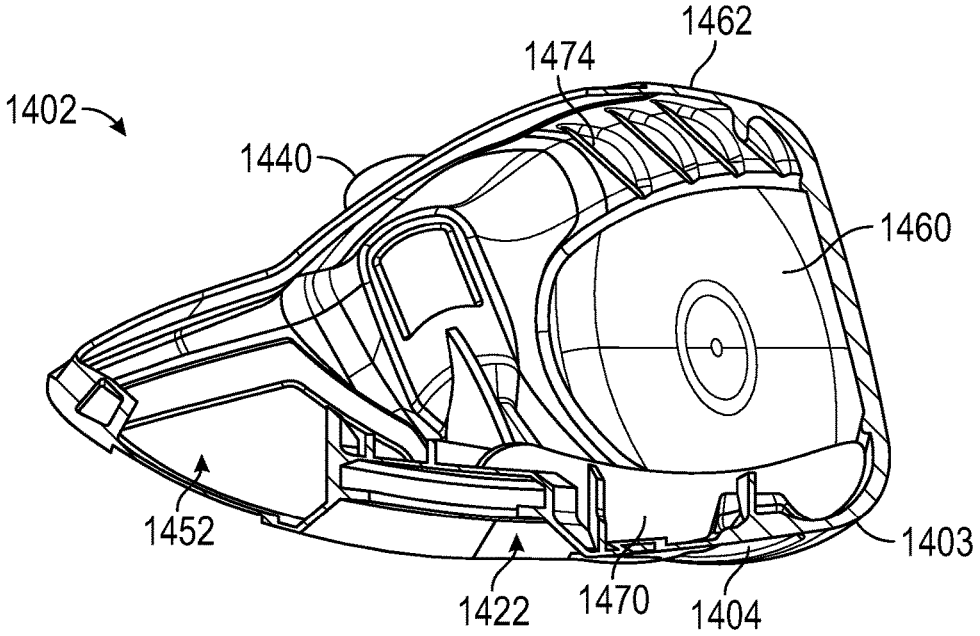
FIG. 59 is another cross-sectional view showing the inside of a heel-side portion of the body of the club head of FIG. 48.
Figure 60:
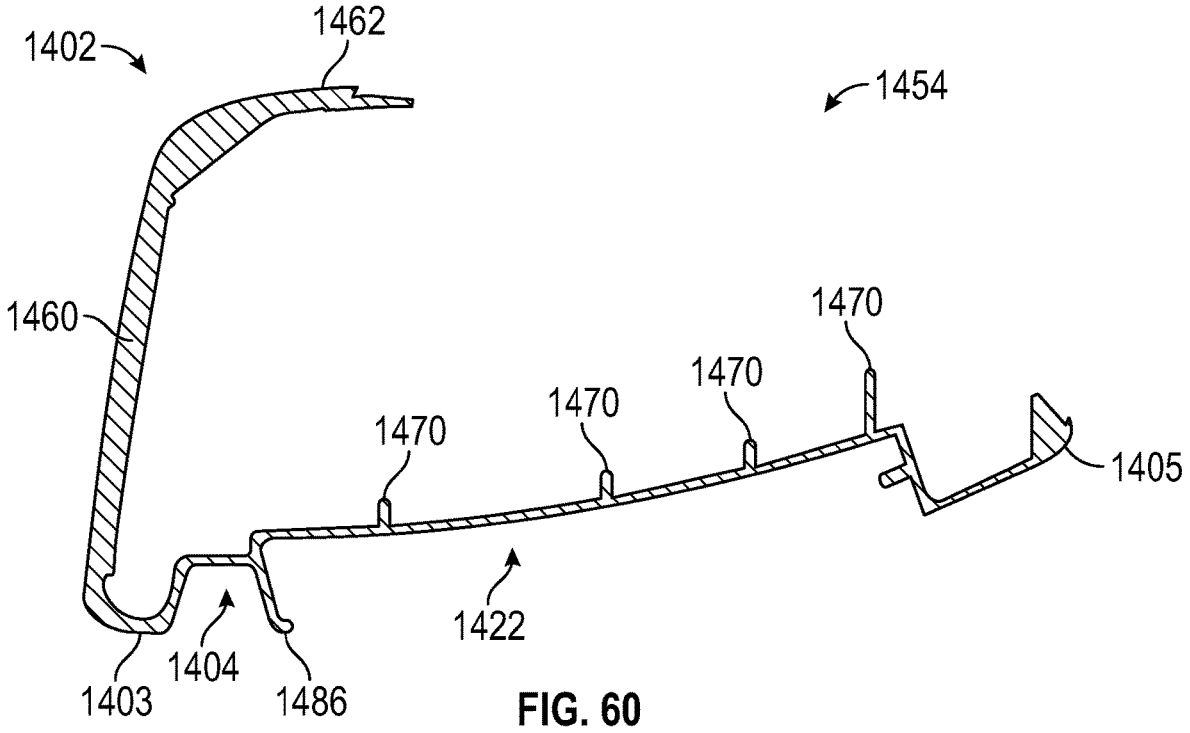
FIG. 60 is a cross-sectional view showing a thickness profile of the club head body along a vertical front-rear plane.
Figure 61:
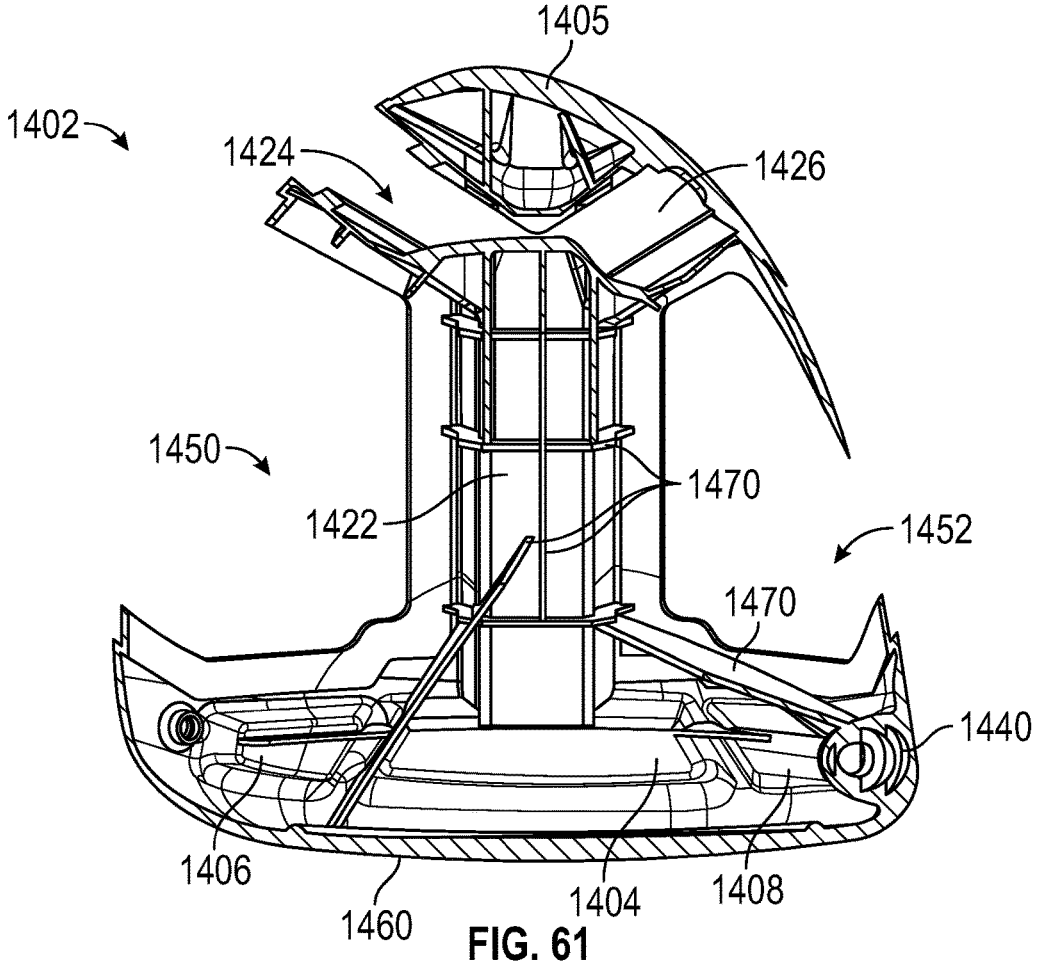
FIG. 61 is a cross-sectional view showing the inside of a bottom portion of the body of the club head of FIG. 48, looking down from above.
Figure 62:
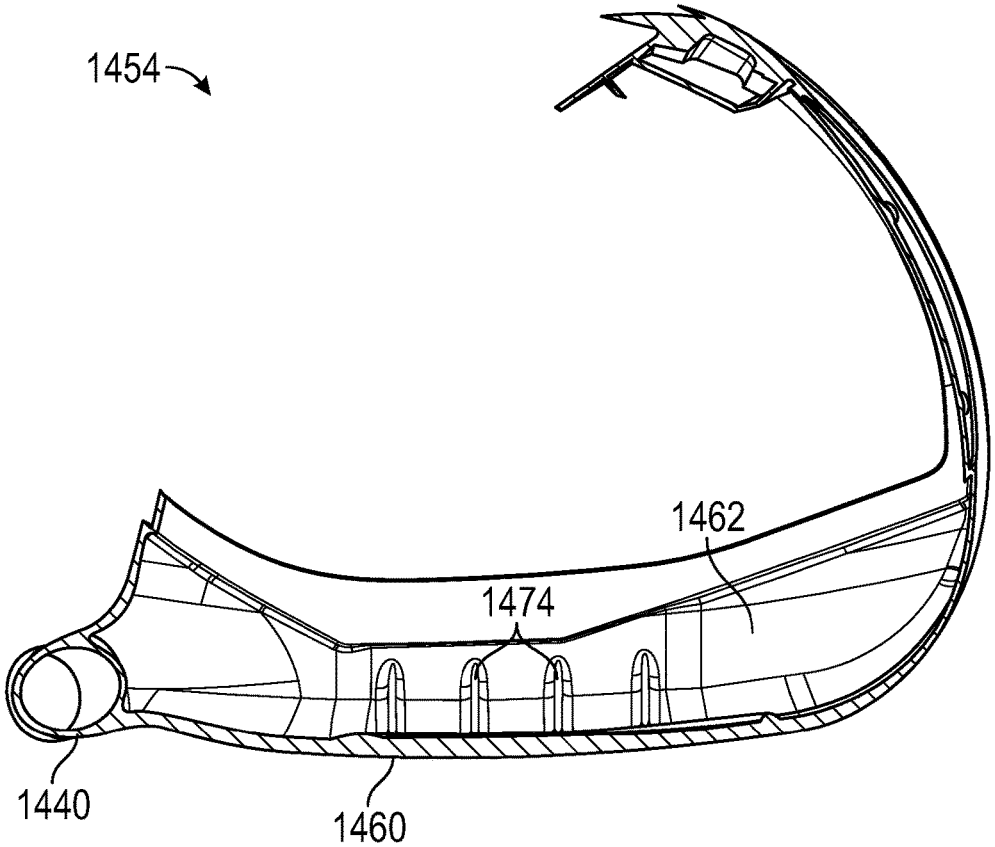
FIG. 62 is a cross-sectional view showing the inside of a top portion of the body of the club head of FIG. 48, looking up from below.
Figure 63:
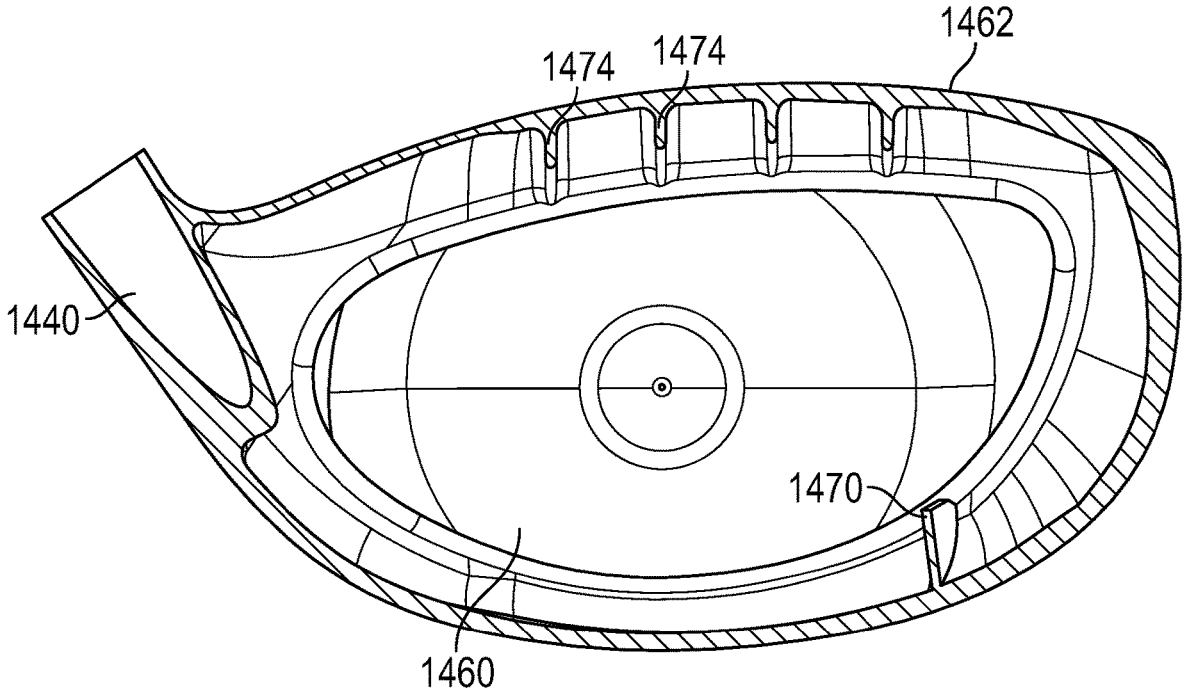
FIG. 63 is a cross-sectional view showing the inside of the front portion of the club head body from behind.
Figure 64:
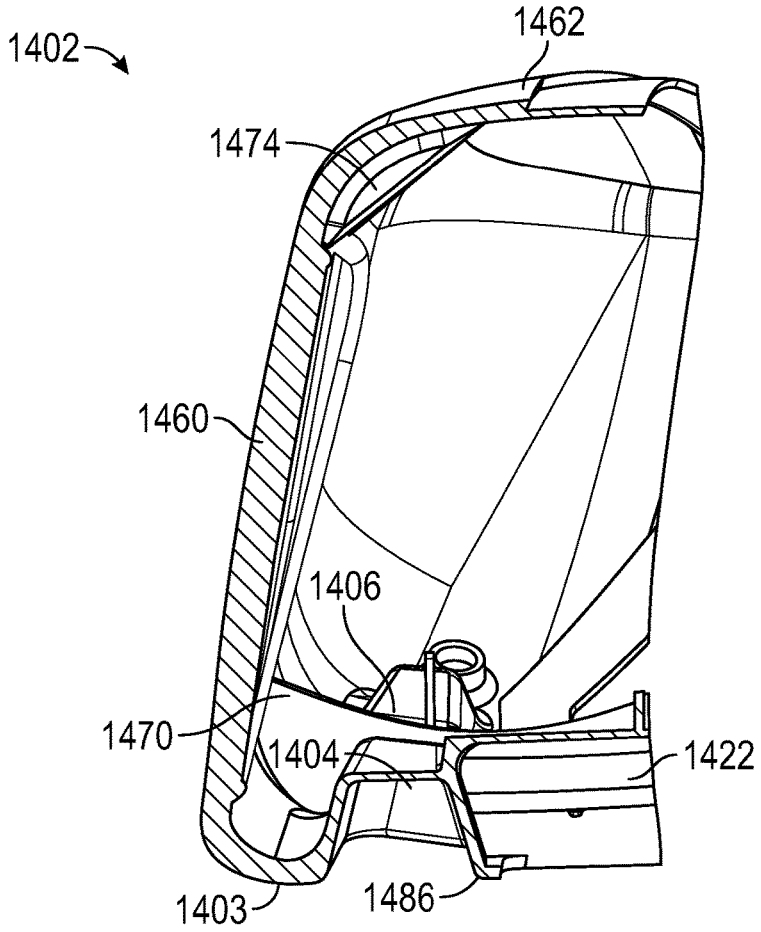
FIG. 64 is a cross-sectional view of a forward and toeward portion of the club head.
Figure 65:
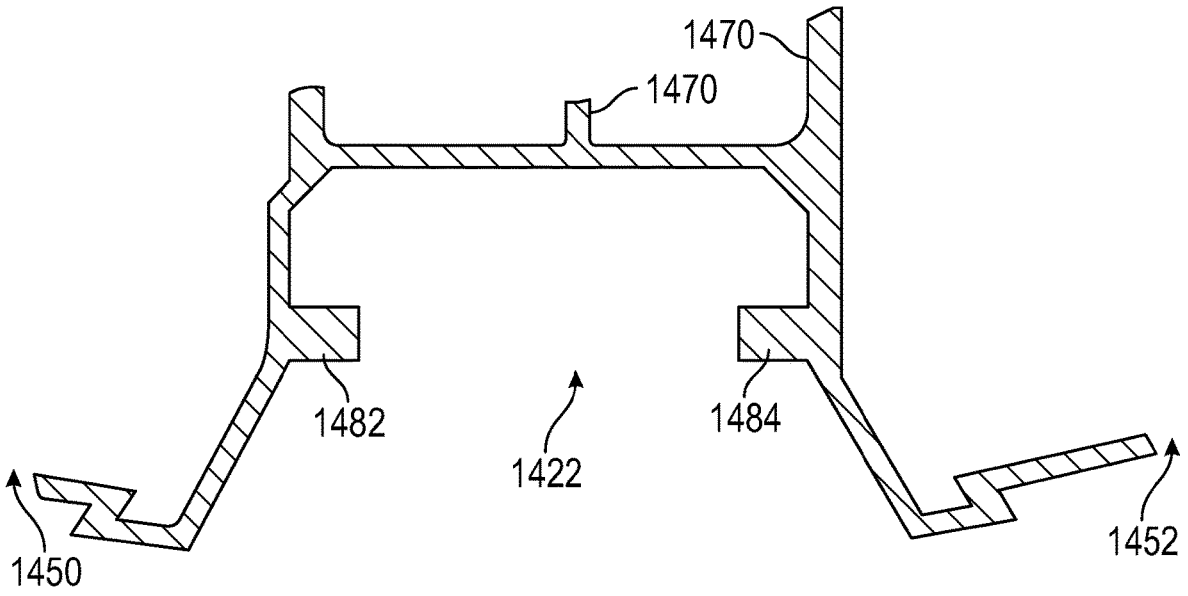
FIG. 65 is a cross-sectional view showing a side-to-side profile of the front-rear weight track.

However, when designers seek to maximize the above parameters it becomes difficult to stay within the volume limits and club head mass targets. Additionally, the sole curvature begins to flatten as these parameters are maximized. A flat sole curvature provides poor acoustics. To counteract this problem, designers may add a significant amount of ribs to the internal cavity to stiffen the overall structure and/or thicken the sole material to stiffen the overall structure. See for example FIGS. 55C and 55D and the corresponding text of U.S. Publication No. 2016/0001146 A1, published Jan. 7, 2016. This, however, wastes discretionary mass that could be put elsewhere to improve other properties like moment of inertia about the z-axis and x-axis.

As discussed above, a raised sole portion is counterintuitive because it raises the CG of the club head. However, the raised sole portion has a greater curvature resulting in increased rigidity and better acoustic properties due to the increased stiffness from the geometry, which means fewer ribs are needed to stiffen the overall structure. Fewer ribs results in more discretionary mass that can be used to increase moment of inertia about the z-axis and x-axis and/or incorporated into user adjustable movable weights.

Because the USGA fills any significant cavities in the sole or series of cavities which have a collective volume of greater than 15 $cm^3$, the designers have found when using the water displacement method of measuring volume it is best to target a volume less than 445 $cm^3$, and preferably less than 440 $cm^3$ to conform to the rules. Using the water displacement method of measuring volume without filling any cavities, in some embodiments a club head may have a volume between 380 $cm^3$ and 445 $cm^3$, such as between 420 $cm^3$ and 445 $cm^3$, such as between 430 $cm^3$ and 440 $cm^3$. Some golfers may prefer a smaller head size in which case the volume may range from 380 $cm^3$ and 425 $cm^3$, such as between 380 $cm^3$ and 420 $cm^3$, such as between 390 $cm^3$ and 410 $cm^3$.

The inventors found a good measure of a club heads overall forgiveness can be determined by applying the following equation:

Forgiveness ratio=(hosel axis to back dimension)* (face area)/(volume)

This forgiveness ratio leads to a dimensionless quantity when the hosel axis to back dimension is in mm, face area is in $mm^2$, and volume is in $mm^3$ . The hosel axis to back of club head dimension represents the distance between the rearward most portion of the club head and the club head hosel axis along the Y axis (in a direction. straight toward the hack of the body when the club head is in the address position). The face area is equivalent to the striking surface area or face size. See U.S. Pat. No. 8,012,038 for further information on measuring face size and address area, which is incorporated by reference herein in its entirety. As discussed above, volume is measured using the water displacement method without filling in any cavities.

The forgiveness ratio is preferably at least 0.915, such as at least 0.930, such as at least 0.945, such as at least 0.960, such as at least 0.965, such as at least 0.970, such as at least 0.975, such as at least 0.980, and such as at least 0.990.

For example, in one embodiment the club head volume is about 433 $cm^3$, face area is about 3944 $mm^2$, and the hosel to back length is about 100.9 mm yielding a forgiveness ratio of about 0.919. In another embodiment, the club head volume is about 436 $cm^3$, face area is about 4283 $mm^2$, and the hosel to back length is about 100.6 mm yielding a forgiveness ratio of about 0.988. In yet another embodiment, the club head volume is about 435 $cm^3$, face area is about 4461 $mm^2$, and the hosel to back length is about 103.9 mm yielding a forgiveness ratio of about 1.0655. The above are non-limiting examples and each of the parameters may be varied to achieve the various forgiveness ratios listed above.

Another measure of forgiveness of a club head are its moment of inertia about the z-axis and x-axis. Preferably, the moment of inertia about the z-axis is at least 350 kg-$mm^2$, such as at least 400 kg-$mm^2$, such as at least 450 kg-$mm^2$, such as at least 500 kg-$mm^2$. Preferably, the moment of inertia about the x-axis is at least 20 kg-$mm^2$, such as at least 270 kg-$mm^2$, such as at least 290 kg-$mm^2$, such as at least 300 kg-$mm^2$, such as at least 310 kg-$mm^2$. Preferably, the moment of inertia about the z-axis divided by the volume is greater than 0.99 kg/m, and more preferably greater than 1 kg/m.

A large moment of inertia about the hosel axis increases the resistance to closing the face of the golf club head during impact making it difficult to square the face at impact resulting in a right tendency. Accordingly, it is desirable to increase the moment of inertia about the z-axis without significantly increasing the moment of inertia about the hosel axis. Preferably, in some embodiments the moment of inertia about the hosel axis divided by the moment of inertia about the z-axis is less than 1.6, such as less than 1.59, such as less than 1.57, such as less than 1.55, such as less than 1.53, such as less than 1.51. For example, in one embodiment the club head volume is about 433 $cm^3$, face area is about 3944 $mm^2$, and the hosel to back length is about 100.9 mm, the moment of inertia about the z-axis is about 454 kg-$mm^2$, and the moment of inertia about the hosel axis is about 711 kg-$mm^2$ mm yielding a ratio of about 1.56. In another embodiment, the club head volume is about 436 $cm^3$, face area is about 4283 $mm^2$, the hosel to back length is about 100.6, the moment of inertia about the z-axis is about 502 kg-$mm^2$, and the moment of inertia about the hosel axis is about 749 kg-$mm^2$ mm yielding a ratio of about 1.49.

Importantly, as face area increases so does the overall mass of the club head, which is a deterrent to making golf club heads with a large area face. The inventors target a club head mass between 195 grams and 205 grams, and as face area is increased it becomes challenging to stay within this range so the inventors target a face area between 3900 $mm^2$ and 4600 $mm^2$. In the past, some designers have made large area faces out of non-metal composite material to save weight. However, non-metallic faces have several drawbacks that are challenging to overcome the first being the acoustics or sound and feel of the club head. A non-metal composite face does not ring the way a metal face does and as a result sounds muted compared to a metallic face, which fails to meet certain design metrics and is additionally unappealing to the golfer. A second problem with non-metallic faces is their ability to perform consistently in a variety of weather, such as wet weather. In wet weather, the ball tends knuckle ball off the face, which again fails to meet certain design metrics. A third problem is golfers typically mark their golf ball with a permanent marker and this permanent marker transfers to the face of the golf club during impact, but unfortunately is very difficult to remove from a non-metallic face without damaging the face. For at least the above reasons, the inventors chose to use a metallic face over a non-metallic face.

As discussed above, the inventors chose to use non-metallic materials in other areas of the club head, such as the crown and/or sole, instead of the face. This achieves weights savings without the issues described above. However, acoustics are still effected, but to a lesser degree because the crown and sole are not used to impact the golf ball.

Another important parameter that golf club head designers consider is Zup or the location of the center of gravity in the vertical axis (z-axis) direction from the ground plane to the CG when the club head is in the address position. For the embodiments described, Zup is preferably less 30 mm, such as less than 29 mm, such as less than 28 mm, such as less than 27 mm, such as less than 26 mm, such as less than 25 mm. Another parameter is Zup relative to half head height (Zup—(Head Height/2)) which is described in U.S. patent application Ser. No. 15/259,026, filed Sep. 7, 2016, which is incorporated by reference herein in its entirety. For the embodiments described, Zup—(Head Height/2) is preferably less than −4.0 mm, such as less than −4.5 mm, such as less than −5.0 mm, such as less than −5.5 mm, such as less than −6.0 mm, such as less than −6.5 mm, such as less than −7.0 mm.

Table 3 below contains additional data and ratios for the various club head embodiments disclosed herein. Club heads 200*a* and 200*b* correspond to two different versions of the club head 200 shown in FIGS. 20-36 having two different volumes (433 $cm^3$ and 406 $cm^3$).

TABLE 3

| | | | Club | Club Head 200a | | | | Club Head 200b | | | |
|---|---|---|---|---|---|---|---|---|---|---|---|
| | Units | Club Head 10 | Head 100 | Center Middle | Center Front | Center Back | Heel Back | Center Middle | Center-Front | Center-Back | Toe-Back |
| Club Head Mass: | g | 199.5 | 199.9 | 204.9 | 204.9 | 204.9 | 204.9 | 204.5 | 204.5 | 204.5 | 204.5 |
| Vol. | $cm^3$ | 436 | 435 | 433 | 433 | 433 | 433 | 406 | 406 | 406 | 406 |
| Zup | mm | 29 | 27.2 | 25.4 | 25.2 | 25.7 | 26 | 25.9 | 25.7 | 26.2 | 26.4 |
| Address Area | $cm^2$ | 122 | 127 | 123 | 123 | 123 | 123 | 112 | 112 | 112 | 112 |
| CGX: | mm | −0.42 | 0.2 | 0.9 | 0.9 | 0.9 | 2.9 | 0.8 | 0.8 | 0.8 | −1.2 |
| CGZ: | mm | −2.85 | −3.57 | −4.46 | −4.66 | −4.22 | −3.86 | −3.91 | −4.01 | −3.59 | −3.33 |
| CGY: | mm | 34.5 | 39.3 | 30.4 | 28.6 | 32.2 | 32.2 | 28.9 | 27.4 | 30.9 | 30.9 |
| Ixx: | kg-$mm^2$ | 337 | 403 | 258 | 243 | 296 | 293 | 237 | 224 | 273 | 270 |
| Iyy: | kg-$mm^2$ | 298 | 283 | 277 | 278 | 275 | 284 | 260 | 261 | 258 | 268 |
| Izz: | kg-$mm^2$ | 502 | 564 | 403 | 386 | 442 | 454 | 362 | 349 | 401 | 412 |
| I HOSEL AXIS: | kg-$mm^2$ | 749 | 896 | 666 | 637 | 719 | 711 | 575 | 553 | 626 | 650 |
| FACE AREA: | $mm^2$ | 4283 | 4461 | 3944 | 3944 | 3944 | 3944 | 3971 | 3971 | 3971 | 3971 |
| HEAD HEIGHT: | mm | 67.3 | 64.8 | 65.5 | 65.5 | 65.5 | 65.5 | 66.3 | 66.3 | 66.3 | 66.3 |
| HEAD LENGTH: | mm | 124 | 126 | 124 | 124 | 124 | 124 | 120 | 120 | 120 | 120 |
| HOSEL TO BACK LENGTH: | mm | 101 | 104 | 101 | 101 | 101 | 101 | 94 | 94 | 94 | 94 |
| For-giveness Ratio | N/A | 0.99 | 1.07 | 0.92 | 0.92 | 0.92 | 0.92 | 0.92 | 0.92 | 0.92 | 0.92 |
| Izz/vol | kg/m | 1.15 | 1.30 | 0.93 | 0.89 | 1.021 | 1.048 | 0.892 | 0.860 | 0.988 | 1.02 |
| Ixx/vol | kg/m | 0.773 | 0.926 | 0.596 | 0.561 | 0.684 | 0.677 | 0.584 | 0.552 | 0.672 | 0.665 |
| Zup − (Head Height/2) | mm | −4.7 | −5.2 | −7.4 | −7.6 | −7.1 | −6.8 | −7.3 | −7.5 | −7.0 | −6.8 |
| I HOSEL AXIS/Izz | N/A | 1.492 | 1.589 | 1.653 | 1.650 | 1.627 | 1.566 | 1.588 | 1.585 | 1.561 | 1.578 |

Club heads 200*a* and 200*b* are essentially the same club head just different volumes. Both Club heads 200*a* and 200*b* have front to back and heel to toe sliding weight tracks. The different parameters listed for club heads 200*a* and 200*b* are for different weight positions. The position of the weight in the heel to toe weight track is given first and the position of the weight in the front to back track is given second e.g. Center Back means the weight in the heel to toe sliding weight track is centered and the weight in the front to back sliding weight track is positioned in the back most or rearward position of the track. The values for various weight positions are provided to show the change in moment of inertia as well as the change in CGx, CGy, and CGz. Notably CGy may be adjusted by more than 3 mm, which has a significant impact on Izz, CG projection, and the amount of backspin imparted to the ball during impact.

Methods of making any of the golf club heads disclosed herein, or associated golf clubs, may include one or more of the following steps:

forming a frame having a sole opening, forming a composite laminate sole insert, injection molding a thermoplastic composite head component over the sole insert to create a sole insert unit, and joining the sole insert unit to the frame;

providing a composite head component which is a weight track capable of supporting one or more slidable weights;

forming the sole insert from a thermoplastic composite material having a matrix compatible for bonding with the weight track;

forming the sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof;

forming both the sole insert and weight track from thermoplastic composite materials having a compatible matrix;

forming the sole insert from a thermosetting material, coating the sole insert with a heat activated adhesive, and forming the weight track from a thermoplastic material capable of being injection molded over the sole insert after the coating step;

forming the frame from a material selected from the group consisting of titanium, one or more titanium alloys, aluminum, one or more aluminum alloys, steel, one or more steel alloys, and any combination thereof;

forming the frame with a crown opening, forming a crown insert from a composite laminate material, and joining the crown insert to the frame such that the crown insert overlies the crown opening;

selecting a composite head component from the group consisting of one or more ribs to reinforce the head, one or more ribs to tune acoustic properties of the head, one or more weight ports to receive a fixed weight in a sole portion of the club head, one or more weight tracks to receive a slidable weight, and combinations thereof;

forming the sole insert and crown insert from a continuous carbon fiber composite material;

forming the sole insert and crown insert by thermosetting using materials suitable for thermosetting, and coating the sole insert with a heat activated adhesive;

forming the frame from titanium, titanium alloy or a combination thereof and has a crown opening, and the sole insert and weight track are each formed from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and forming the frame with a crown opening, forming a crown insert from a thermoplastic composite material, and joining the crown insert to the frame such that it overlies the crown opening.

The bodies of the golf club heads disclosed herein, and optionally other components of the club heads as well, serve as frames and may be made from a variety of different types of suitable materials. In some embodiments, for example, the body and/or other head components can be made of a metal material such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The body may be formed by conventional casting, metal stamping or other known processes. The body also may be made of other metals as well as non-metals. The body can provide a framework or skeleton for the club head to strengthen the club head in areas of high stress caused by the golf ball's impact with the face, such as the transition region where the club head transitions from the face to the crown area, sole area and skirt area located between the sole and crown areas.

In some embodiments, the sole insert and/or crown insert of the club head may be made from a variety of composite materials and/or polymeric materials, such as from a thermoplastic material, preferably from a thermoplastic composite laminate material, and most preferably from a thermoplastic carbon composite laminate material. For example, the composite material may comprise an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42% to 57%) will suffice. The material weighs about 200 g/m$^2$.

Another similar exemplary material which may be used for the crown insert and/or sole insert is TEPEX® DYNALITE 208. This material also has a carbon fiber volume range of 42% to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming sole and crown inserts.

Once the crown insert and/or sole insert are formed (separately) by the thermoforming process just described, each is cooled and removed from the matched die. The sole and crown inserts are shown as having a uniform thickness, which lends itself well to the thermoforming process and ease of manufacture. However, the sole and crown inserts may have a variable thickness to strengthen select local areas of the insert by, for example, adding additional plies in select areas to enhance durability, acoustic or other properties in those areas.

As shown in FIGS. 36A-36D, the crown insert and/or sole insert can have a complex three-dimensional curvature corresponding generally to the crown and sole shapes of a driver-type club head and specifically to the design specifications and dimensions of the particular head designed by the manufacturer. It will be appreciated that other types of club heads, such as fairway wood-type clubs, may be manufactured using one or more of the principles, methods and materials described herein.

In an alternative embodiment, the sole insert and/or crown insert can be made by a process other than thermoforming, such as injection molding or thermosetting. In a thermoset process, the sole insert and/or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the sole (or crown) insert. Each insert is cooled and removed from its respective mold.

The carbon fiber reinforcement material for the thermoset sole/crown insert may be a carbon fiber known as "34-700" fiber, available from Grafil, Inc., of Sacramento, Calif., which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Exemplary epoxy resins for the prepreg plies used to form the thermoset crown and sole inserts are Newport 301 and 350 and are available from Newport Adhesives & Composites, Inc., of Irvine, Calif.

In one example, the prepreg sheets have a quasi-isotropic fiber reinforcement of 34-700 fiber having an areal weight of about 70 g/m$^2$ and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

Once the sole insert and crown insert are formed, they can be joined to the body in a manner that creates a strong integrated construction adapted to withstand normal stress, loading and wear and tear expected of commercial golf clubs. For example, the sole insert and crown insert each may be bonded to the frame using epoxy adhesive, with the crown insert seated in and overlying the crown opening and the sole insert seated in and overlying the sole opening. Alternative attachment methods include bolts, rivets, snap fit, adhesives, other known joining methods or any combination thereof.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-$SO_2$-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially significant polysulfones are:

a) polysulfone (PSU);

b) Polyethersulfone (PES also referred to as PESU); and c) Polyphenylene sulfoner (PPSU).

Particularly important and preferred aromatic polysulfones are those comprised of repeating units of the structure —$C_6H_4SO_2$—$C_6H_4$—O— where $C_6H_4$ represents an m- or p-phenylene structure. The polymer chain can also comprise repeating units such as —$C_6H_4$—, $C_6H_4$—O—, —$C_6H_4$-(lower-alkylene)—$C_6H_4$—O—, —$C_6H_4$—O—$C_6H_4$—O—, —$C_6H_4$—S—$C_6H_4$—O—, and other thermally stable substantially-aromatic difunctional groups known in the art of engineering thermoplastics. Also included are the so called modified polysulfones where the individual aromatic rings are further substituted in one or substituents including

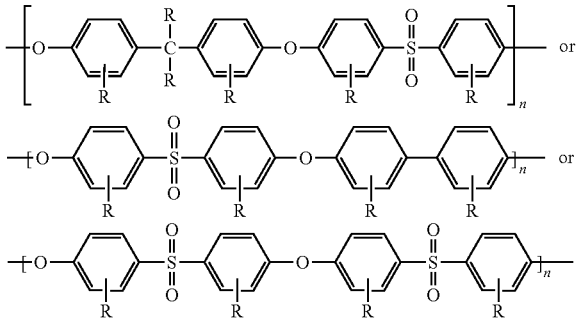

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a $C_1$-$C_{20}$ alkyl group, a $C_2$-$C_{20}$ alkenyl group, a $C_3$-$C_{20}$ cycloalkyl group, a $C_3$-$C_{20}$ cycloalkenyl group, and a $C_6$-$C_{20}$ aromatic hydrocarbon group. These hydrocarbon groups may be partly substituted by a halogen atom or atoms, or may be partly substituted by a polar group or groups other than the halogen atom or atoms. As specific examples of the $C_1$-$C_{20}$ alkyl group, there can be mentioned methyl, ethyl, propyl, isopropyl, amyl, hexyl, octyl, decyl and dodecyl groups. As specific examples of the $C_2$-$C_{20}$ alkenyl group, there can be mentioned propenyl, isopropepyl, butenyl, isobutenyl, pentenyland hexenyl groups. As specific examples of the $C_3$-$C_{20}$ cycloalkyl group, there can be mentionedcyclopentyl and cyclohexyl groups. As specific examples of the $C_3$-$C_{20}$ cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers, include, (a) the polysulfone made by condensation polymerization of bisphenol A and 4,4'-dichlorodiphenyl sulfone in the presence of base, and having the main repeating structure

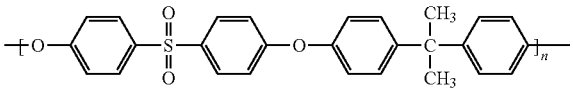

having the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

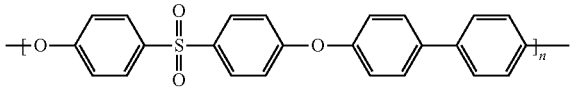

having the abbreviation PPSF and sold under the tradenames RADEL® resin; and (c) a condensation polymer made from 4,4'-dichlorodiphenyl sulfone in the presence of base and having the principle repeating structure

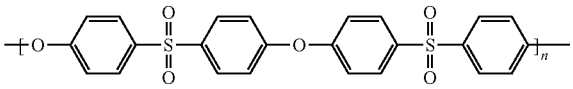

having the abbreviation PPSF and sometimes called a "polyether sulfone" and sold under the tradenames Ultrason® E, LNP™, Veradel®PESU, Sumikaexce, and VICTREX® resin, ".and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. Pat. Nos. 7,267,620; 7,140,974; and U.S. patent application Ser. Nos. 11/642,310, 11/825,138, 11/998,436, 11/895,195, 11/823,638, 12/004,386, 12,004,387, 11/960,609, 11/960,610, and 12/156,947, which are all incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

An example is a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Another examiner is a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Also an option is a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

The foregoing materials are well-suited for composite, polymer and insert components of the embodiments disclosed herein, as distinguished from components which preferably are made of metal or metal alloys.

More information regarding the various aspects of the disclosed technology can be found in the following references, which are incorporated by reference herein:

1. adjustable weight features—U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
2. slidable weight features—U.S. Pat. Nos. 7,775,905; 8,444,505; 8,734,271; 8,870,678; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No.

62/020,972, filed on Jul. 3, 2014; U.S. Patent Application No. 62/065,552, filed on Oct. 17, 2014; and Patent Application No. 62/141,160, filed on Mar. 31, 2015, the entire contents of each of which are hereby incorporated by reference herein in their entirety;

3. aerodynamic shape features—U.S. Patent Publication No. 2013/0123040A1, the entire contents of which is incorporated by reference herein in its entirety;
4. removable shaft features—U.S. Pat. No. 8,303,431, the contents of which are incorporated by reference herein in their entirety;
5. adjustable loft/lie features—U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety;
6. adjustable sole features—U.S. Pat. No. 8,337,319, U. S. Patent Publication Nos. U52011/0152000A1, US2011/0312437, US2012/0122601A1, and U.S. patent application Ser. No. 13/686,677, the entire contents of each of which are incorporated by reference herein in their entirety;
7. variable thickness face features—U.S. patent application Ser. No. 12/006,060, U.S. Pat. Nos. 6,997,820, 6,800,038, and 6,824,475, which are incorporated herein by reference in their entirety; and
8. composite face plate features—U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety.

Additional Embodiments and Features

Figure 38:
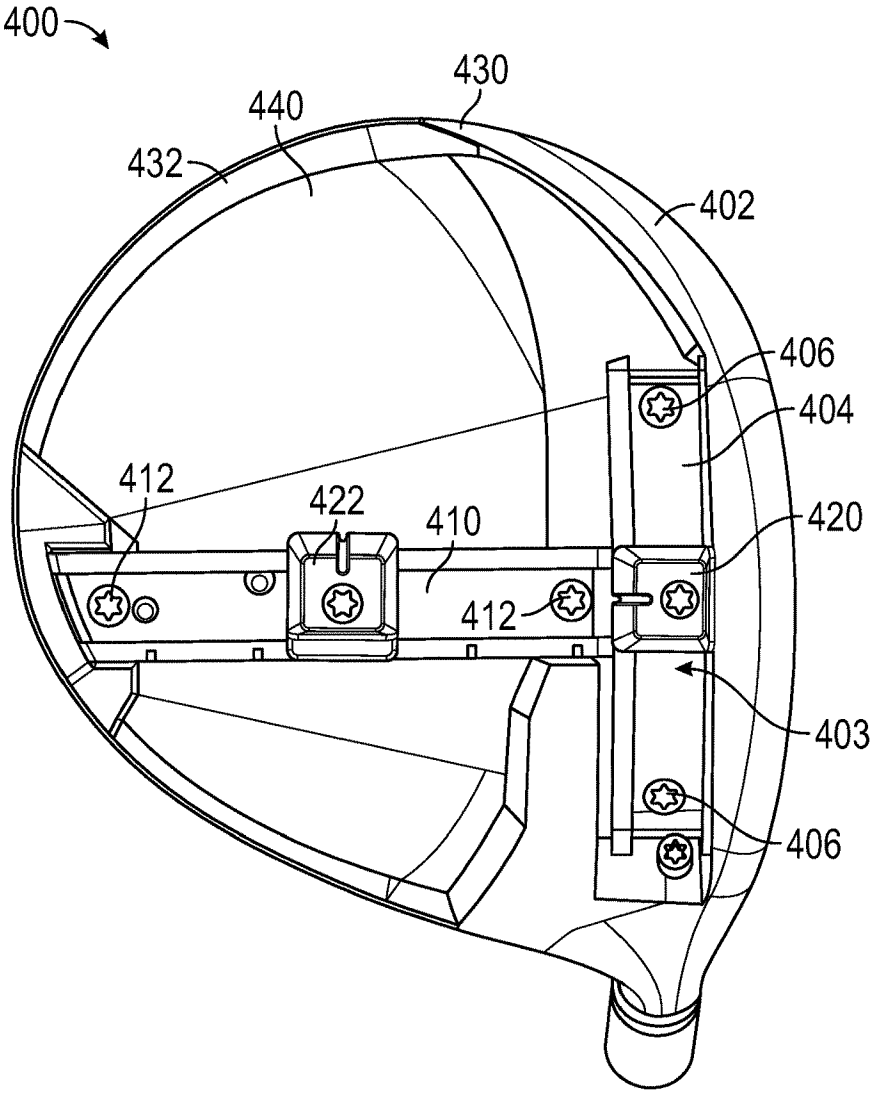
FIG. 38 is a bottom view of an exemplary club head having a detachable T-shaped weight track system.

FIG. 38 shows a bottom view of an exemplary golf club head 400 with a body 402 and a modular T-shaped track system 403 coupled to the sole of the body. The track system 403 can include a front track 404 extending in the heel-toe directions adjacent to the bottom of the striking face, and a rear track 410 extending in the fore-aft directions from near the middle of the front track back to adjacent the rear end of the body. The two tracks can be integrated together as a one-piece track system or can be two or more separate pieces that are individually attachable and detachable from the body. The weight track forms a T shape or Y shape, with a rearwardly extending track branch, a toewardly extending track branch, and a heelwardly extending track branch, defining three terminal ends. The track system 403 can support any number of weights, such as weights 420 and 422, that are slidably adjustable along the extent of the tracks.

The track system 403 can be attached to the body and detached from the body via fasteners, such as bolts 406 and 412, or by other attached mechanisms. If the track system is a multi-piece track system where the front track is not permanently integrated with the rear track, then the two tracks can be individually attached and detached to the body. For example, the front track can be attached to the body and the rear track can be detached from the body, or vice versa. The weights can remain coupled to the modular T-shaped track system when it is removed from the body and/or when it is attached to the body.

The track system 403 can optionally be removed from the body 402 and the club head can be used without the track system and weights. When the track system is removed, the fasteners 406 and 412 can optionally be inserted back into their holes.

In some embodiments, various different types of alternative modular track systems can be coupled to the body to provide different properties and/or adjustment abilities. In some embodiments, the track system can be removed and weight members can be fastened directly to the body using the same fasteners and openings in the body that were used to attached the track system. For example, a single weight can be coupled to the rear of the sole where the rear fastener of the rear track 410 is inserted, which can move the CG rearward and can increase the moment of inertia of the club head, making it more forgiving. For another example, a single weight can be coupled to the front of the sole using one of the forward fastener openings, which can move the CG forward and reduce backspin on struck balls, increasing distance. Individual weights can also be couple to the toe side or heel side fastener openings to generate side spin on struck balls, which can help correct a players natural slice or hook.

In some embodiments, the two tracks 404 and 410 can form a single continuous track, such that the weights mounted in the tracks 404 and 410 can slide along both tracks without detaching the weights from the tracks. For example, the front end of the rear track 410 can merge into an intermediate portion of the front track 404 so that a weight mounted in the rear track can slide forward into the front track and then be slid laterally along the front track, and vice versa.

Other types of components can also be attached to the body instead of the track system 403 using the same fasteners and openings in the body. For example, a smooth sole cover can be attached to the sole to provide a smooth, continuous lower surface for the club head and/or to provide improved aerodynamics or aesthetics.

The golf club head 400 can comprise multiple different materials to advantageously distribute mass and strength properties. The body 402 can comprise a stronger, more rigid material, such as titanium or steel (e.g., the darker grey colored portions in FIG. 38). Other components, such as the crown and sole insert 440 can comprise a low density material, such as carbon fiber composites or other composite materials. In some embodiments, the 50-60% of the sole can comprise a low density composite material (e.g., the lighter colored portions in FIG. 38). The club head can also include a sole with a raised sole portion (as is described elsewhere herein) with a cantilevered ledge, e.g. ledge 432, around portions of the sole perimeter. The body can also include an overhang portion 430 in the toe region that overlaps part of the sole and creates an external cavity.

The track system 403 can comprise various different materials, such as lightweight materials (e.g., aluminum, polymers, composites, etc.) or stronger materials (e.g., titanium, steel, etc.). The use of less dense, lighter weight material can allow mass savings that can be redistributed elsewhere, such as in the weights themselves. The use of stronger materials can help make the club head more rigid, resist damage from ground contact, and/or improve the sound characteristics of the club head.

Figure 39:
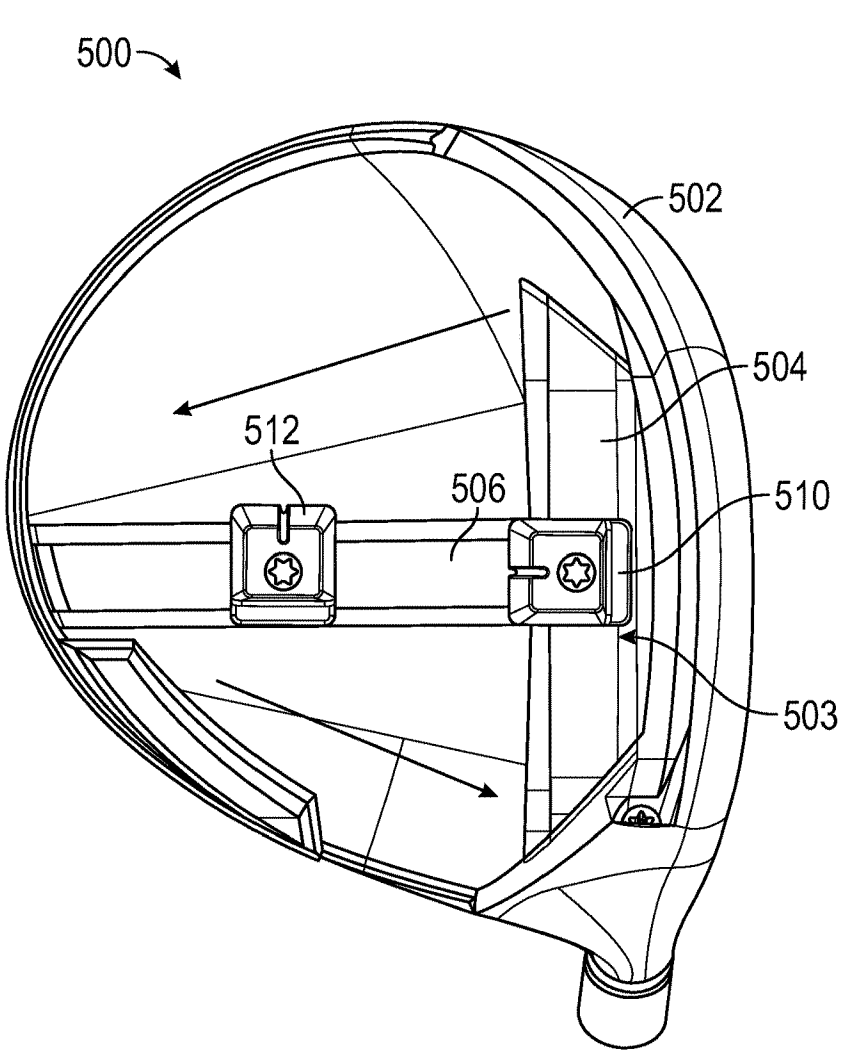
FIG. 39 is a bottom view of an exemplary club head having a T-shaped weight track system that can be flipped around 180 degrees.

FIG. 39 is a bottom view of an exemplary golf club head 500 that is similar to the club head 400. In the club head 500, a modular track system 503 is couplable and decoupleable to the body 502 using fasteners or other means, similar to as described with the club head 400. The track system 503 in the club head 500 includes front track 504 and rear track 506, with exemplary slidable weights 510 and 512 mounted in the tracks. The weight tracks form a T shape or Y shape, defining at least three track branches, and defining at least three terminal ends. However, in the club head 500, the track system 503 is configured to be rotated 180 degrees and attached to the body 502 in a reversed orientation, with the track 504 located in the rear of the club head. The track 504 can be curved in the heel-toe axis such that (in the illustrate configuration) the heel end and toe end arc slightly rearward and an intermediate portion of the track 504 is the most forward portion. The heel and toe ends of the track 504 can also be tapered or pointed, as shown, such that when the track system is turned around the ends of the track 504 follow better with the arced shape of the rear of the club head. The fastener openings included in the club head for attaching the track system can be arranged in a symmetric pattern so that they can be used in either the illustrated orientation or in the reversed orientation with the track 504 in the rear. Additional fastener openings may also be included in the rear toe portion and rear heel portion to accommodate the track system in the reversed orientation. The track system 503 of the club head 500 can also be detached and the club head used without the track system. Also, like as described with club head 400, individual weights, including smart weights, can be attached anywhere along the track system or directly to the sole of the club head with the track system removed. With the track system in the illustrated forward orientation, more mass can be located closer to the front of the club head, reducing back spin, and with the track system in the reversed orientation more mass can be located near the rear of the club head, increasing MOI and forgiveness.

Figure 40:
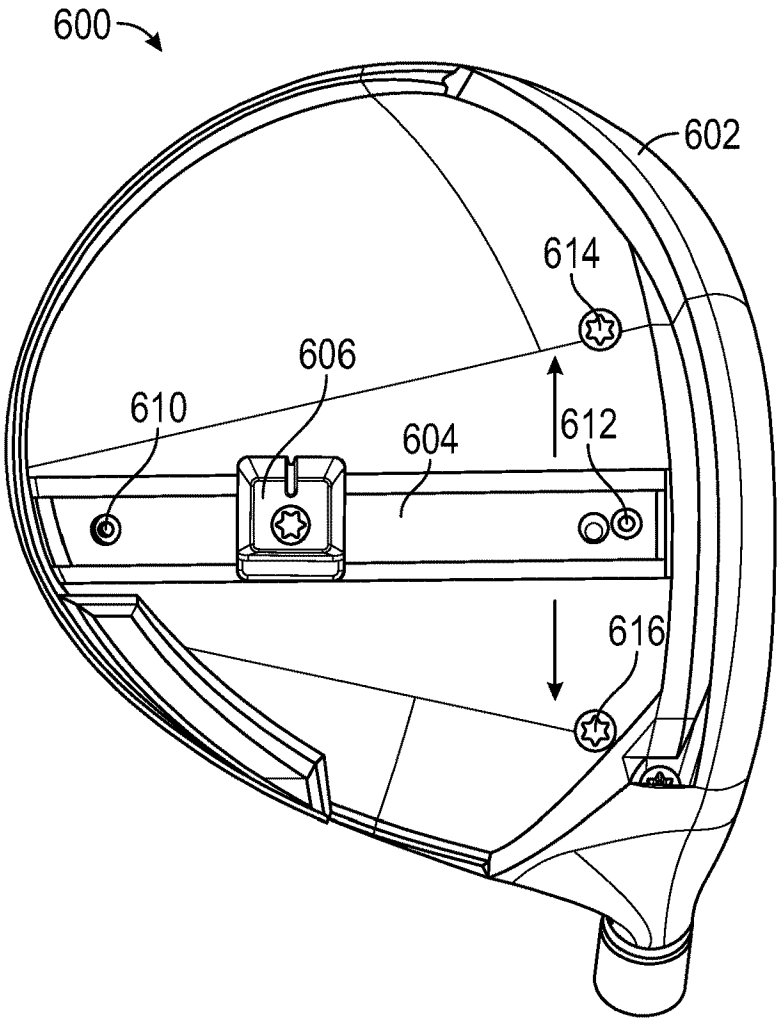
FIG. 40 is a bottom view of an exemplary club head having a pivoting weight track.

FIG. 40 illustrates a club head 600 having a body 602 and a weight track 604 adjustably coupled to the sole such that that it can pivot about a rear pin or fastener 610 and a front portions of the track can be coupled to the sole in plural different positions. As shown, the front end of the track can be coupled to the sole at an intermediate location 612, a toe side location 614, or a heel side location 616. This allows the track to pivot to three different position. In other embodiments, the track can pivot to two, four, five or more different positions about the rear pin or fastener 610. The rear of the track can have a rounded contour that allows the track to maintain a more consistent conformance with the rear of the body in any of the pivot positions. A single fastener can be used to fix the front end of the track in the desired one of the various possible pivot positions. In other embodiments, each position can have its own fastener. The track 604 can mount one or more slidable weights, such as the illustrated weight 606. Smart weights can also be included. The track can also be removed and the club head used without the track. Individual weights can also be attached to the sole without the track using the same fastener openings used for the track. With the track and/or weight positioned to the toe side, the GC can be moved toward, and with the track and/or weights positioned to the heel side, the GC can be moved heelward, effecting the side spin of a struck ball. The pivoting track as illustrated can also be reversed in other embodiments, with the front end of the track fixed with a pin or fastener, and the rear end of the track being adjustable to any of plural different heel-to-toe positions.

Figure 41:
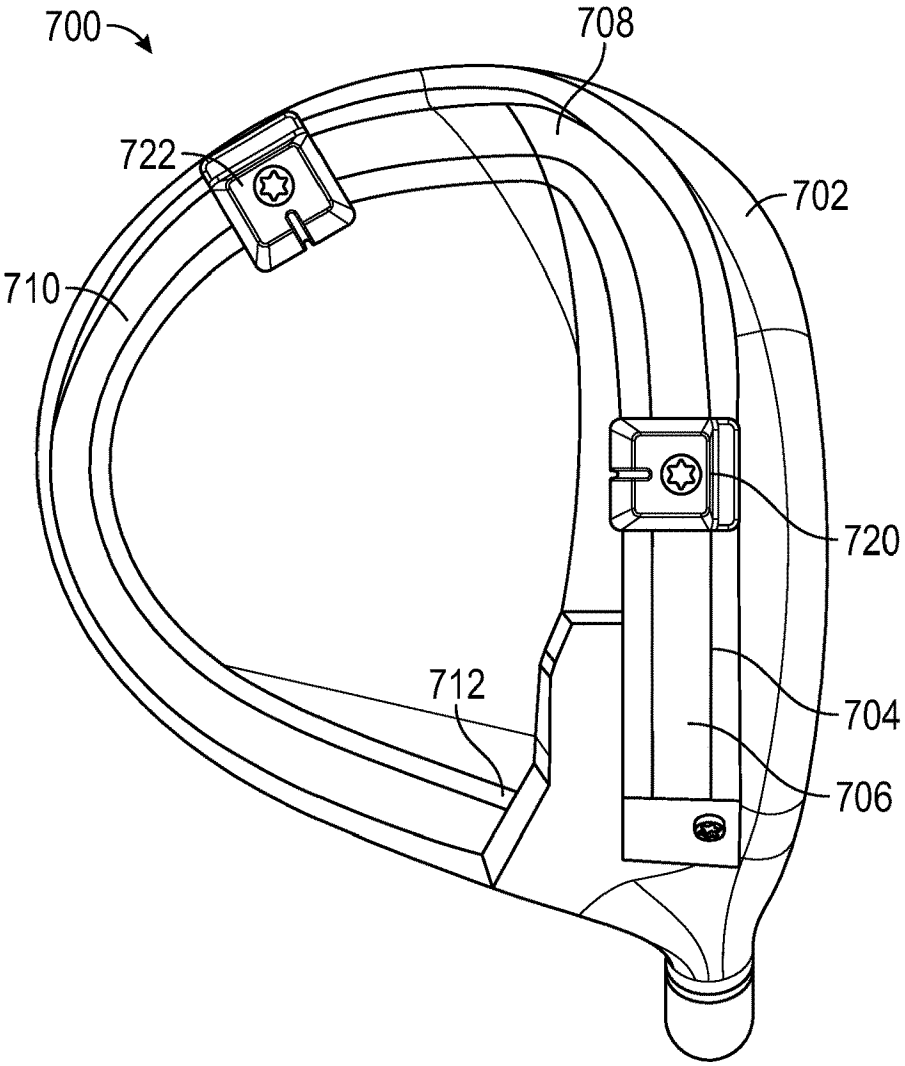
FIG. 41 is a bottom view of an exemplary club head having a weight track that extends around a majority of the perimeter of the sole.

FIG. 41 illustrates a club head 700 comprising a body 702 and a single continuous weight track 704 extending around the perimeter of the sole. The weight track 704 can comprise a cast titanium track, for example, or can be formed of other materials. The track 704 can extend in a full loop or in a partial loop as shown. In the illustrated embodiment, the track 704 includes a first end 704 at the front of the sole near the hosel. The track extends toeward across the front of the sole to a toe a point 708 at near the toe of the club head, then curves rearward around to the rear end 710 of the club head and then back around the heel side to a second end 712 near the hosel. Any type of weights 720, 722 can be mounted on the track, and more than one weight can be used at the same time at different points around the track. Because the track 704 extends around the perimeter of the sole, the position of the weights around the track strongly effect the CG and MOI of the club head.

In some embodiments, the track 704 can be fastened to the body using fastener bolts secured to a generic set of fastener openings in the sole of the club head, and the same set of generic fastener openings can receive alternative weight tracks have different shapes. The same for the track 604 of club head 600. For example, the club heads 600 and 700, according to one embodiment, can utilize a common club head body with a generic set of fastener openings in the sole, and a straight weight track 604 can be attached to form the club head 600 or a curved weight track 704 can be attached to form the club head 700.

Figure 42A:
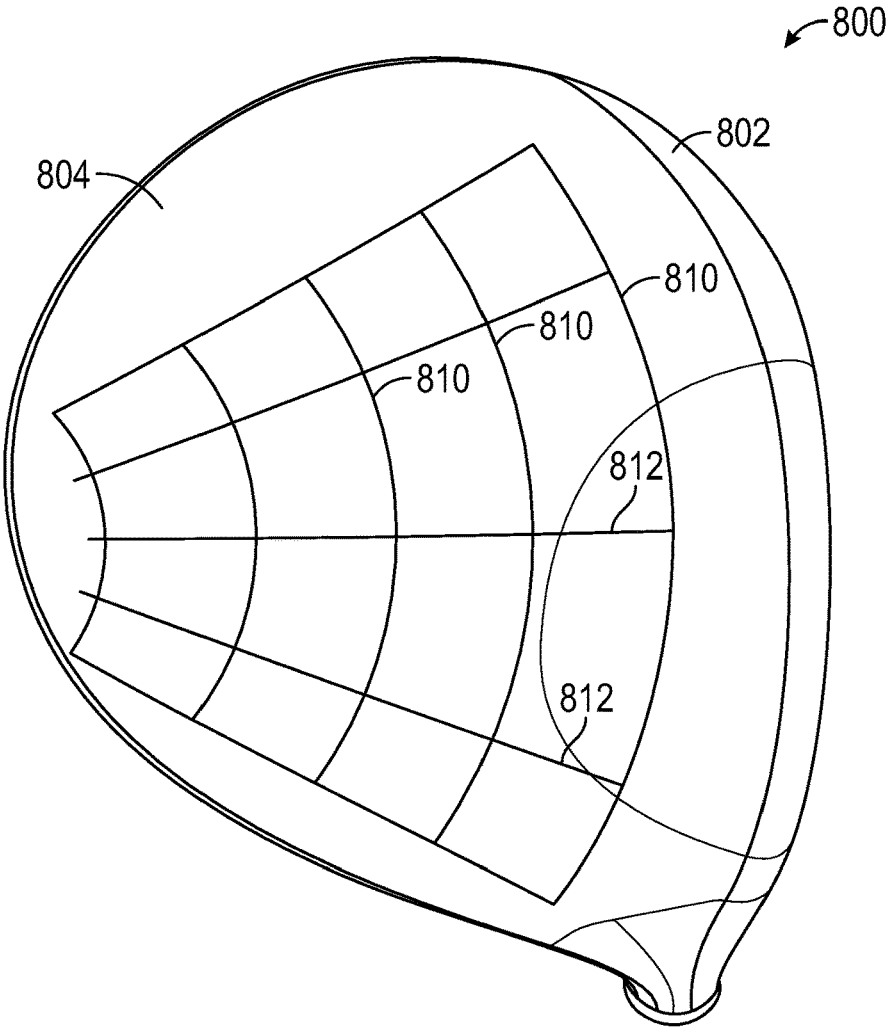
FIG. 42A is a bottom view of an exemplary club head having a grid shaped array of weight attachment locations.
Figure 42B:
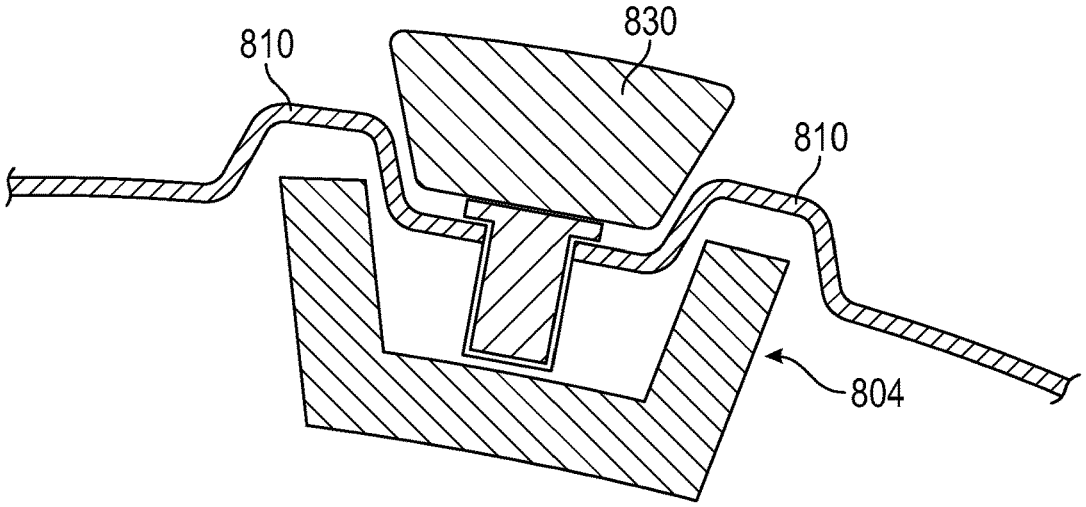
FIG. 42B is a cross-sectional illustration showing a weight attachment recess between two ridges on the sole of the club head of FIG. 42A.

FIG. 42A illustrates a club head 800 that includes a body 802 and a composite sole 804 that covers a large fraction of the bottom of the club head. The sole 804 can include a "waffle" grid structure comprised of a plural heel-to-toe ridges 810 and plural front-rear ridges 812 that intersect to form a grid structure with rectangular recesses between the ridges. Individual weights 830 can be selectively attached to the sole in the recesses between the ridges, as illustrated in FIG. 42B. Any number of weights can be attached to the sole at the same time, and any combination of the waffle grid recesses between the ridges.

Figure 43:
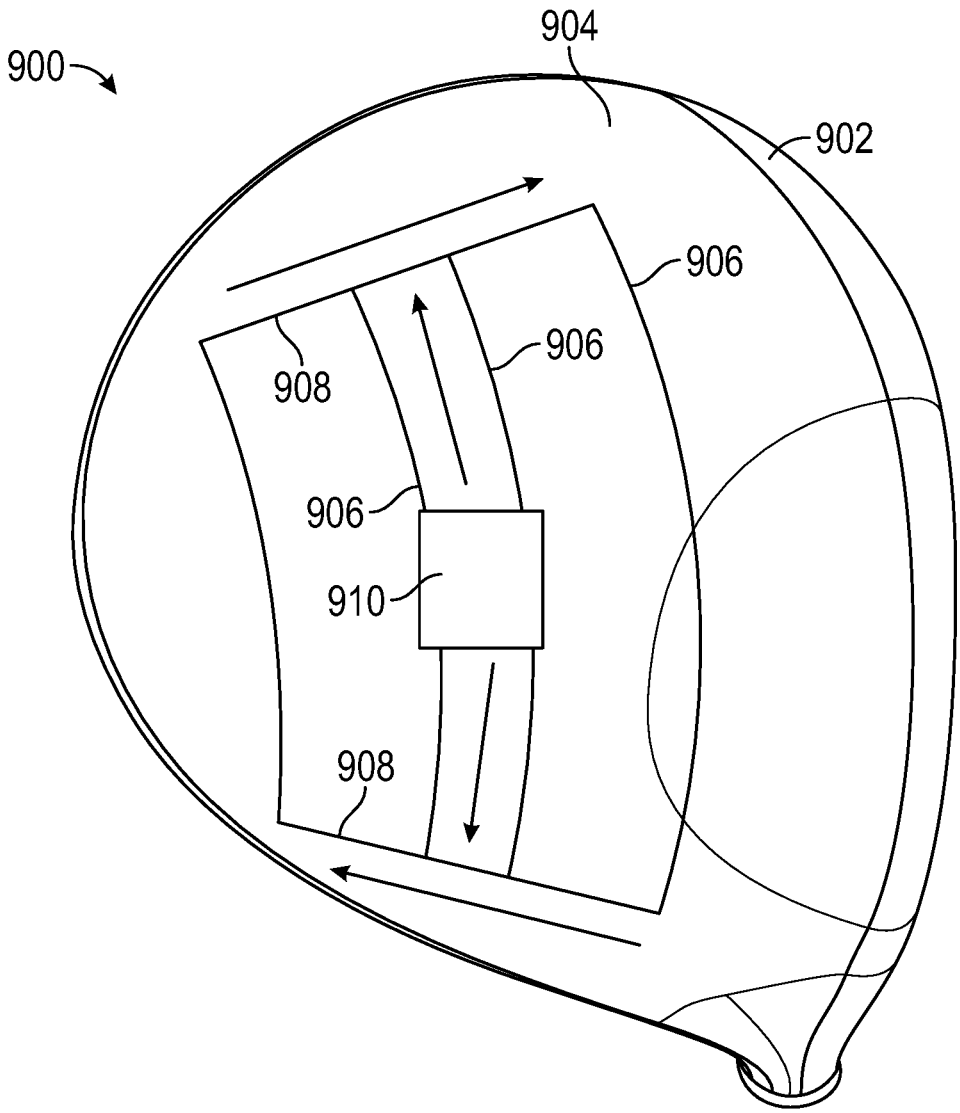
FIG. 43 is a bottom view of an exemplary club head having several attachment zones.

FIG. 43 illustrates another club head 900 comprising a body 902 and a composite sole 904. The sole 904 includes plural heel-to-toe ridges, or tracks, 906 extending between to end ridges 908, forming plural weights tracks formed between the ridges 906. Weights such as weight 910 can be attached in the desired weight tracks and can be slidable side to side between the end ridges 908 in the selected track.

Figure 44:
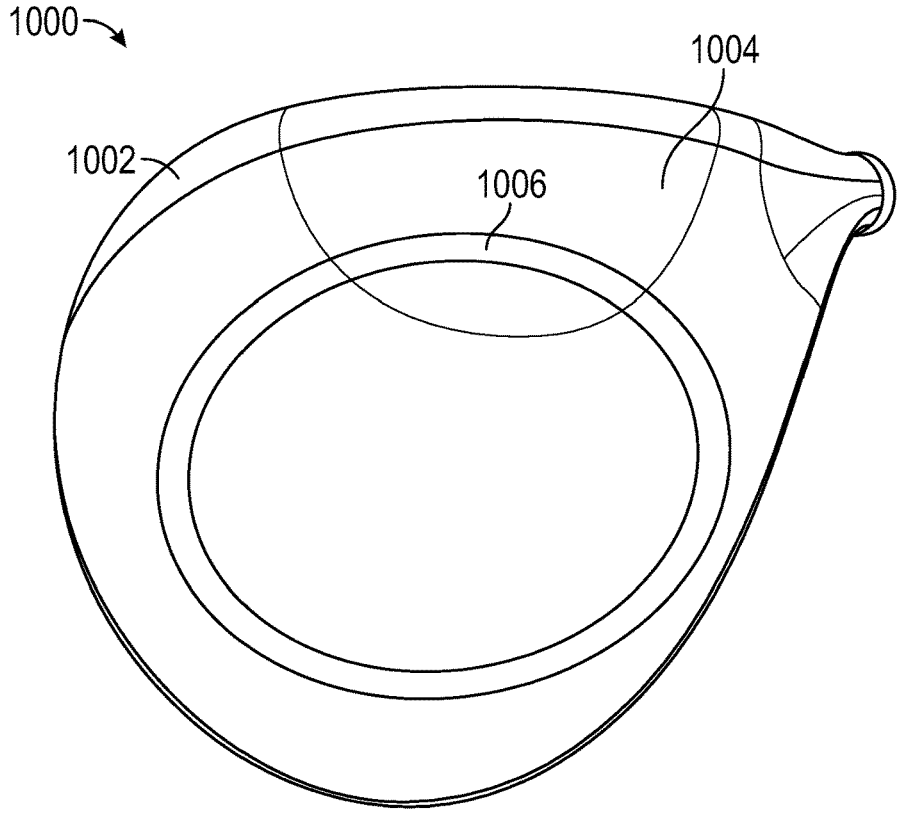
FIG. 44 is a bottom view of an exemplary club head having a circular or oval shaped weight track on the sole.

FIG. 44 illustrates another club head 1000 comprising a body 1002 and a sole 1004. The sole 1004 can include a continuous looped weight track 1006, and any number of weights can be attached to the track and can be adjusted to any points around the loop. The looped track 1006 can form a circle, oval, or other shape. The weight track 1006 can be formed in a more rigid portion of the club head and can be covered by an overlying composite sole cover that hides the weight track and weights. In some embodiments, the sole cover can include a groove or slot over the track that allows a user to insert a tool through the cover to access the weight fasteners, in order to adjust the position of the weights without removing the sole cover.

Figure 45:
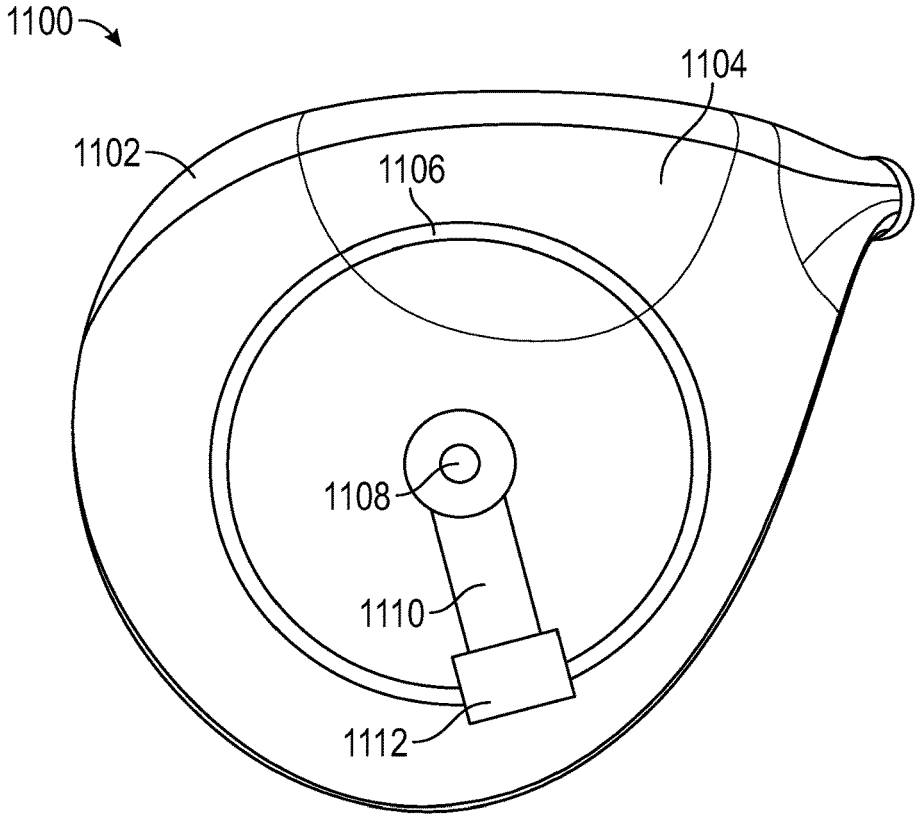
FIG. 45 is a bottom view of an exemplary club head having a weight arm that pivots around in a circular path on the sole.

FIG. 45 illustrates a club head 1100 comprising a body 1102 and a sole 1104. The sole 1104 can includes a continuous circular weight track 1106 and a pivoting weight arm 1110. The weight arm can include a base 1108 pivotably coupled to the sole and a weight 1112 at the radial end of the arm, such that the weight 1112 can move in the circular weight track 1106 about the pivot point 1108. More than one weight arm can be included with a common pivot point in some embodiments. The track and weight arm can be covered by a composite sole cover that overlies the sole and hides the weight arm. The sole cover can include a groove or slot over the track that allows a user to insert a tool through the cover to access a weight fastener, in order to adjust the position of the weight arm without removing the sole cover.

Figure 46:
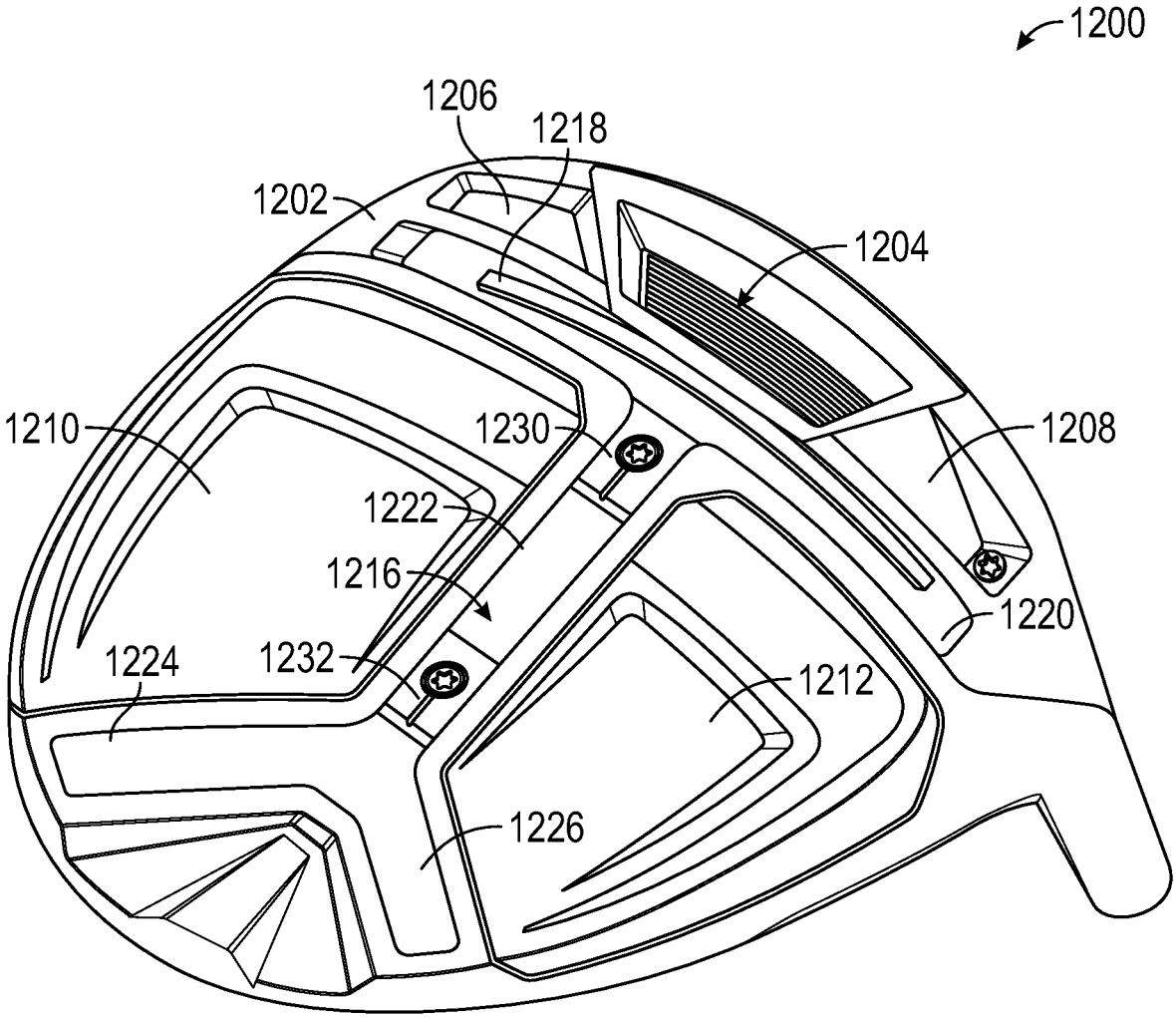
FIG. 46 is a bottom view of an exemplary club head having a continuous weight track system on the sole, with toe and heel front branches and toe and heel rear branches, where the weights can slide about all the track branches without removing them from the club head.

FIG. 46 illustrates an exemplary golf club head 1200. The head 1200 comprises a body 1202 made of a relative more rigid material that forms a main structural support for the club head. The club head also includes lighter weight components, such as sole inserts 1210 and 1212 and/or a crown insert. The body can include openings in the sole that receive the sole inserts 1210, 1212. The sole inserts can be elevated crownward relative to other parts of the sole around the inserts. The sole inserts can be mounted/inserted to the body from the outside of the body (e.g., from below the sole) or from the inside of the body (e.g., through an upper crown opening and down onto the inside of the sole). The club head 1200 also include a single, multi-branched weight track system 1216 that includes a front-toe branch 1218, a front-heel branch 1210, an intermediate front-rear branch 1222, a rear-toe branch 1224, and a rear-heel branch 1226. Weights, such as weights 1230 and 1232 shown, can slide about all of the weight track branches without being removed. The weight track system 1216 can include outer ledges that overhang the weights to provide a smoother, more aerodynamic exterior surface to the sole, and reduce the amount of dirt and debris that gets into the weight tracks. Placing the weights nearer to the front track branches can reduce backspin and create a lower trajectory for more distance, and placing the weights nearer to the rear track branches can create more backspin and a higher trajectory, and also increase MOI for more forgiveness. Placing the weights nearer to the toe side tracks can generate more side spin to create a fade, and placing the weights nearer to the heel side tracks can generate more side spin in the opposite direction to create a draw. The various connected branches can form a generally H shaped or K shaped track system. In other embodiments, the weight track can have an X shape or a + shape with four branches all meeting at a common joining intersection, or a cross between X and H shapes with angled terminal branches and an intermediate connecting branch. The weight track includes five branches including four terminal track branches, each with a terminal end and a joining end, the joining ends joining with the intermediate front-rear branch 1222. As shown, the rear branches 1224, 1226 can be angled to extend rearward as they move apart from the intermediate branch 1222. The weight track system 1216 can extend partially around the sole openings that receive the sole inserts 1210, 1212. For example, the insert 1210 can be positioned between the branches 1218, 1222, and 1224, while the insert 1212 can be positioned between the branches 1220, 1222, and 1226. At the front of the sole, the club head can further include a sole channel with a toe end portion 1206, a sole end portion 1208, and an intermediate channel portion 1204. The intermediate channel portion 1204 can bounded on the toe and heel sides by rigid walls/supports forming transitions between the end portions 1206, 1208 and the intermediate portion. In some embodiments, as shown, the body can include a generally trapezoidal or rectangular wall structure around the intermediate channel 1204 at the bottom of the face, which can help increase the rigidity of the lower portion of the face despite the presence of the front channel in the sole. In some embodiments, the front sole channel can extend through the body into the interior cavity of the club head, or at least part of the channel, such as the intermediate portion 1204, can. The illustrated front channel 1204/1206/1208 and the associated structure at the lower front portion of the club head can provide many benefits and advantages, as discussed elsewhere herein, including helping to improve/optimize the contact time and coefficient of restitution when striking a golf ball, particularly below the center of the face. In one exemplary embodiment, this structure can provide a desirable contact time of about 242 microseconds and corresponding coefficient of restitution of about 0.824.

Figure 47A:
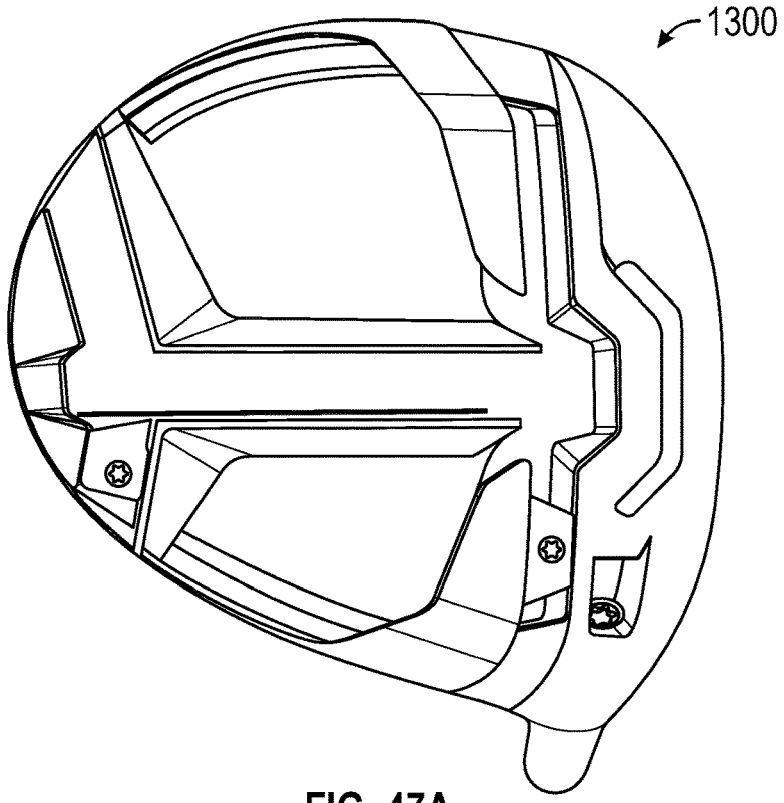
FIG. 47A and FIG. 47B are bottom views of another exemplary club head having a continuous weight track system on the sole, with toe and heel front branches and toe and heel rear branches, where the weights can slide about all the track branches without removing them from the club head.
Figure 47B:
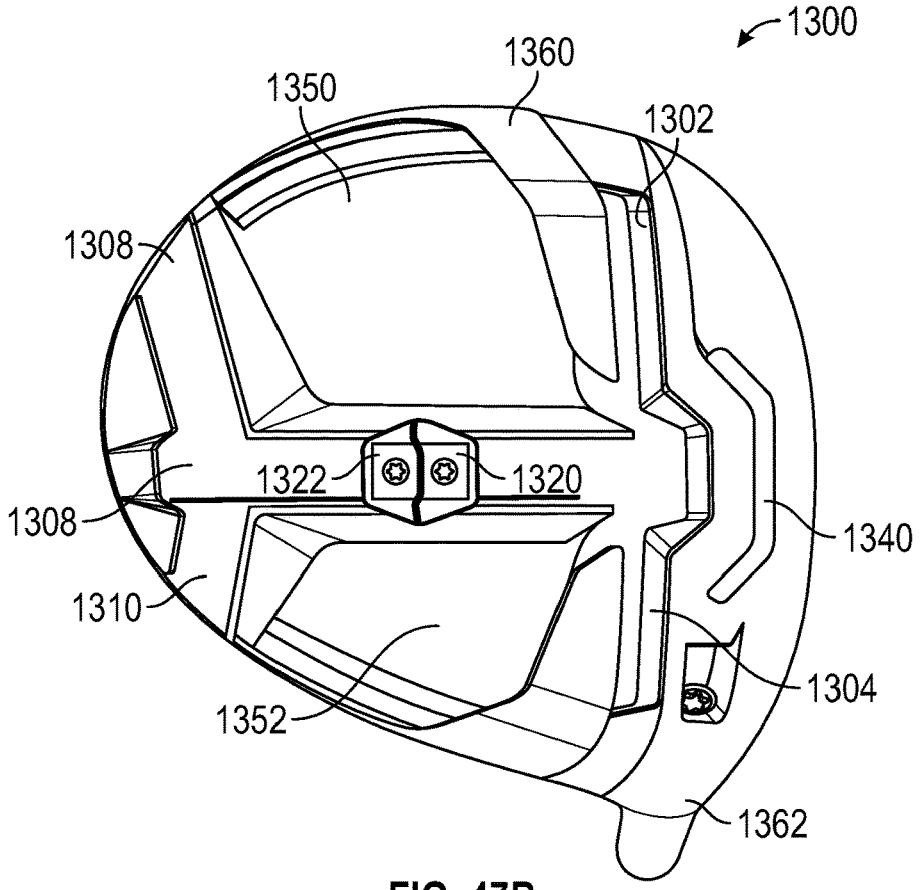
Figure 48:
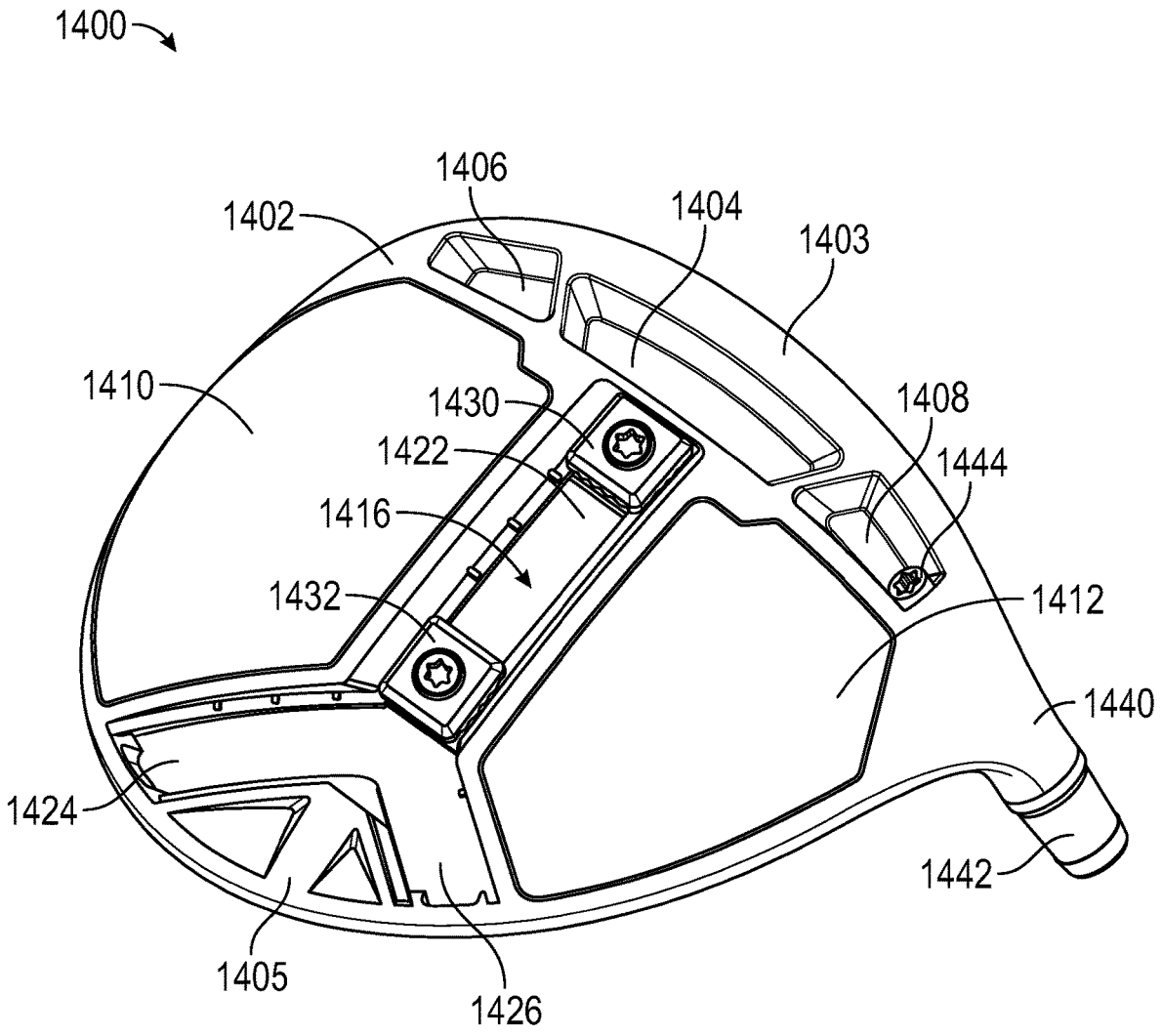
FIG. 48 is a bottom perspective view of another exemplary club head having a continuous Y-shaped weight track system on the sole, with a front-rear track portion and toe and heel rear track branches. The club head also includes a crown insert, a toe-side sole insert, and a heel-side sole insert, along with an adjustable head-shaft connection assembly.
Figure 49:
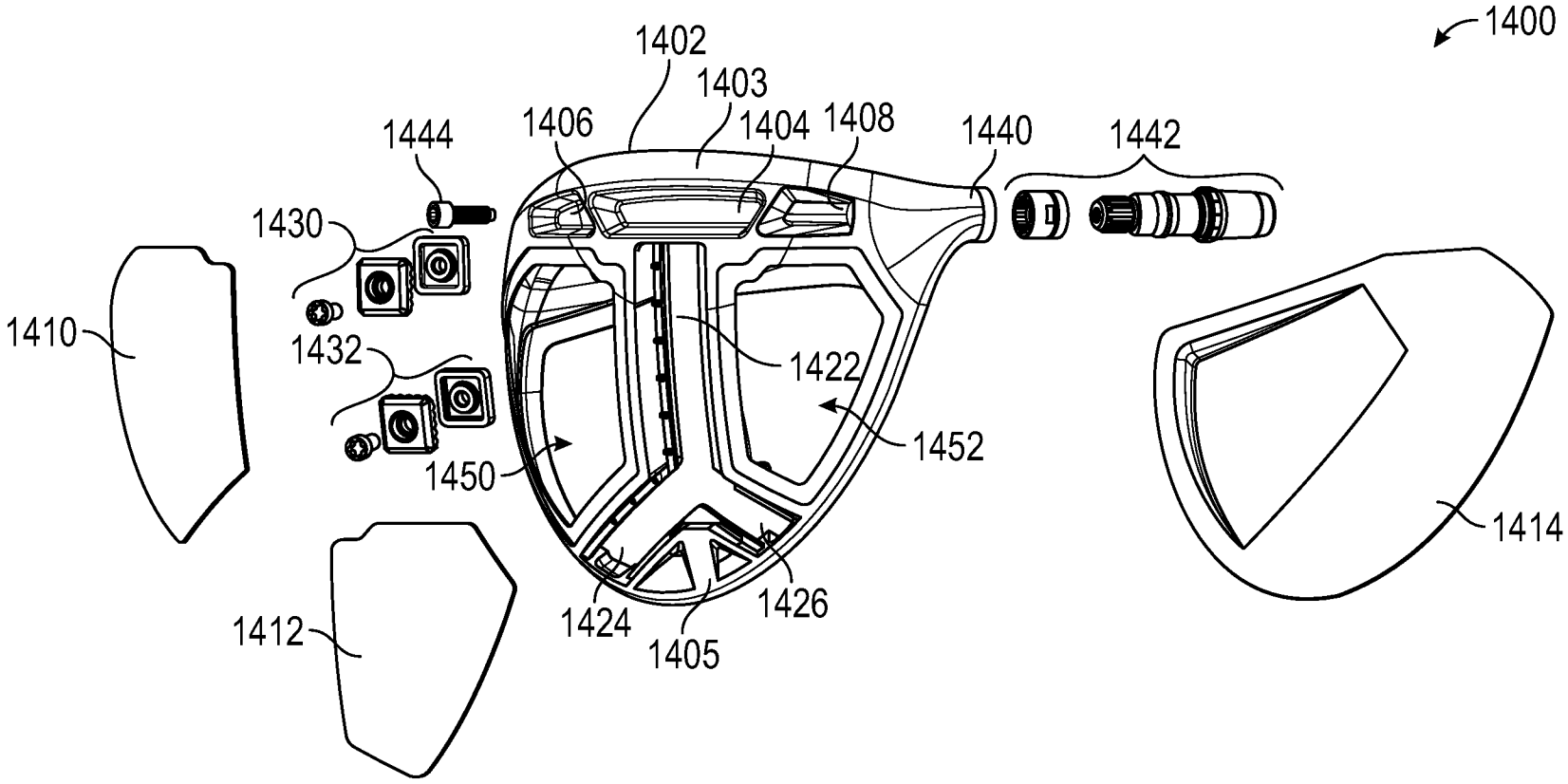
FIG. 49 is an exploded view of the club head of FIG. 48.
Figure 50:
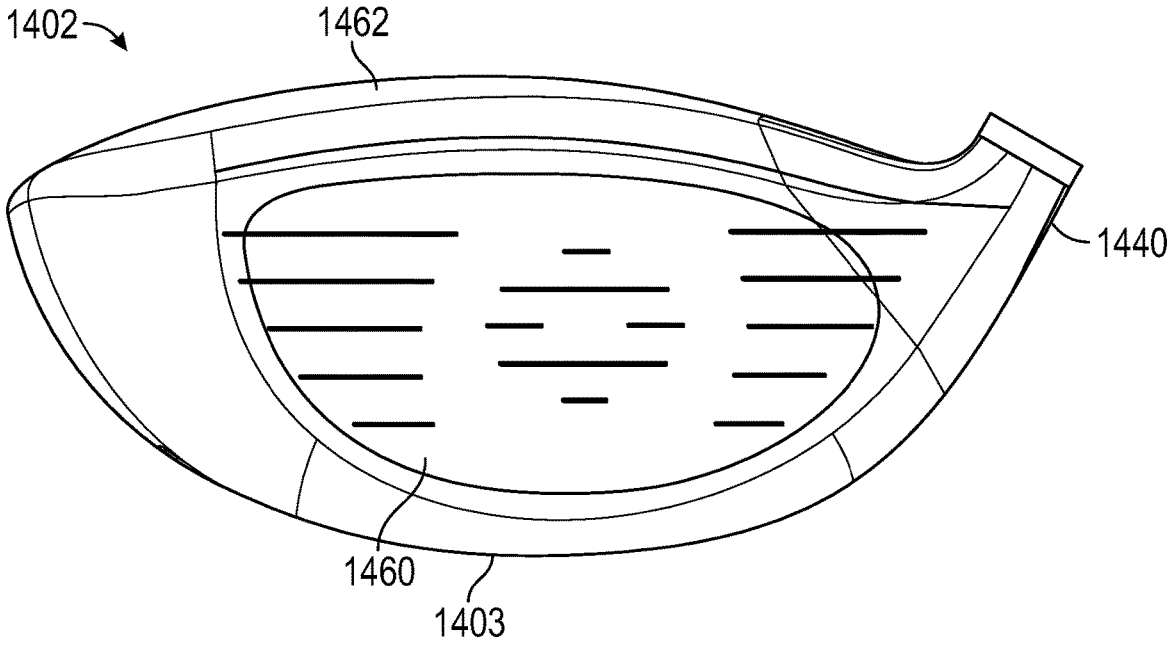
FIG. 50 is a front view of the body of the club head of FIG. 48.
Figure 51:
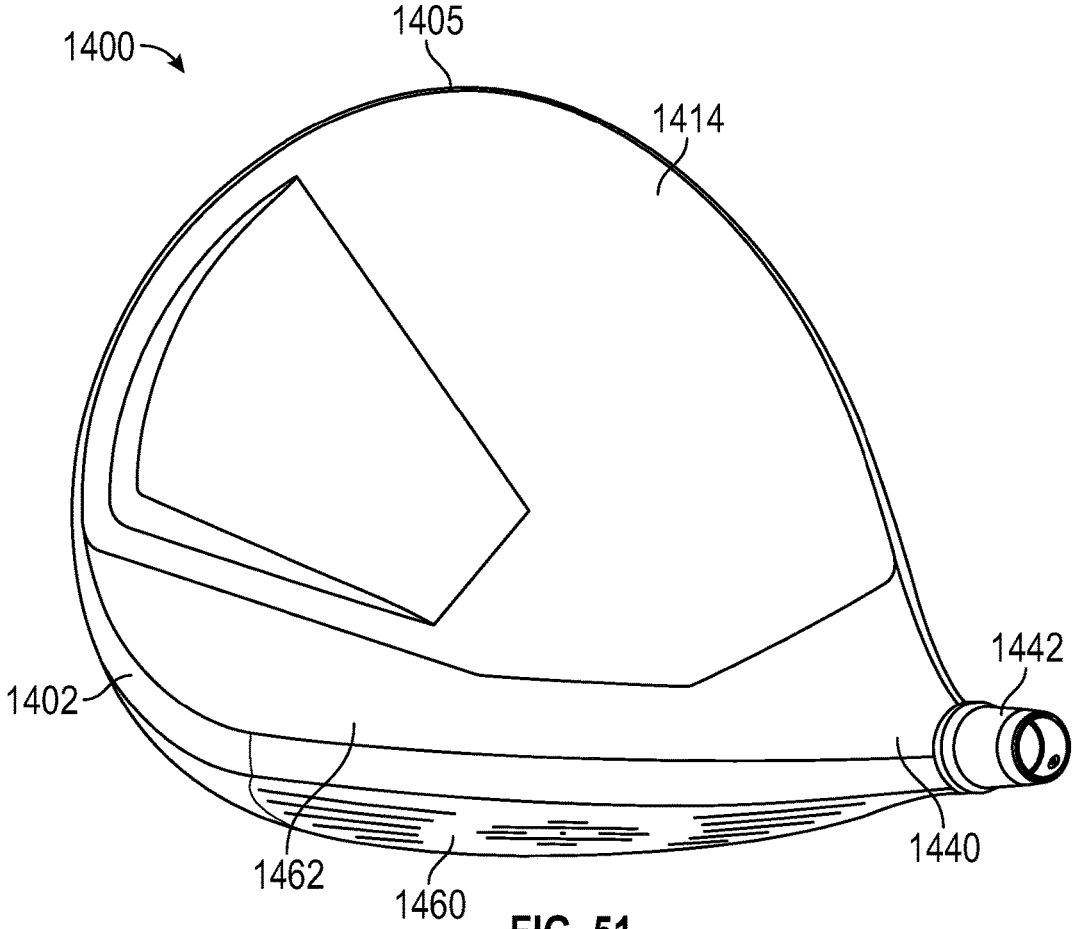
FIG. 51 is a top view of the club head of FIG. 48.

FIGS. 47A and 47B illustrate another golf club head 1300 that is similar to the club head 1200. The head 1300 comprises a body 1302 made of a relative more rigid material that forms a main structural support for the club head. The club head also includes lighter-weight components, such as sole inserts 1350 and 1352. The body can include openings in the sole that receive the sole inserts 1350, 1352. The sole inserts can be elevated crownward relative to other parts of the sole around the inserts. The sole inserts can be mounted/inserted to the body from the outside of the body (e.g., from below the sole) or from the inside of the body (e.g., through an upper crown opening and down onto the inside of the sole). The body can also include overhanging portions 1360 at the toe and/or heel areas that overhang the raised up sole inserts. The club head also includes a single, multi-branched weight track that includes a front-toe branch 1302, a front-heel branch 1304, an intermediate front-rear branch 1306, a rear-toe branch 1308, and a rear-heel branch 1310. Weights, such as weights 1320 and 1322 shown, can slide about all of the weight track branches without being removed. Placing the weights nearer to the front track branches can reduce backspin and create a lower trajectory for more distance, and placing the weights nearer to the rear track branches can create more backspin and a higher trajectory, and also increase MOI for more forgiveness. Placing the weights nearer to the toe side tracks can generate more side spin to create a fade, and placing the weights nearer to the heel side tracks (see FIG. 47A) can generate more side spin in the opposite direction to create a draw. Placing both of the weights in the middle of the sole (see FIG. 47B) can produce a neutral effect. The various connected branches can form a generally H shaped or K shaped track system. The weight track includes five track branches, include four terminal branches each having a terminal end and a joining end, the joining ends joining with the intermediate front-rear branch. At the front of the sole, the club head can further include a sole channel 1340 to provide increased forgiveness and performance for balls struck at the bottom of the face. In some embodiments, the front sole channel 1340 can extend through the body into the interior cavity of the club head.

FIGS. 48-82 illustrate another exemplary golf club head 1400 that includes a multi-branched weight track and low density sole and crown inserts, among other features. The club head has a face place 1460, a hosel 1440, a crown 1462, and a sole having a front end 1403 and a rear end 1405. The club head 1400 comprises a body 1402 made of a relatively rigid material that forms a main structural support for the club head, and also includes additional components coupled to the body 1402, such as light-weight sole and crown inserts 1450, 1452, 1454, a head-shaft connection assembly 1442, and adjustable weight assemblies 1430, 1432.

The club head 1400 can include lighter-weight components, such as sole inserts 1410 and 1412 and a crown insert 1414, to reduce mass in certain areas. These inserts can be made of composite materials, for example, with a low density while maintaining relatively high strength-to-mass and durability properties. The body 1402 can include a toe-side sole opening 1450 and sole-side sole opening 1452 that receive the toe-side sole insert 1410 and heel-side sole insert 1412, respectively. The sole inserts can be mounted/inserted to the body from the outside of the body (e.g., from below the sole) or from the inside of the body (e.g., through the upper crown opening and down onto the inside of the sole). The crown insert 1414 is mounted over crown opening 1454 in a similar manner.

The club head 1400 also includes adjustability features, including an adjustable head-shaft connection assembly 1442 and weight assemblies 1430, 1432 that are slidably adjustable along a multi-branched weight track 1416. The weight track 1416 has a "Y" shape with three branches that joint at a common intersection, including a front-rear branch 1422, a rear-toe branch 1424, and a rear-heel branch 1426. Each branch has a terminal end opposite from the intersection end. Any number of weights or weight assemblies, such as weight assemblies 1430, 1432, can be mounted to the weight track at a time. The weights can slide about substantially all of the track branches without being removed from the weight track.

Placing the weights nearer to the front 1403 of the club head can reduce backspin and create a lower trajectory for more distance, and placing the weights nearer to the rear 1405 of the club head can create more backspin and a higher trajectory, and also increase MOI for more forgiveness. Placing the weights nearer to the toe side can generate more side spin to create a fade, and placing the weights nearer to the heel side can generate more side spin in the opposite direction to create a draw. As shown, the rear branches 1424, 1426 can be angled to extend rearwardly as they extend laterally apart from the front-rear branch 1422. Weight assemblies can be insertable anywhere along the weight track 1416, such as at the front terminal end of the front-rear branch 1422, at the rear terminal end of one or both rear branches 1424, 1426, or therebetween.

At the front 1403 of the sole, the club head can further include a sole channel with a toe end portion 1406, a sole end portion 1408, and an intermediate channel portion 1404. The intermediate channel portion 1404 can bounded on the toe and heel sides by rigid walls/supports forming transitions between the end portions 1406, 1408 and the intermediate portion. In some embodiments, as shown, the intermediate channel 1404 can include a generally trapezoidal or rectangular wall structure or perimeter, which can help increase the rigidity of the front of the sole and the bottom of face despite the presence of the front channel in the sole. In some embodiments, the front sole channel can extend through the body into the interior cavity of the club head, or at least part of the channel, such as the intermediate portion 1404, can. The heel channel portion 1408 can include a fastener hole for a screw 1444 to be placed for securing the head-shaft connection assembly 1442 and a shaft to the club head. The illustrated front channel 1404/1406/1408 and the associated structure at the lower front portion of the club head can provide many benefits and advantages, as discussed elsewhere herein, including helping to improve/optimize the contact time and coefficient of restitution when striking a golf ball, particularly below the center of the face.

Figure 52:
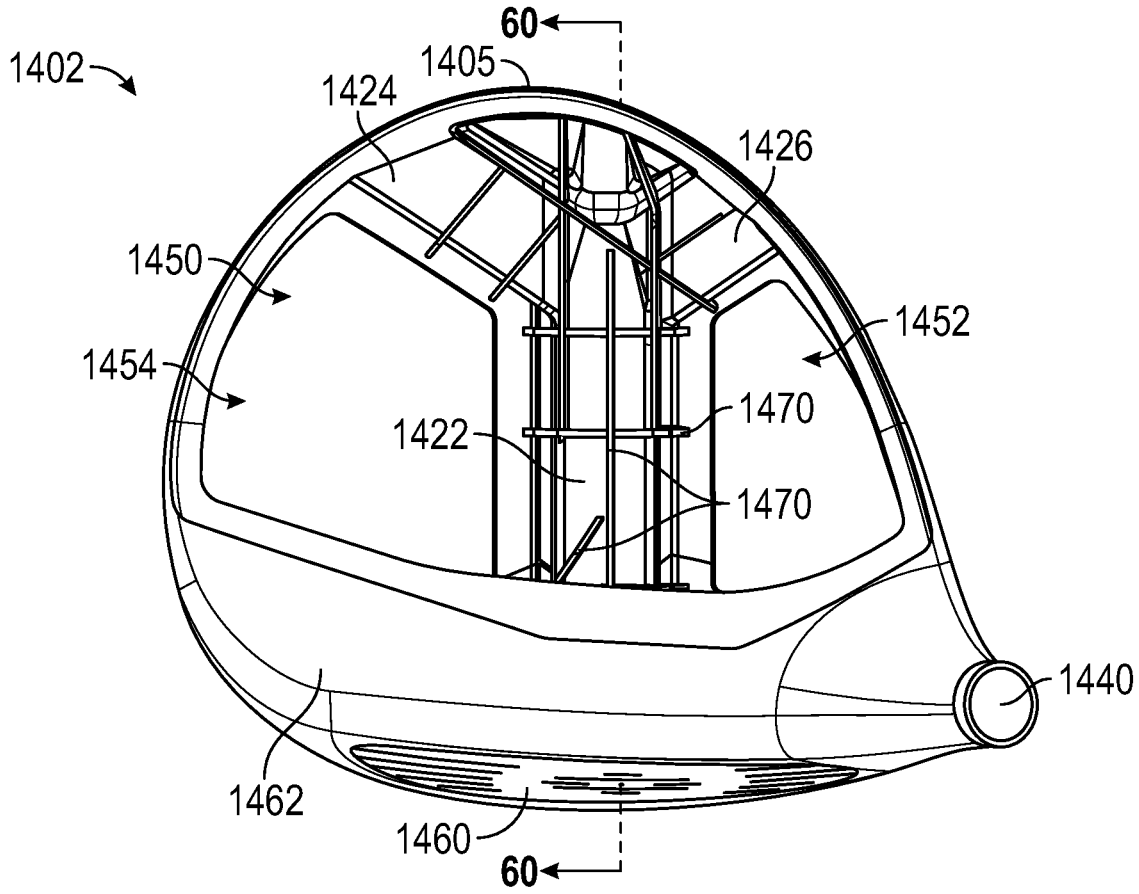
FIG. 52 is a top view of the body of the club head of FIG. 48.
Figure 53:
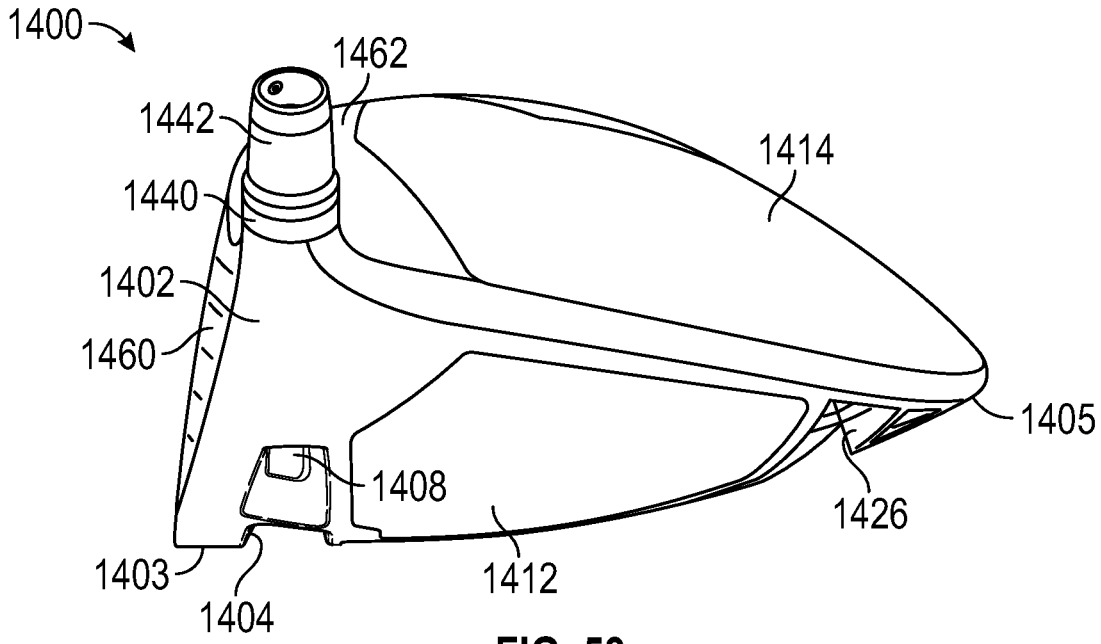
FIG. 53 is a heel-side view of the club head of FIG. 48.
Figure 54:
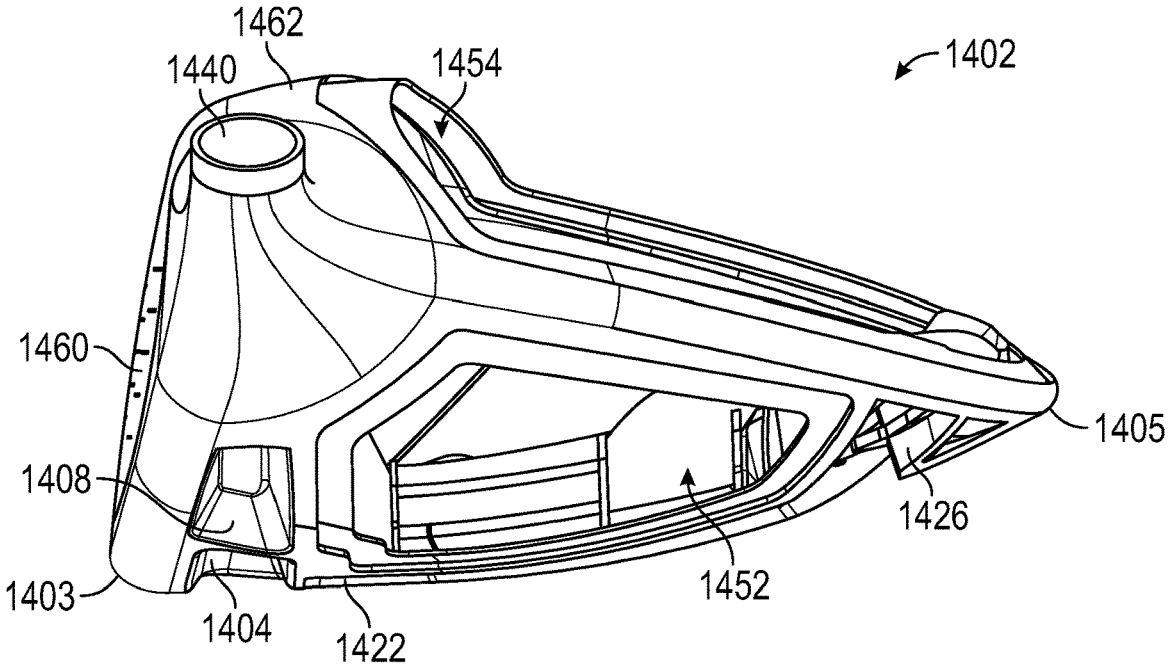
FIG. 54 is a heel-side view of the body of the club head of FIG. 48.

The club head 1400 can also include various internal ribs that can reinforce the club head at strategic locations and/or provide enhanced acoustic properties for the club head. FIG. 52 shows several internal ribs 1470 located above the sole and above the branches of the weight track 1416. FIGS. 56-59 show additional internal lip ribs 1474 that are positioned at the transition between the top of the face 1460 and the forward portion of the crown 1462. As shown, the club head 1400 includes four lip ribs 1474, with at least one located toward the heel side and at least one located toward the toe side of the club head. The lip ribs can help reinforce the face and can provide desire contact time (CT) and COR properties along a wider breadth across the face. reinforcing local parts of the face can allow lowering CT values at local portions of the face without lowering CT elsewhere on the face, such as at the centerface location. This can provide more consistent CT values over the whole face. Furthermore, one or more of the ribs 1470 along the sole/weight track can extend forwardly to the lower end of the face 1460 (see FIGS. 59 and 61). As shown, one of the ribs 1470 joins with the lower end of the face at a toe side of the face, which can further reinforce the face and provide more desirable contact times and COR properties in that region of the face. The rib various ribs can be located to strategically stiffen certain areas to provide local stiffness benefits (e.g., reducing vibrations/rattling along the weight track and lower contact times on balls struck toward the toe, particularly well above or below the centerface) and global club head benefits (e.g., increasing the pitch of the sound made when striking a golf ball).

The club head 1400 includes a weight track 1416 that has three track branches generally forming a Y shape. The front branch 1422 extends from a forward terminal end just behind the front-center channel 1404 rearwardly across generally the middle of the sole. The rear-toe branch 1424 extends from a terminal end along the toe side of the sole forwardly and heelwardly to join with the rear end of the front track 1422. The rear-heel branch 1426 extends from a terminal end along the heel side of the sole forwardly and toewardly to join with the rear end of the front track as well. The three branches each have joining ends to join together at a common intersection. Each of the weight assemblies 1430, 1432 can travel across the intersection to move from any one of the branches to any other of the branches without being removed from the weight track. The weight assemblies just need to be loosened partially to be moved around the weight track. Then they can be tightened to fix them in place at desired locations along the weight track.

Figure 66:
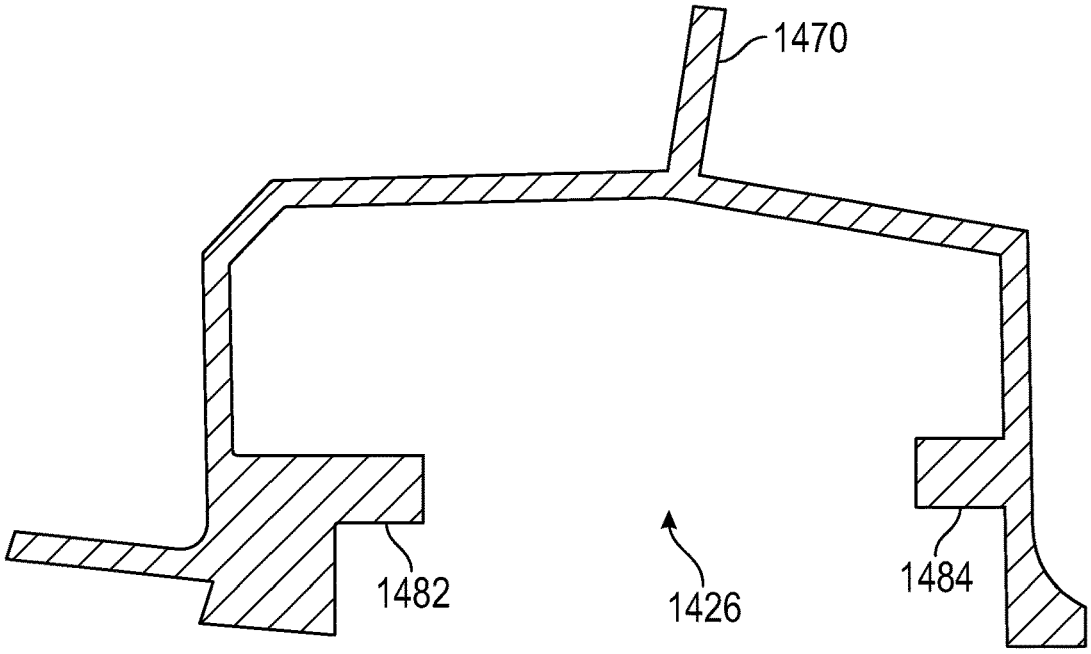
FIG. 66 is a cross-sectional view showing a profile of the heel-side weight track.
Figure 67:
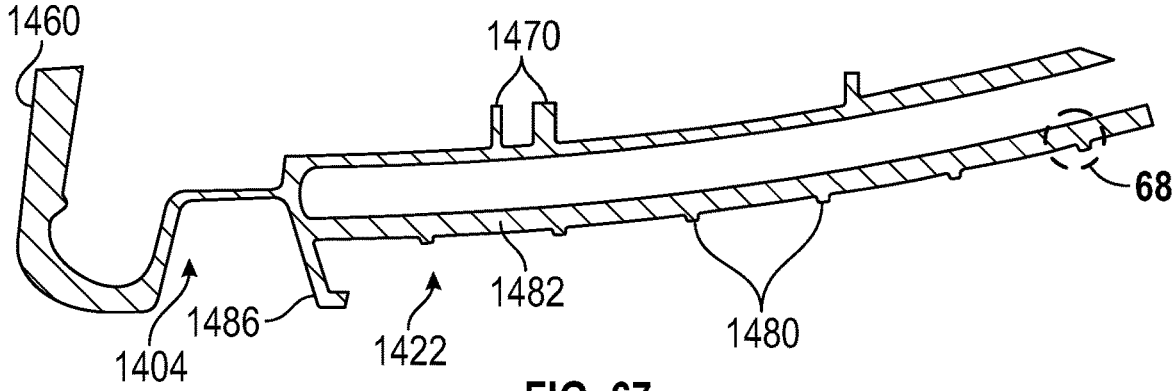
FIG. 67 is a cross-sectional view showing a front-rear profile of the front-rear weight track.
Figure 68:
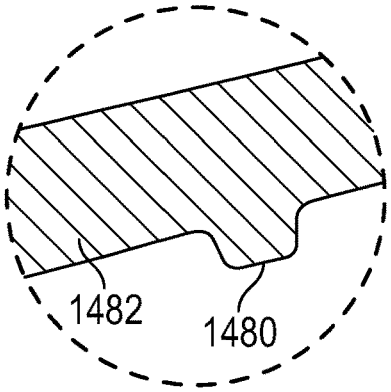
FIG. 68 is an enlarged view of a nub shown in FIG. 67.

FIG. 66 is a widthwise cross-section of the front branch 1426, showing two ledges 1482, 1484 on either side of the track, and one of the internal ribs 1470 overlying the track. The weight assemblies can clamp onto one or both of the ledges to be fixed in place. FIG. 67 shows a lengthwise cross-section of the front branch 1422, showing the toe-side ledge 1482 and nubs 1480 (see also FIG. 68) along the ledge 1482 that can help secure the weight assembly to the track at desired locations. FIG. 67 also show a front wall 1486 of the front track, which is also a rear wall of the center channel 1404.

Figure 69:
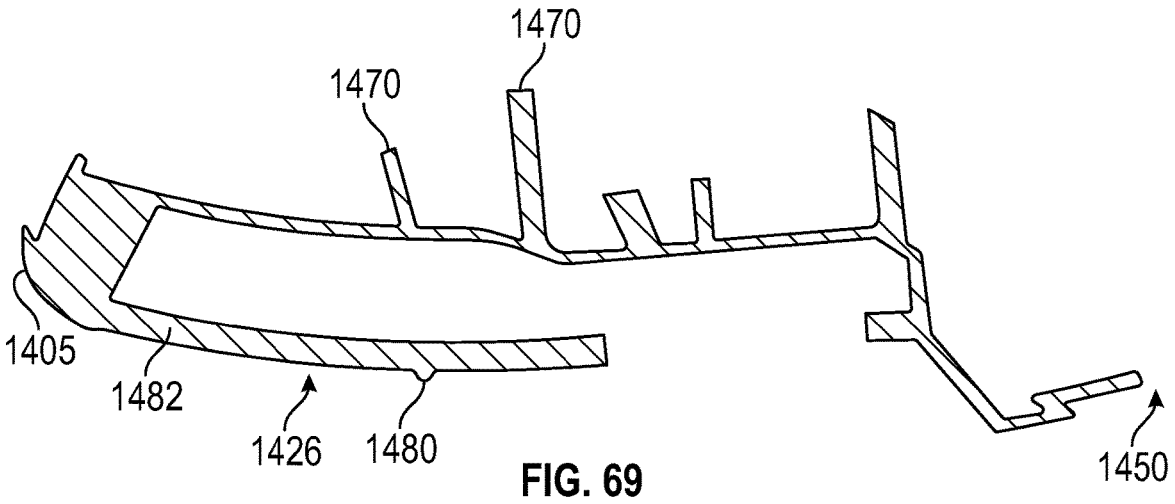
FIG. 69 is a cross-sectional view of a length profile of the heel-side weight track.
Figure 70:
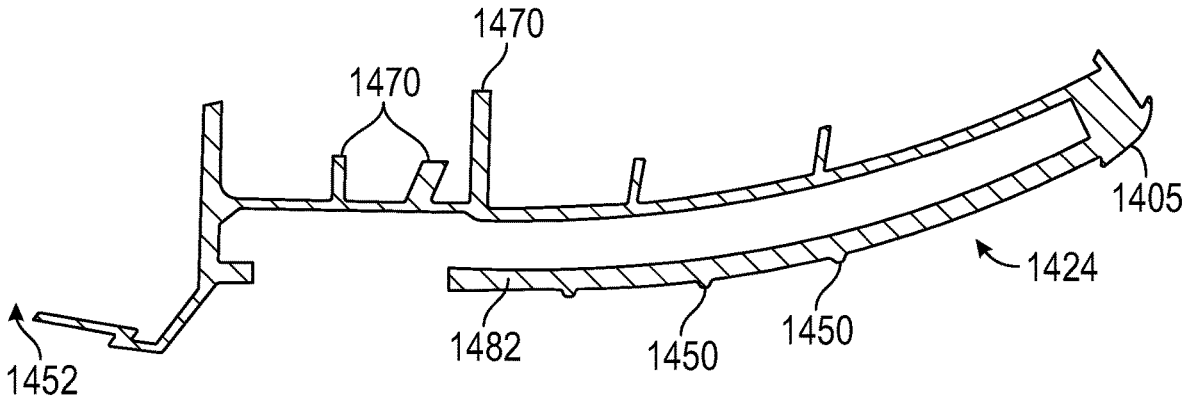
FIG. 70 is a cross-sectional view showing a length profile of the toe-side weight track.

FIG. 69 shows a lengthwise cross-section of the rear-heel branch 1426, showing one of its ledges 1482 and a nub 1480 located on the ledge. Some of the ribs 1470 are also visible above the branch 1426. FIG. 70 shows a lengthwise cross-section of the rear-toe branch 1424, showing one of its ledges 1482 and nubs 1480 located on the ledge. Some of the ribs 1470 are also visible above the branch 1424.

Figure 71:
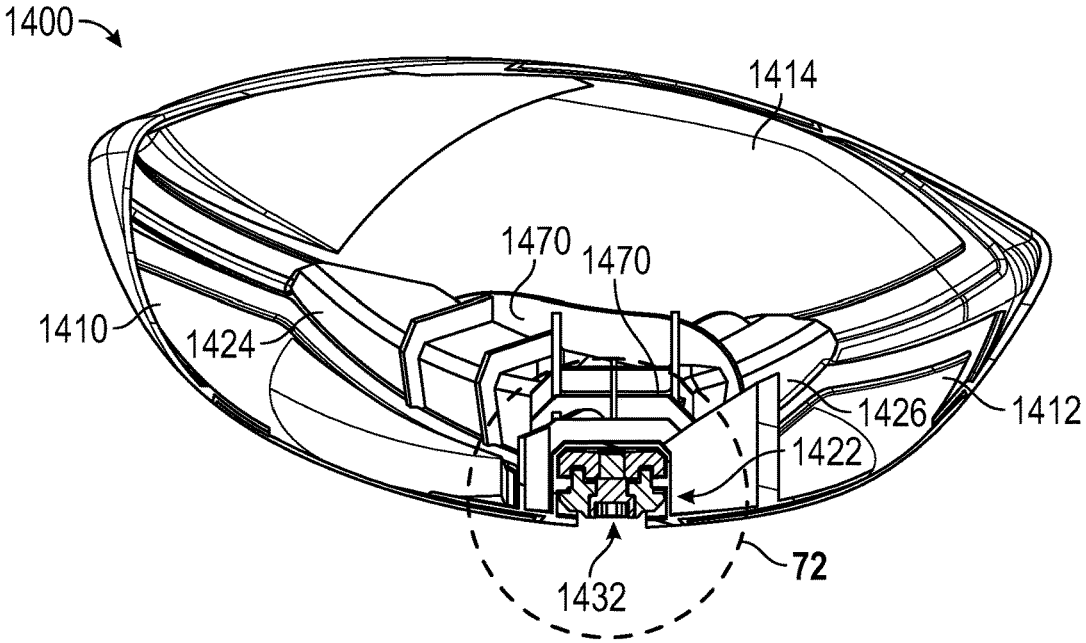
FIG. 71 is a cross-sectional view of a rear portion of the club head, from the front, showing a weight assembly mounted in the front-rear weight track.
Figure 72:
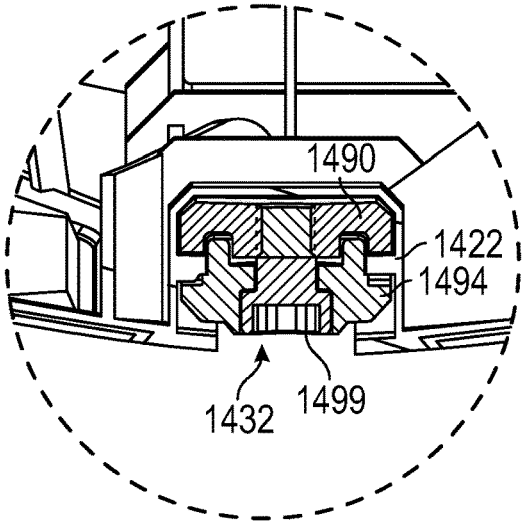
FIG. 72 is an enlarged view of the mounted weight assembly of FIG. 71.
Figure 73:
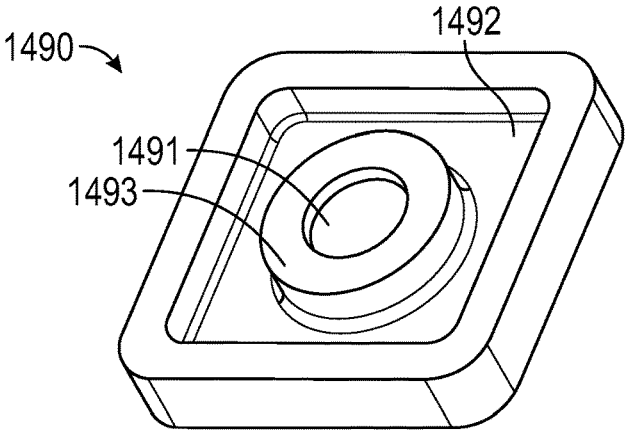
FIG. 73 is a perspective view of an inner weight member of the weight assembly.
Figure 74:
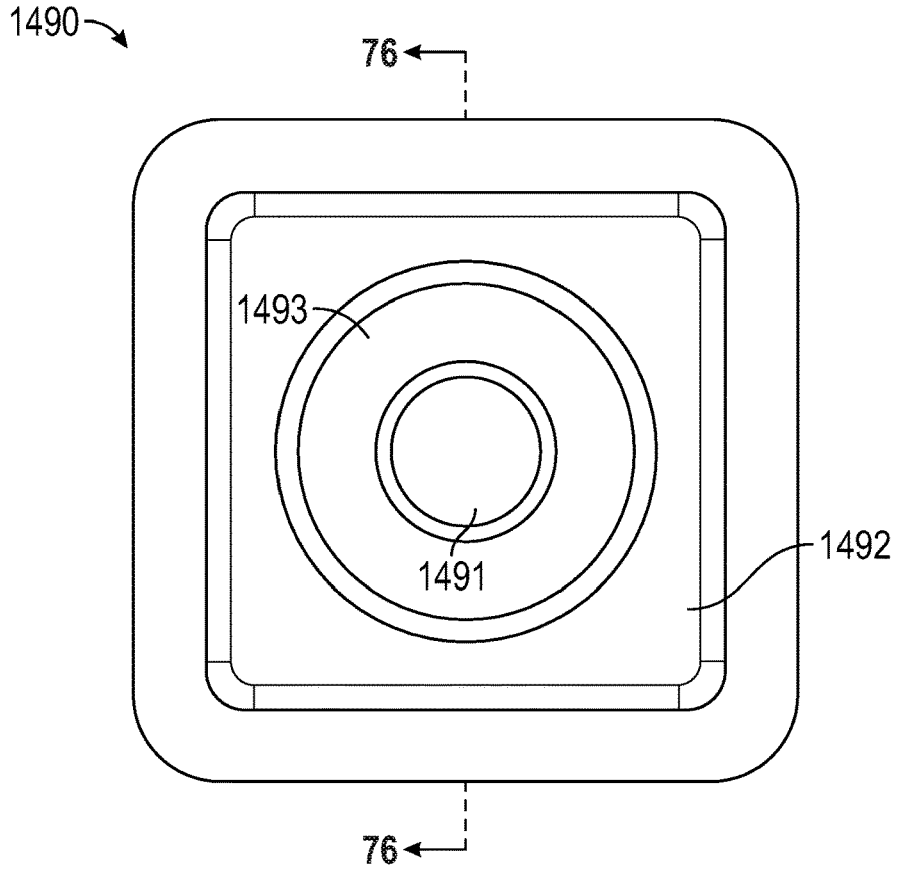
FIG. 74 is a plan view of the inner weight member.
Figure 75:
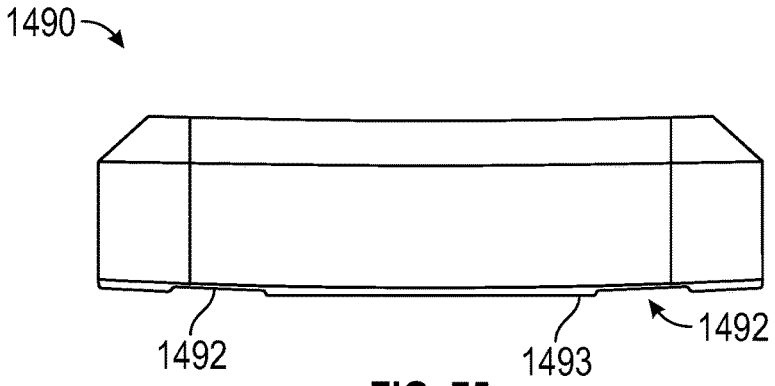
FIG. 75 is a side view of the inner weight member.
Figure 76:
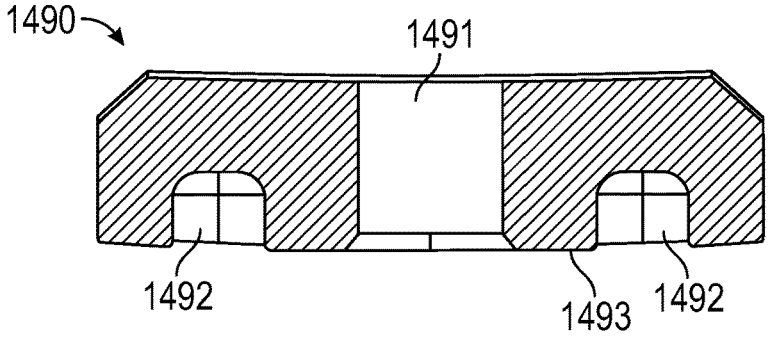
FIG. 76 is a cross-sectional view of the inner weight member.
Figure 77:
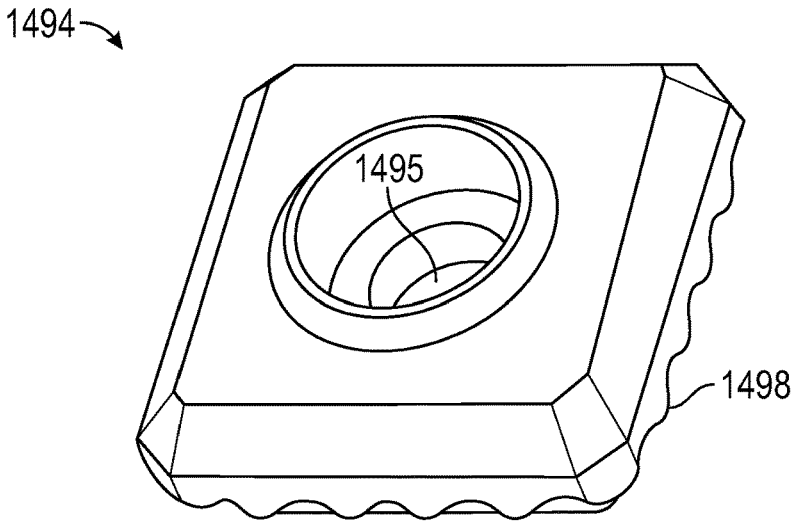
FIG. 77 is a perspective view of the outer weight member of the weight assembly.
Figure 78:
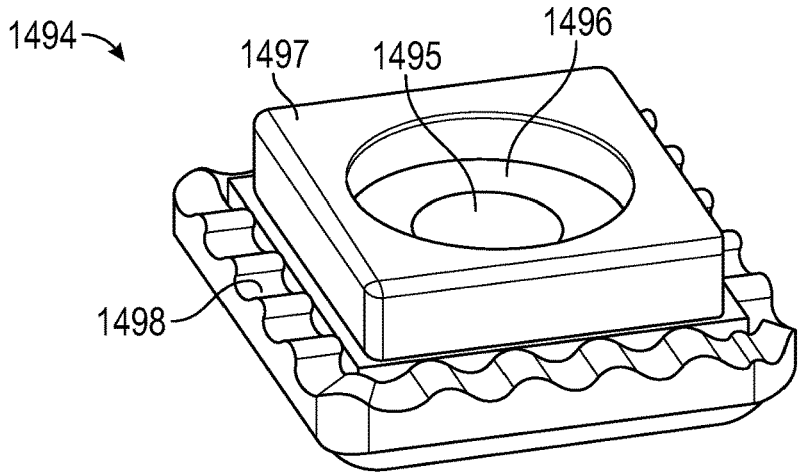
FIG. 78 is another perspective view of the outer weight member, from the other side.
Figure 79:
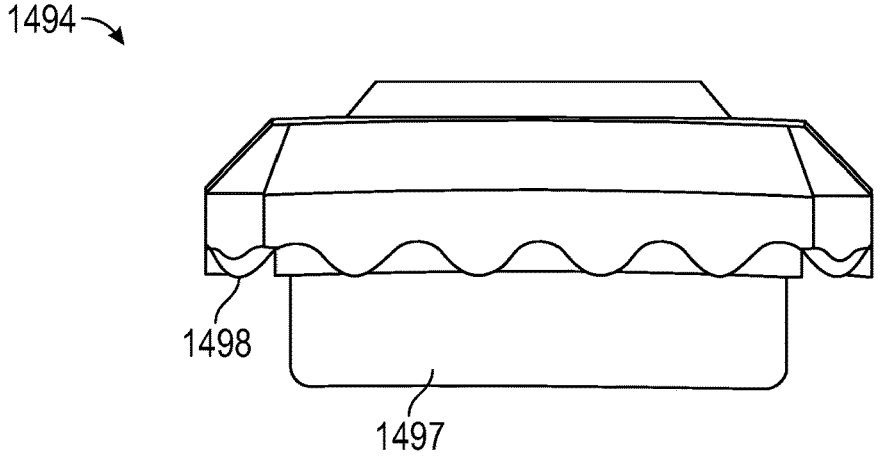
FIG. 79 is a side view of the outer weight member.
Figure 80:
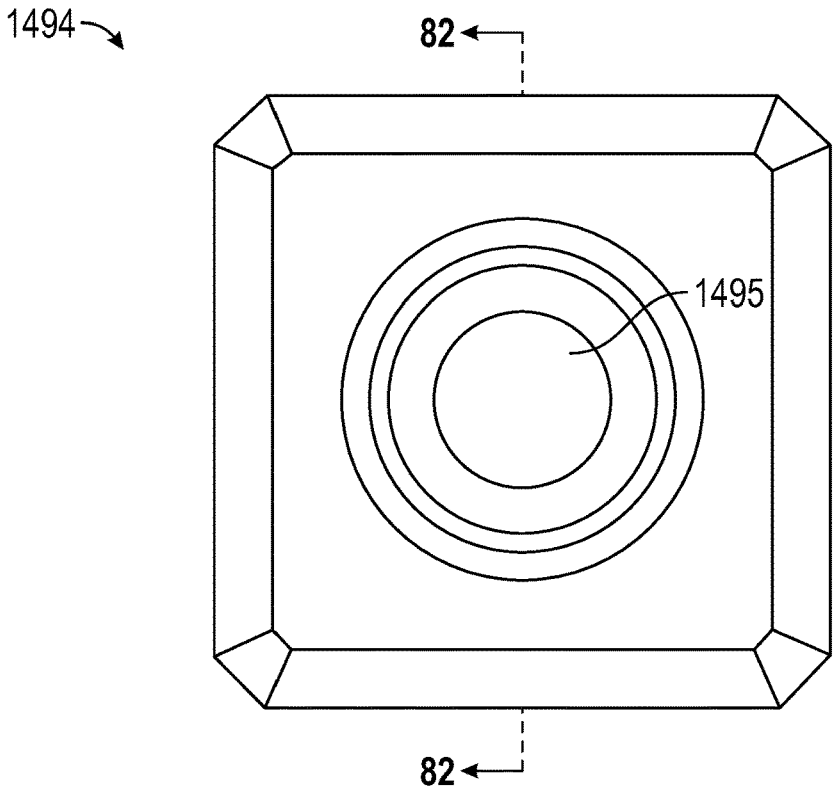
FIG. 80 is a bottom plan view of the outer weight member.
Figure 81:
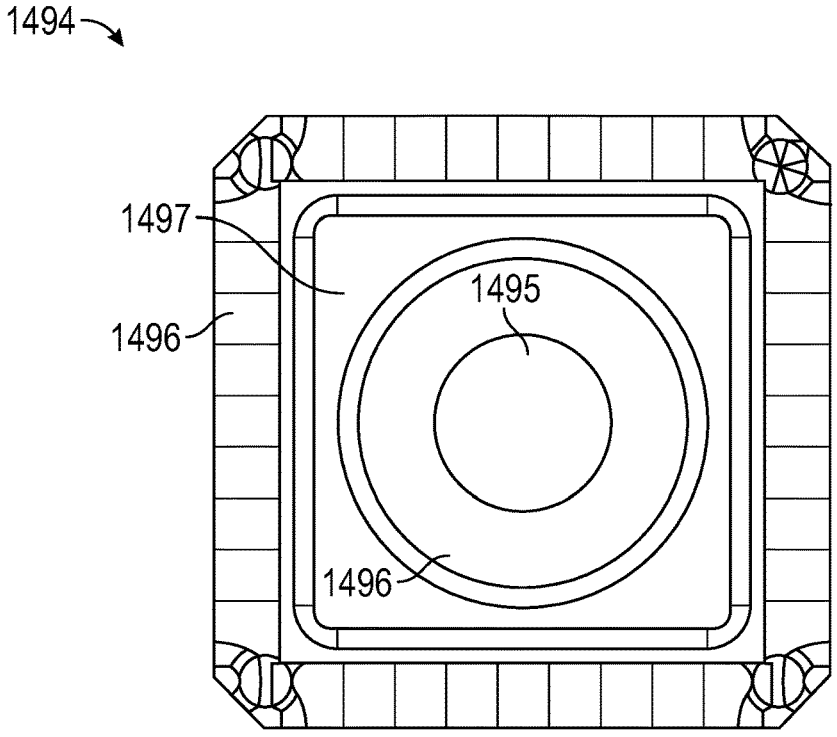
FIG. 81 is a top plan view of the outer weight member.
Figure 82:
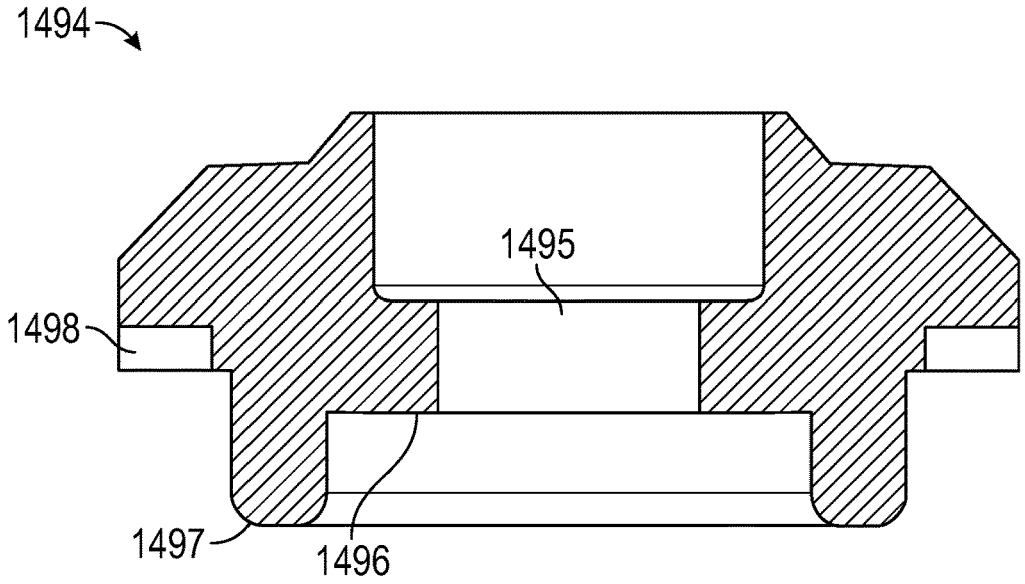
FIG. 82 is a cross-sectional view of the outer weight member.

FIGS. 71 and 72 show a widthwise cross-section of the club head cutting across the front track 1422 and one of the weight assemblies 1432, and looking rearwardly. The position of the weight assembly 1432 and its components is shown relative to the track and ledges. FIG. 71 shows several of the internal ribs 1470 located above the weight track, and shows the internal sides of the two rear branches 1424, 1426. FIG. 72 shows how the internal weight member 1490 is positioned above the ledges of the weight track and the external weight member 1494 is positioned below the ledges, such that tightening the fastener 1499 allows the internal and external weight members to clamp onto the ledges. Loosening the fastener partially allows the weight assembly to be slidable along the weight track, moving over the nubs 1480 on the ledges, but without letting the weight assembly come apart or letting the internal weight member inadvertently come out of the weight track.

FIGS. 73-82 show detailed views of the inner weight member 1490, external weight member 1494, and fastener 1499 that make up the three-piece weight assemblies 1430 and 1432. The internal weight member 1490 can be rectangular or square to cause it to fit within the weight track without rotating (so it does not turn when the fastener is turned to tighten/loosen the assembly). The internal weight member 1490 includes a threaded opening 1491 to mate with the fastener, a projection 1493 around the opening, and a recess 1492 around the projection 1493. The projection 1493 and recess 1492 face downward when installed in a weight track. The external weight member 1494 includes a central passage 1495 for the fastener to pass, a recess 1496 around the passage 1494 that receives the projection 1493 of the internal member, and a raised wall 1497 that fits into the recess 1492 of the internal member. When mated, the rectangular raised wall 1497 cannot rotate relative to the recess 1492, keeping the internal and external weight members rotationally aligned. The can prevent the weight assemblies from getting misaligned or mis-rotated, especially while traversing the intersection between the different track branches. The external member 1494 also includes a crenelated or notched perimeter surface 1498 that extends around four sides of the raised wall 1497 and serves to receive one or more of the nubs 1480 on the ledges. When a nub 1480 is seated in one of the notches of the perimeter surface 1498, and the assembly is fastened tightly to the ledge, the nub helps prevent the weight assembly from inadvertently sliding along the weight track.

In one embodiment, the club head 1400 including the two weight assemblies 1430, 1432 can have a mass of about 200-205 grams and a volume of about 435-440 cc, and due to the adjustability of the weight track, the club head can have a CGx in a range of about −3.4 mm to about −0.6 mm, a Delta CGx of at least about 2.8 mm, a CGz in a range of about −3.7 mm to about −2.0 mm, a Delta CGz of at least about 1.56 mm, a Zup from about 26.4 mm to about 28 mm, an Ixx of from about 262 to about 337, an Iyy of from about 262 to about 268, and an Izz of from about 402 to about 495. The body 1402 can account for about 152.5 grams of mass, with a density of about 4.36 g/m$^3$.

Figure 83:
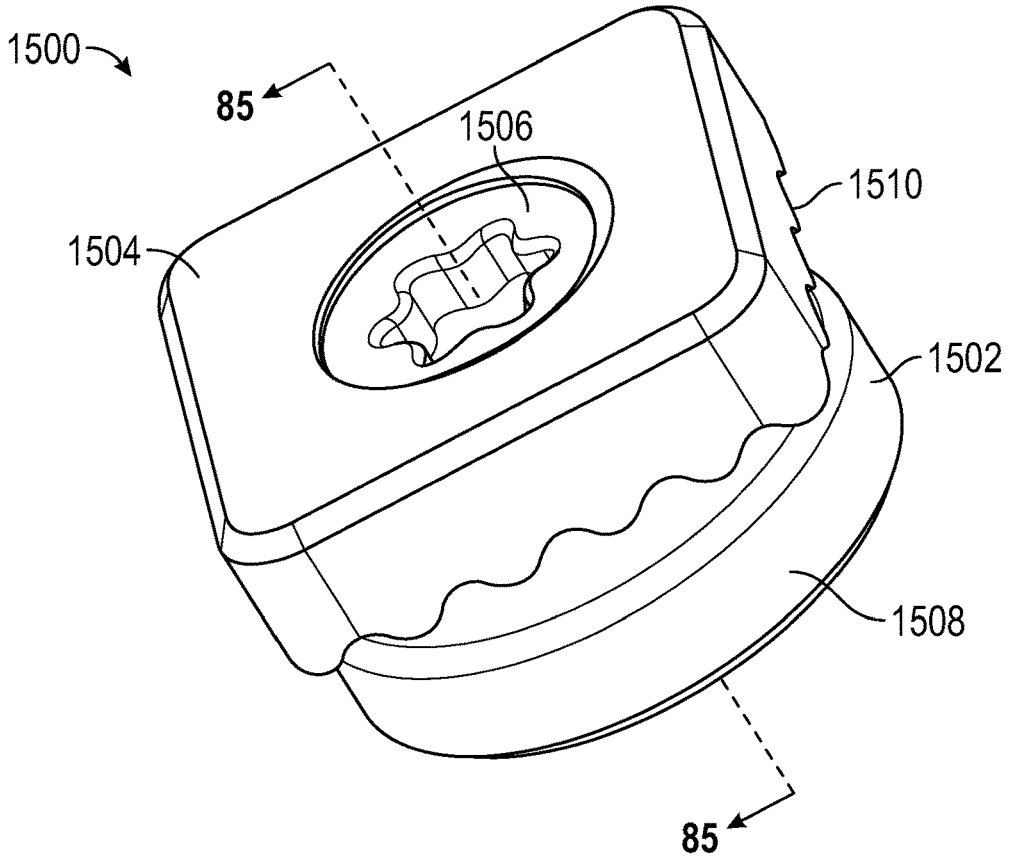
FIG. 83 is a perspective view of an exemplary two-piece weight assembly including a rounded inner member having a male fastener member and a square outer member having a female fastener opening.
Figure 84:
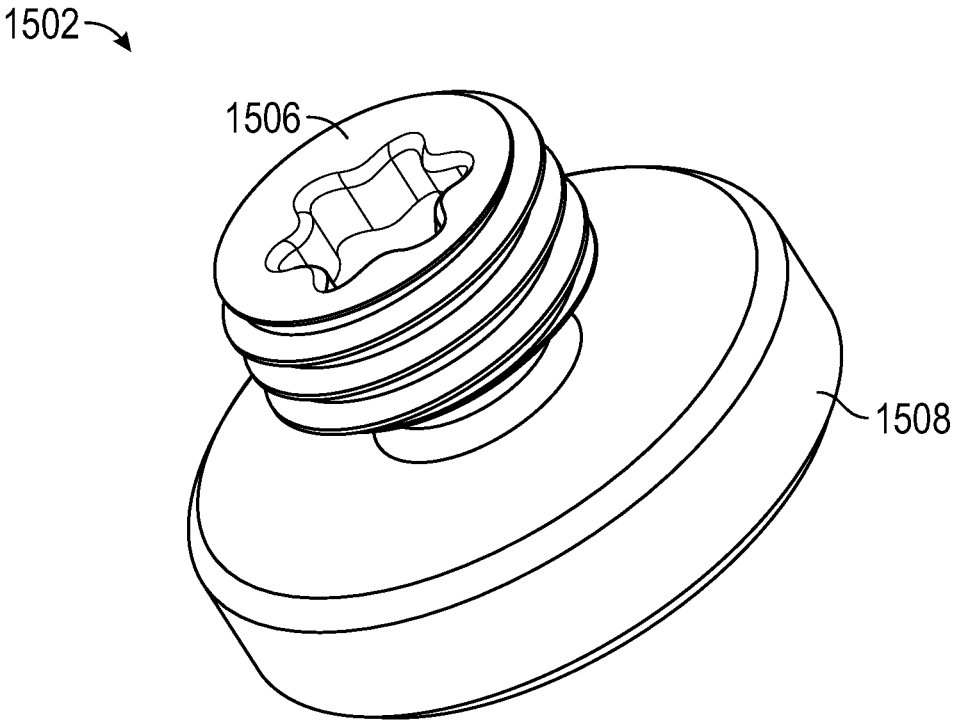
FIG. 84 is a perspective view of the rounded inner weight member.
Figure 85:
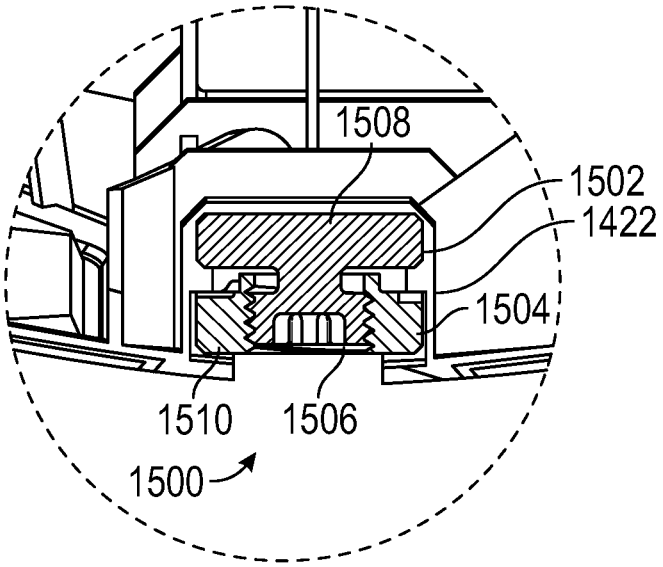
FIG. 85 is a cross-sectional view, looking from the front toward the rear, showing the two-piece weight assembly of FIG. 83 mounted in the club head body of FIG. 48.
Figure 86:
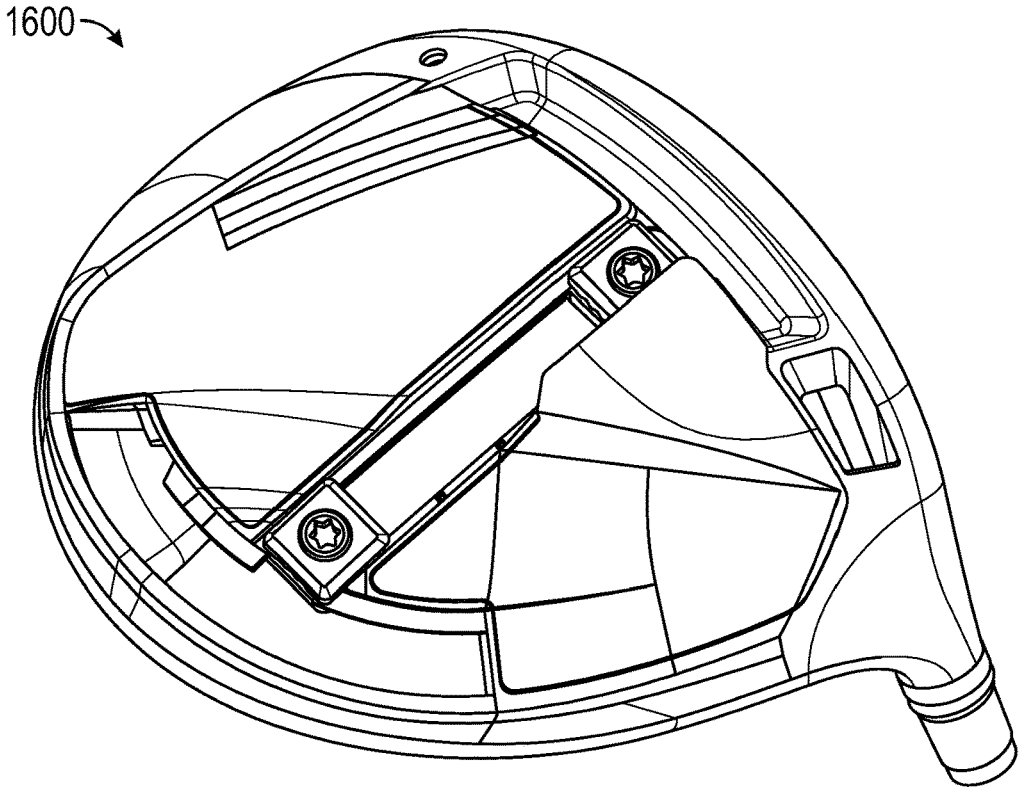
FIG. 86 is a perspective bottom view of another exemplary club head having a multi-branched weight track and front sole channel.
Figure 87:
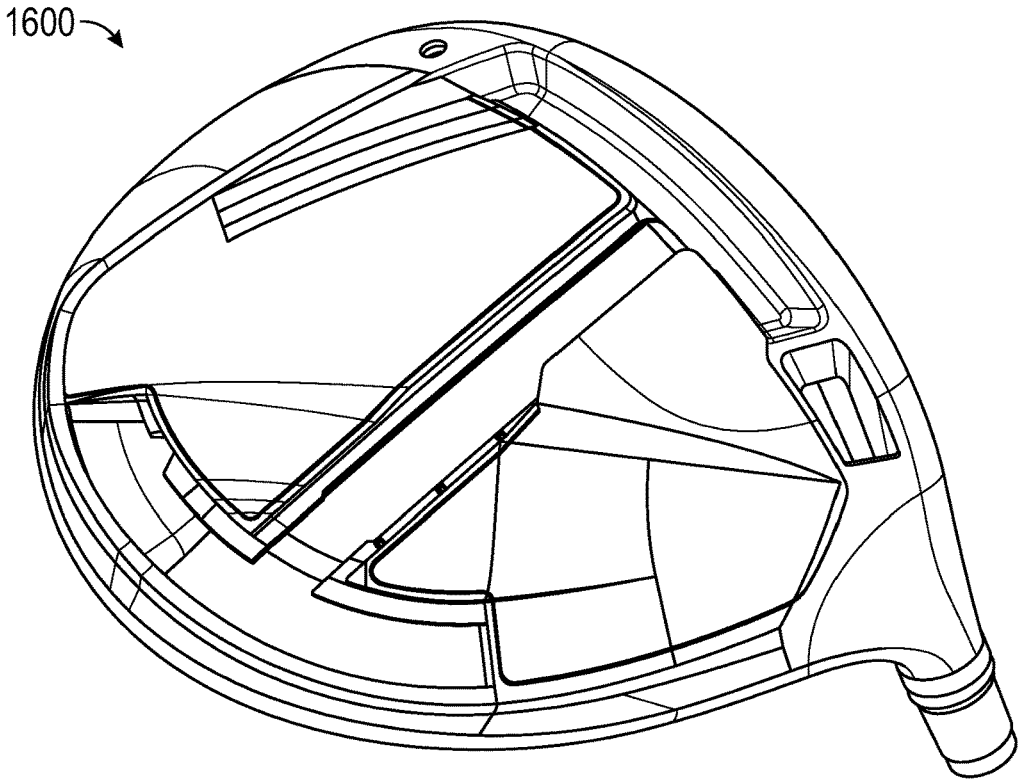
FIG. 87 shows the club head of FIG. 86 without the weight assemblies installed.
Figure 88:
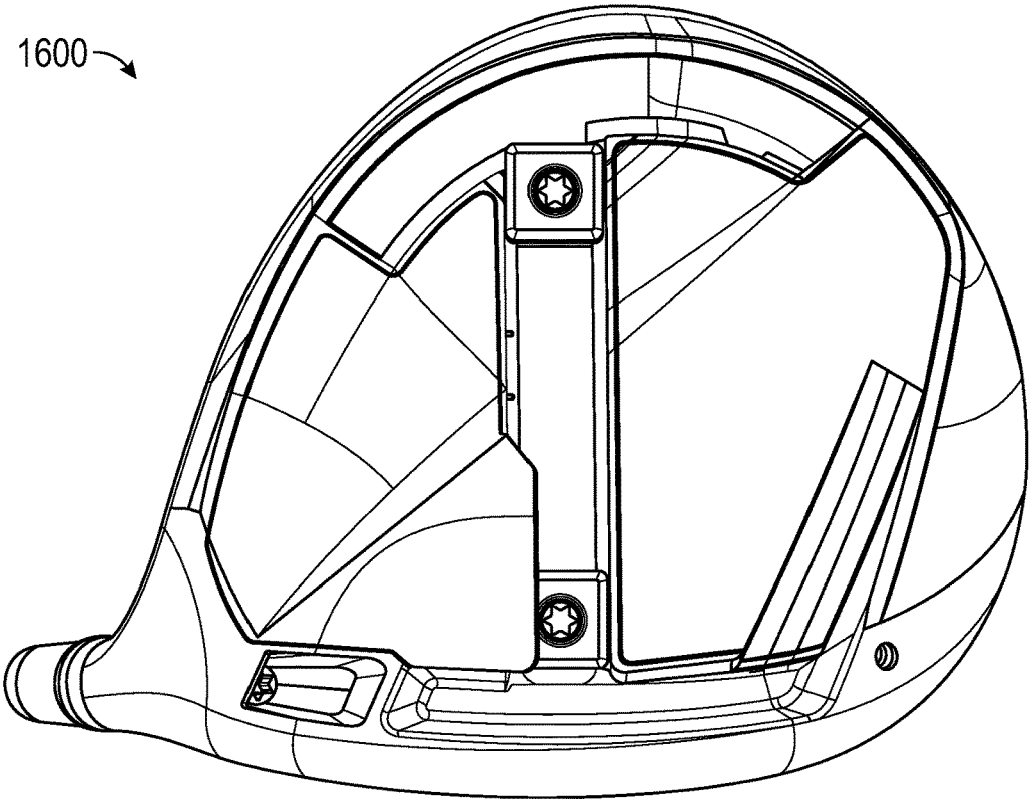
FIG. 88 is a bottom plan view of the head of FIG. 86.

FIGS. 83-85 illustrate an alternative weight assembly having just two pieces. The two-piece weight assembly 1500 includes a round internal member 1502 and a rectangular external member 1504. There is no separate fastener. The internal member 1502 includes a circular body 1508 and a male threaded projection 1506 that mates with a female threaded opening in the external member 1504. The external member 1504 can include a crenelated or notched perimeter surface 1510 similar to the external member 1494. FIG. 85 shows the two-piece assembly mounted in the front weight track branch 1422 of club head 1400 instead of the three-piece weight assembly 1432 (compare to FIG. 72). The two members clamp onto the ledges of the track branch 1422 when the internal member 1502 is rotated while the external member 1504 stays stationary relative to the club head. The circular shape of the internal body 1508 allows it to turn tighten or loosen the assembly. The circular shape also helps the weight member more easily move across the varying sole geometry and around corners in the track. For example, the weight can transition from the front track to one of the rear tracks without getting caught on a corner or getting stuck diagonally in the intersection between the branches. The two-piece weight assembly 1500 can have any desired total mass, such as from 1 gram to 18 grams. Further, any number of such assemblies can be mounted in the weight track, and one assembly can be substituted out for two assemblies each having half the mass so they still add up to the same total mass. More mass assemblies can provide more flexibility in mass positioning, allowing more customizable mass adjustments.

FIGS. 86-93 show another exemplary golf club head 1600 that includes many of the same features, or similar features, as described with reference to the club head 1400. Notably, the weight track is shaped differently, with two curved rear weight track branches extending in opposing toeward and heelward directions from the back end of the front track. The two rear branches can be considered to form one continuously curved rear track that extends along the rear portion of the sole below the skirt. Compared to the club head 1400, the terminal ends of the three track branches are in about the same location, but the intersection between the joining ends of the three branches is moved rearward, such that the front track is longer and extends further rearwardly. This track formation allows more perimeter weighting options.

Further, as can be seen in FIGS. 86-88 and 93, the sole includes an underhanging portions that partially extends under the front track, such that is positioned between the weight track and the ground when the club head is in the address position. This underhang can help protect the weight track and weight assemblies from damage and debris when the club head contacts the ground during a swing, and can enhance the aerodynamics of the club head during a swing.

Another notable feature of the club head 1600 is the front channel that extends in the heel-toe direction just behind the face and in front of the weight track. The channel can include a smaller heel portion when the fastener is located from the head-shaft assembly, and a longer center-toe portion that extends across the middle and toe sections of the sole.

Figure 89:
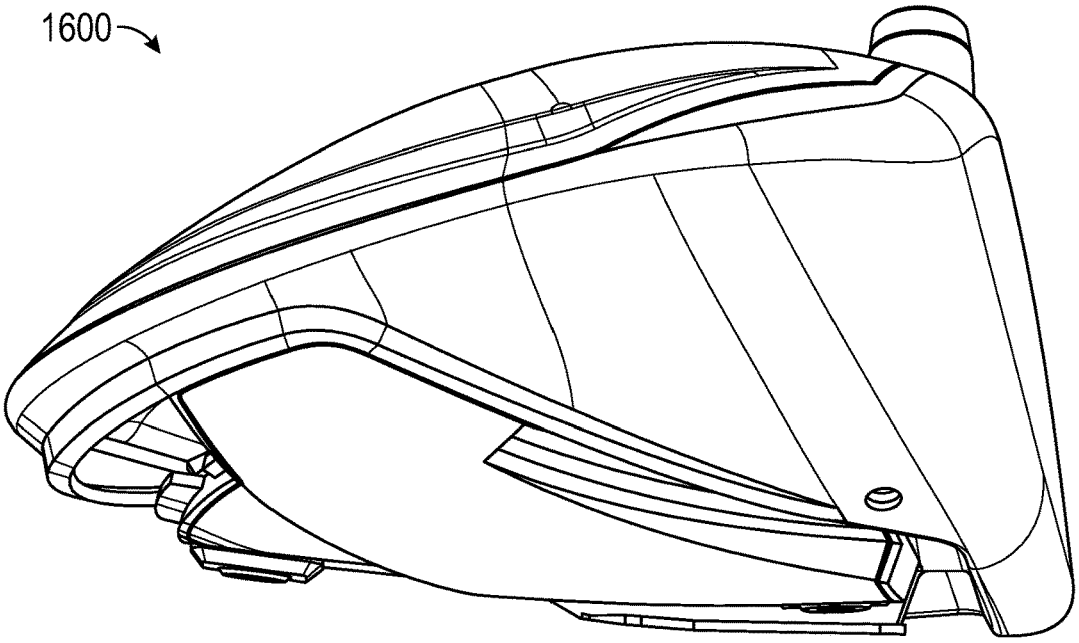
FIG. 89 is a toe side elevation view of the head of FIG. 86.
Figure 90:
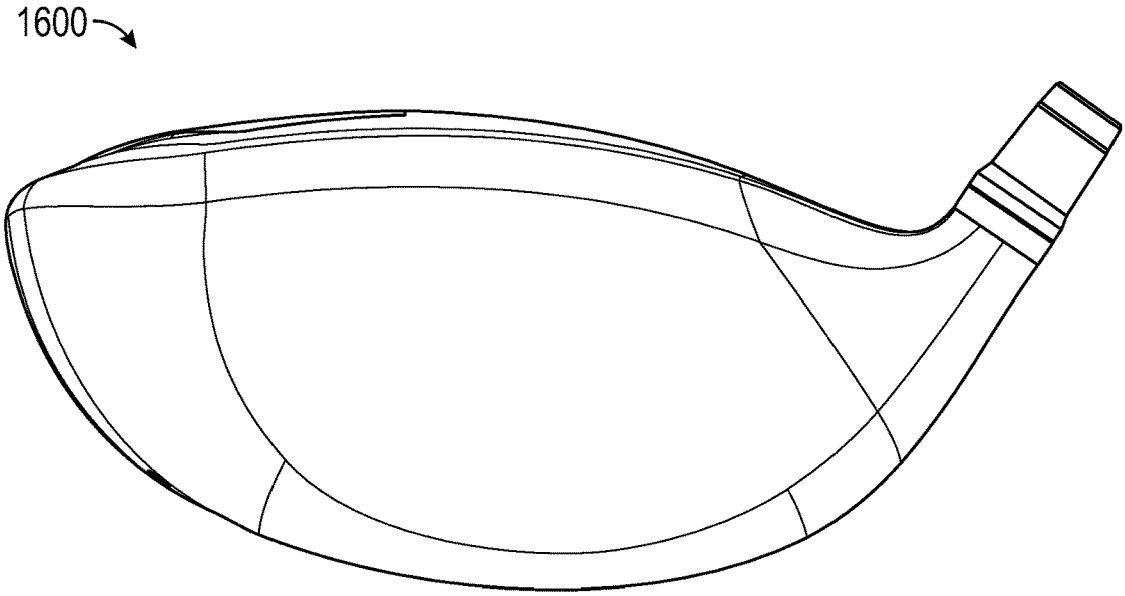
FIG. 90 is a front elevation view of the head of FIG. 86.
Figure 91:
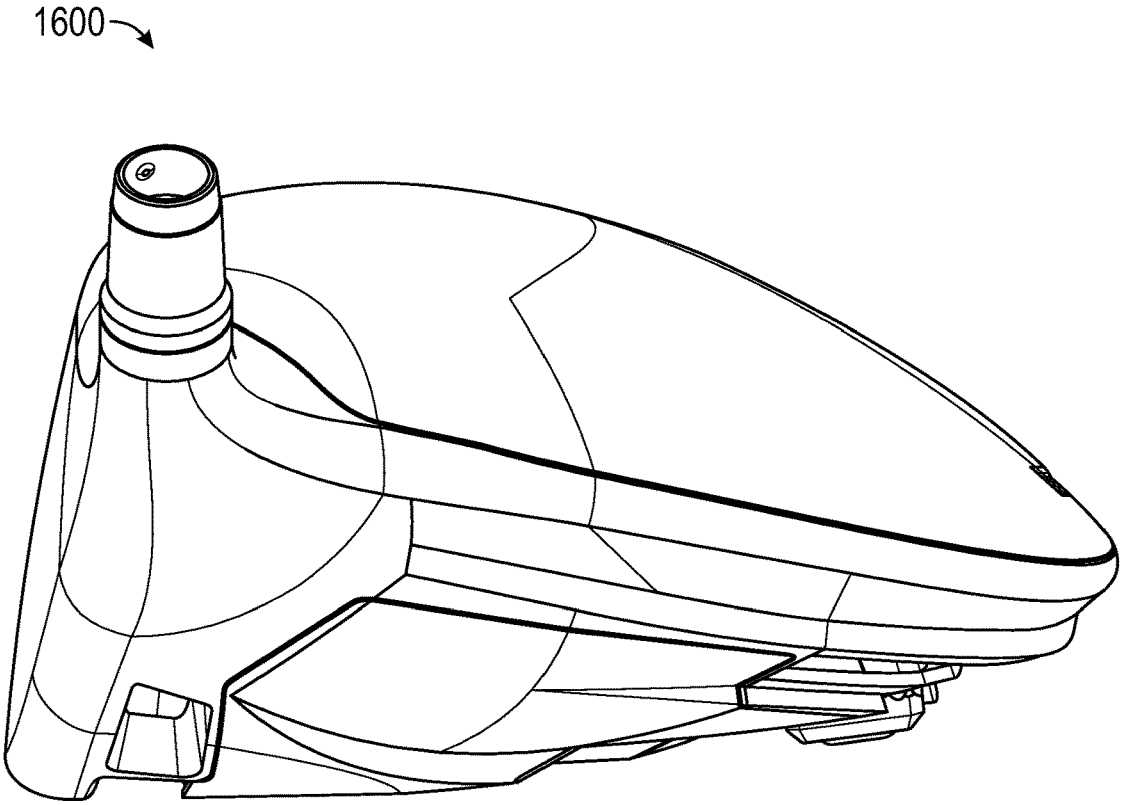
FIG. 91 is a heel side elevation view of the head of FIG. 86.
Figure 92:
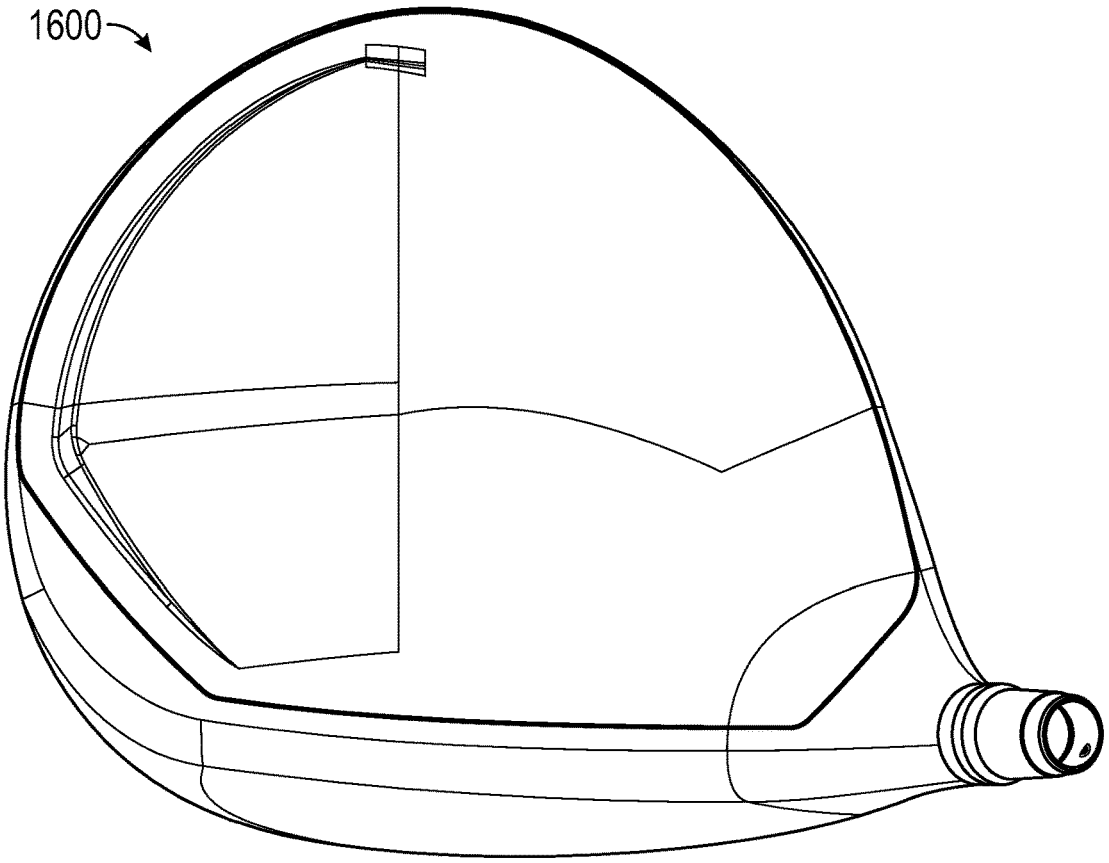
FIG. 92 is a top plan view of the head of FIG. 86.
Figure 93:
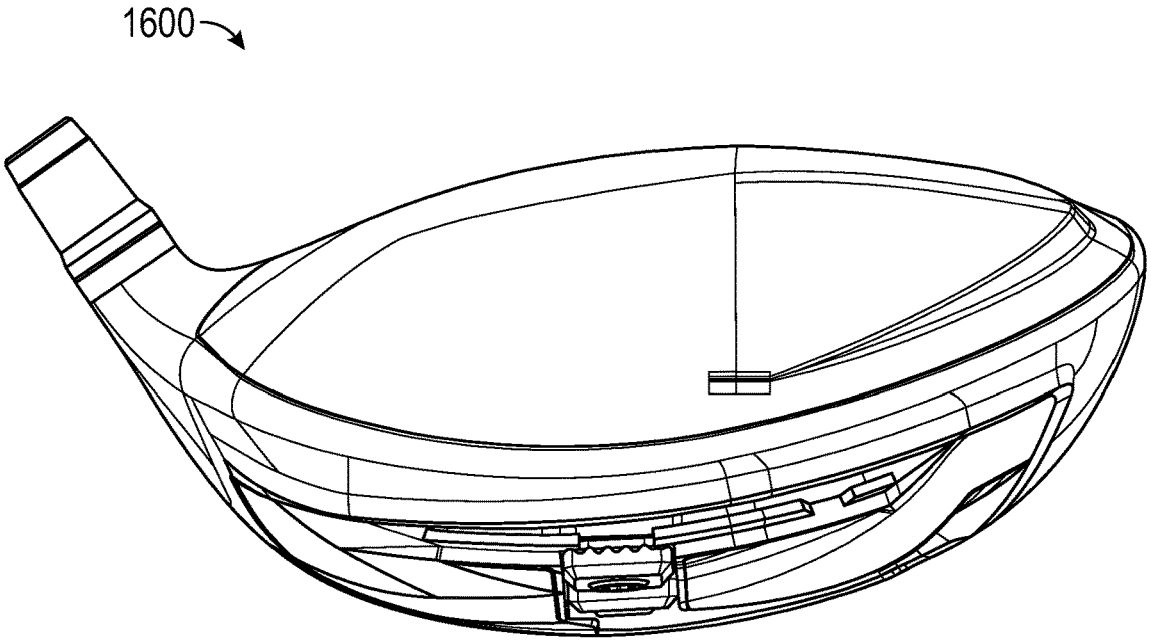
FIG. 93 is a rear elevation view of the head of FIG. 86.

Another notable feature of the club head 1600 is that the sole can include a raised sole portion toward of the weight track and rearward of the front channel, as shown in FIG. 89. The club head 1600 can also include a perimeter ledge that extends down around the rear weight track branches, the raised sole portion, and generally extends around a rear, toe, and heel perimeter of the club head.

In the golf club heads 1200, 1300, 1400, 1600 the plural slidable weight assemblies can travel about the entire weight track to any desired combination of positions, without being removed. Because the tracks have multiple joined branches, the weight assemblies can also be switched in position readily. For example, any of the weight assemblies can be the front weight, the rear weight, the toe side weight, or the heel side weight. If one assembly has more mass than the other, switching their positions can provide greater variety of possible mass distribution properties.

In any of the disclosed embodiments, such as the club heads 1200, 1300, 1400, 1600 the weight tracks can include inner and outer channels separated by one or more ledges, with an inner weight member in the inner channel and an outer weight member in the outer channel, such that tightening the fastener of the weight assembly clamps the two weight members onto the ledge to fix the position. In inner and outer channels can be at least as wide as the weight members to allow them to slide along the channels. In some embodiments, the inner and/or outer weight channels can have a width of about 10 mm to about 20 mm, about 13 mm to about 17 mm, such as about 15 mm for example. One or more portions of the channels can be a bit wider to allow angled insertion of the weight member, such as about 15 mm to about 20 mm, such as about 17.5 mm for example. The inner and outer channels can be accessed via an exterior slot that is narrower than the width of the weight members, such that there is an overhanging ledge that partially covers the weight members. The exterior slot can be fairly narrow for most of the length of the weight tracks, so long as there is enough width to insert a tool to tighten and loosen the fastener, such as an Allen wrench or similar tool. The exterior slot can have a width from about 3 mm to about 10 mm, such as about 8.5 mm in one example. This allows a user to insert a tool to access the fastener, while substantially covering the weight members inside the channels to provide a smoother exterior surface on the sole and provide superior aerodynamic properties. The exterior slot can be somewhat wider at at least one location to allow insertion and removal of the weight members while still being a useable portion of the weight track.

In some embodiments, any of the club heads disclosed herein can include a "smart" club feature, which can include various types of sensors, measurement systems, data transmission systems, electronic or computerized systems, or the like. Smart club features can comprise smart weights, for example. Any of the movable or stationary weights disclosed herein can comprise or be swapped out for a smart weight. A smart weight can include one or more sensors/measurement devices and/or one or more data transmission or data storage systems. Exemplary sensors and measurement devices can include GPS systems, gyroscopic sensors, accelerometers, magnometers, and the like. Exemplary data transmission systems can comprise Bluetooth or Bluetooth Low Energy transmitters, RFID transmitters, NFC transmitters, etc. Such smart weights and/or other smart features can be used to measure, analyze, store, and/or transmit data related to a golfers swings, locations on a golf course, impacts with balls and surfaces, club usage frequency, and many other useful metrics. Data related to a golfers swings can include swing speeds, club head angles, club positions, hand speed, hand rotation, impact time, impact duration, ball trajectory, ball speed, ball spin, and many other useful metrics. These data can be collected during any activities, can be stored and/or transmitted, and can be analyzed remotely to provide useful feedback for a club and for a golfer.

Smart features can also include a power source, such as a battery (rechargeable or not). Some smart club features can be powered via a small "coin cell" battery, such as a 550 mAh coin cell battery or similar. Batteries can last at least a year, at least two years, or longer before needing to be replaced or recharged. In some embodiments, the power source can be recharged via motions of the host club, allowing the smart feature to remain continuously charged. Smart features can be located in safe portions of a golf club to protect them, such as away from the striking face and away from ground contact surfaces. For example, a smart weight can be located at the rear of the sole away from impact. Smart features can also be located inside the body, on or in the crown, the shaft, grip, and/or other portions of the club.

In some embodiments, smart features can comprise a printed circuit board (PCB) containing the desired components and a battery. The PCB and battery may be side by side (such as to create a low profile), one above the other (such as to fit inside a weight member), or combined together in some other way. Multiple PCB's in one or more smart features may be powered by a common battery in some embodiments.

Depending on the construction of the smart feature and its location in the club, its durability can vary. In some embodiment, a smart feature can be configured to last for at least 1000 club head impacts, at least 2000 club head impacts, or at least 3000 club head impacts with losing functionality due to damaged, loss of power, or other failure.

A smart weight can be part of a set of weights that includes regular non-smart weights, so that the smart weight can be coupled to the club at desired times for data collection, and a regular weight can be substituted for the smart weight at other times. Two or more smart weights can also be included in a set and/or coupled to a club head at the same time. Smart weights can have any mass, though often smart weights have a relative higher mass comparted to other weights in a set due to the sensors, transmitters, storage devices, or other smart features included in the smart weights. A set can include a smart weight of a given mass and also a dummy weight having the same mass as the smart weight. A dummy weight and a smart weight of the same mass can be interchangeable without changing the mass properties (e.g., CG, MOI, etc.) or other performance properties of the club head, such that the club head performs the same with either weight installed.

Whether part of a weight member or included elsewhere in a club, a smart feature can have a size and mass to provide desirable club properties. When in a weight member, it may be desirable for the smart feature to have more mass but smaller dimensions, wherein when embedded in the club head body a smart feature can have larger dimensions but maybe less mass is desirable, for example. In some embodiment, a smart feature is embedded in a wall of the body, such as in the sole or in the crown. In such embodiments and others, it can be desirable to have a low profile smart feature that is very narrow in at least a thickness dimension, but can be long and/or wide in other dimensions. For example a thickness of such a smart feature can be from 1 mm to about 20 mm, such as from about 5 mm to about 15 mm, such as about 8 mm to about 12 mm. A length and/or width can be about 10 mm to about 50 mm, such as about 15 mm to about 45 mm, such as about 20 mm to about 40 mm. The overall volume of a smart feature can be any value, such as about 0.5 cc to about 25 cc, such as about 1 cc to about 20 cc, such as about 2 cc to about 15 cc, such as about 4 cc to about 10 cc. A ratio of the volume of the smart feature to the overall volume of the club head can be about 0.1% to about 10%, such as about 0.5% to about 5%, such as about 1% to about 3%. The mass of the smart feature can be any value, such as about 1 gram to about 50 grams, such as about 2 grams to about 25 grams, such as about 4 grams to about 10 grams. A ratio of the mass of the smart feature to the overall mass of the club head can be about 1% to about 25%, such as about 2% to about 20%, such as about 3% to about 15%, such as about 4% to about 10%.

In some embodiments, the club head can be prepared for play with two weight assemblies (e.g., such as weight assemblies 1320/1322 or 1500) mounted in the weight track, and one of two weight assemblies can comprise a smart weight while the other weight assembly comprises a traditional (non-smart) weight assembly. Or both assemblies can comprise smart weights. Further, for any given weight assembly, either one of the internal weight member and the external weight member can include a smart feature, or both can.

In any of the disclosed embodiments that include adjustable weights, the club head can include at least two interchangeable weights that can alternatively be attached to the club head, or simultaneously attached to the club head. The at least two interchangeable weights can include at least a first weight, having a first mass, and at least a second weight, having a second mass. Either of the two weights can comprise a smart weight, for example. Additional weights with their own respective masses can also be included. In some embodiments, the first mass and the second mass both fall within a range of from about 1 gram to about 25 grams. Further, the second mass can be larger than the second mass, such as at least two times, at least three times, or at least four times the first mass, while still within the 1-25 gram range. For example, the first mass can be 5 grams and the second mass can be 20 grams. In another example, the first mass is between about 1 gram and about 3 grams, and the second mass is between about 6 grams and about 18 grams. Where more than two weights are included, the masses can all have varied masses, though some may have the same mass, such as a smart weight and a corresponding dummy weight. More information about weights, weight kits, weight masses, weight fasteners, relative masses of several weights in a kit, and related information can be found in U.S. Publication No. 2015/0375070, published on Dec. 31, 2015, which is expressly incorporated by reference herein in its entirety.

In some embodiments, a head cover can be used with the golf club head. A head cover can be placed over the club head when the club is not in use to protect the club head. The head cover can be removed to use the club to strike a ball, then the head cover can be placed back on the club head until the next use of the club. In some embodiments, the head cover can interact with the club head. For example, the head cover can include a magnet or other magnetic field generator and the club head can include a sensor that detects the presence or absence of the magnet or magnetic field and responds by making a change to the club head. For example, the club head can awaken a smart feature in the club head when it detects the absence of the magnetic field, such as when the head cover is removed from the club head. The club head can also cause the smart feature to go into a "sleep mode" of low energy use when the magnetic field is detected again, such as when the head cover is placed back on the club head. A magnetic field can be detected by a magnetometer, for example. The club head can include a magnetometer, such as in a smart weight or elsewhere in the club head. In some embodiments, different types of wireless communication can be used in place of, or in addition to, a magnetic field. For example, the head cover and club head can communicate using an NFC tag and tag reader, an RF field generator and RF detector, wifi, optical sensors and/or light emitters, or any other form of wireless communication. In some embodiments, a wired or other physical connection and de-connection can be employed between the club head and the head cover. For example, the head cover and club head can have one or more plugs or electrodes that touch the other object and electrically couple them together, or the club head can include a button or pressure sensor that is activated by the head cover when it is on the club head, and not activated when the head cover is removed. No matter what means is used to detect when the head cover is on or off the club head, the club head smart feature can activate when the head cover is off such that the smart feature can be functional when the club head is being used. The magnetometer or other detector in the smart device can check for the presence of the head cover at regular intervals, such as every 20 seconds or so. Once the presence of the head cover is no longer detected the device can change from sleep mode to a wakened mode activating all sensors, where the device is expecting a golf swing and ready to capture data related to the golf swing. The head cover can also include a data storage device to store data collected from the club head, a data transmission device to communicate data with the club head and/or with a remote computing device or the like, and/or a power source. The head cover can in some embodiments include a power source and can charge a power source in the club head coupled to the smart feature when the head cover is on the club head. Power can be transmitted to the club head via a direct electrical connection or via wireless means, such as inductive charging. The head cover can include a rechargeable battery that can be charged up between rounds and can store enough power to supply the smart weight for an entire round, or multiple rounds. In any of these examples, the head cover can be substituted with a golf club bag, golf cart, a tag that is placed on the club, or any other device that can be located near the club when the club is not in use, and not located near the club when the club is in use.

In view of the many possible embodiments to which the principles of the disclosed technology may be applied, it should be recognized that the illustrated embodiments are only exemplary implementations of the disclosed technology and should not be taken as limiting the scope of the disclosure. Rather, the scope of the disclosure is at least as broad as the following claims and their equivalents.

The invention claimed is:

1. A golf club head comprising:

a club head body and a smart feature coupled to the club head body, the smart feature comprising a battery and at least one additional electrical device;

a club head cover that is placeable over the golf club head and removeable from the golf club head, wherein the club head cover comprises a magnet and the smart feature comprises a magnetometer or magnetic field sensor, such that the smart feature can detect whether the club head cover is positioned over the golf club head or not;

wherein the smart feature is configured to be in a sleep mode when the smart feature detects that the club head cover is positioned over the golf club head, and to awaken from sleep mode when the smart feature detects that the club head cover is removed from the golf club head;

wherein the golf club head has a club head mass and the smart feature has a smart feature mass of from 1 gram to 50 grams, and a ratio of the smart feature mass to the club head mass is from 1% to 25%; and wherein the golf club head has a club head volume and the smart feature has a smart feature volume, and a ratio of the smart feature volume to the club head volume is from 0.1% to 10%.

2. The golf club head of claim 1, wherein the at least one additional electrical device comprises a sensor, a measurement system, a data transmission system, a data storage system, or a computing system.

3. The golf club head of claim 1, wherein the body defines an internal cavity and the smart feature is positioned within the internal cavity.

4. The golf club head of claim 1, wherein the smart features is coupled to an exterior of the body.

5. The golf club head of claim 1, wherein the golf club head is not a putter head.

6. The golf club head of claim 1, wherein the smart feature is removable from the body and replaceable.

7. The golf club head of claim 1, wherein the battery is rechargeable.

8. The golf club head of claim 1, wherein the smart feature comprises a smart weight that is adjustable relative to the body to adjust mass distribution characteristics of the club head.

9. The golf club head of claim 8, wherein the smart weight is swappable with a dummy weight.

10. The golf club head of claim 8, wherein the smart weight is part of a set of weights having differing masses that are interchangeably couplable to the body.

11. The golf club head of claim 1, wherein the ratio of the smart feature mass to the club head mass is from 2% to 20%.

12. The golf club head of claim 11, wherein the golf club head volume ranges from 110 cc to 600 cc, the smart feature volume ranges from about 4 cc to about 10 cc.

13. A golf club head comprising:

a club head body and a smart feature coupled to the club head body, the smart feature comprising a battery and at least one additional electrical device; and a club head cover that is placeable over the golf club head and removeable from the golf club head, wherein the club head cover comprises a magnet and the smart feature comprises a magnetometer or magnetic field sensor, such that the smart feature can detect whether the club head cover is positioned over the golf club head or not;

wherein the golf club head has a club head mass and the smart feature has a smart feature mass of from 1 gram to 50 grams, and a ratio of the smart feature mass to the club head mass is from 1% to 25%; and wherein the smart feature is configured to be in a sleep mode when the smart feature detects that the club head cover is positioned over the golf club head, and to awaken from sleep mode when the smart feature detects that the club head cover is removed from the golf club head.

14. The golf club head of claim 13, wherein the smart feature comprises a smart weight that is swappable with a dummy weight.

15. The golf club head of claim 13, wherein the golf club head has a club head volume and the smart feature has a smart feature volume, and a ratio of the smart feature volume to the club head volume is from 0.1% to 10%.

* * * * *